US008528494B2

(12) United States Patent
Moody

(10) Patent No.: US 8,528,494 B2
(45) Date of Patent: Sep. 10, 2013

(54) MODULAR ROUGH WATER DOCKING SYSTEM

(75) Inventor: Larry D. Moody, Fall City, WA (US)

(73) Assignee: Wavemaster Docking Systems, Ltd., Youbou (CA)

( * ) Notice: Subject to any disclaimer, the term of this patent is extended or adjusted under 35 U.S.C. 154(b) by 203 days.

(21) Appl. No.: 12/979,032

(22) Filed: Dec. 27, 2010

(65) Prior Publication Data

US 2011/0155037 A1 Jun. 30, 2011

Related U.S. Application Data

(60) Provisional application No. 61/290,727, filed on Dec. 29, 2009.

(51) Int. Cl.
*B63B 35/44* (2006.01)

(52) U.S. Cl.
USPC ..... 114/263; 114/219; 114/266; 405/219

(58) Field of Classification Search
USPC ..... 114/263, 266, 267, 219; 405/218, 405/219, 220, 221, 212, 215
See application file for complete search history.

(56) References Cited

U.S. PATENT DOCUMENTS

| | | | | |
|---|---|---|---|---|
| 4,041,716 | A * | 8/1977 | Thompson | 405/219 |
| 4,940,021 | A | 7/1990 | Rytand | |
| 5,390,620 | A | 2/1995 | Murphy | |
| 5,625,985 | A | 5/1997 | Johnson | |
| 5,649,787 | A * | 7/1997 | Hirose et al. | 405/219 |
| 6,003,464 | A | 12/1999 | Long | |
| 6,374,763 | B1 * | 4/2002 | Hartman | 114/263 |
| 6,695,541 | B1 | 2/2004 | Spence | |
| 6,833,410 | B2 | 12/2004 | Swain | |
| 7,243,608 | B2 | 7/2007 | Knight, Jr. et al. | |
| 2004/0200397 | A1 | 10/2004 | Klein | |
| 2007/0245942 | A1 | 10/2007 | Sestito et al. | |
| 2009/0266010 | A1 | 10/2009 | Lomske et al. | |

OTHER PUBLICATIONS

PCT/US2010/62154 International Search Report, dated May 25, 2011 (4 pgs.).

* cited by examiner

*Primary Examiner* — Lars A Olson
(74) *Attorney, Agent, or Firm* — Fulbright & Jaworski, L.L.P.; Colin Lee Fairman

(57) ABSTRACT

A modular dock unit and system for making large modular dock systems is disclosed. The dock unit includes a molded floatation shell, a molded decking piece and a molded dri-loc retainer ring. The floatation shell has column supports molded therein suitable for holding support members. In use, support member are placed in flanges molded into the support columns and the floatation shell rim. The dri lock retainer is placed on the side support members and the decking piece is opposed to the dri-loc retainer. Mounting aids such as tongue and groove members are molded in opposing pieces of floatation shell, retainer and deck and secured where necessary. The dock unit also includes a boat bumper system that mates with the dock units to surround the modular dock system. When assembled, the dock unit comprises a water-tight flotation cavity protecting the internal components and providing buoyancy to the dock unit.

37 Claims, 49 Drawing Sheets

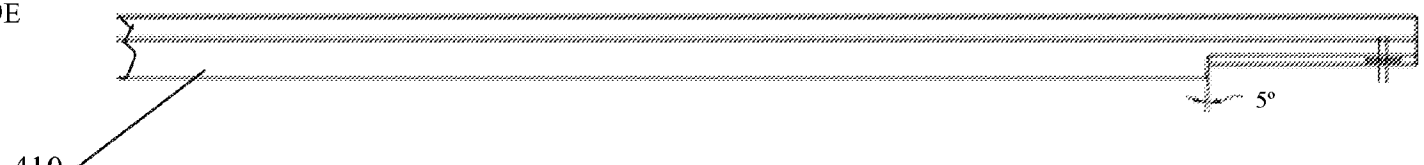
FIG. 39E
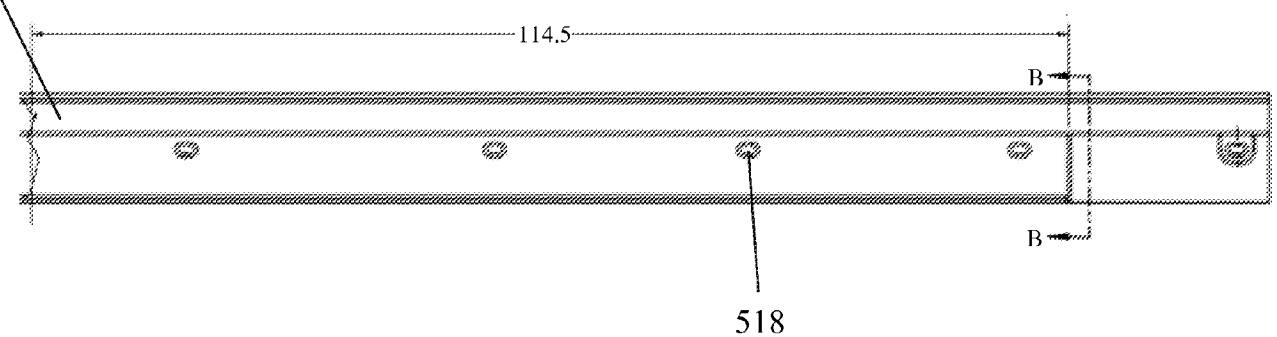
FIG. 39F
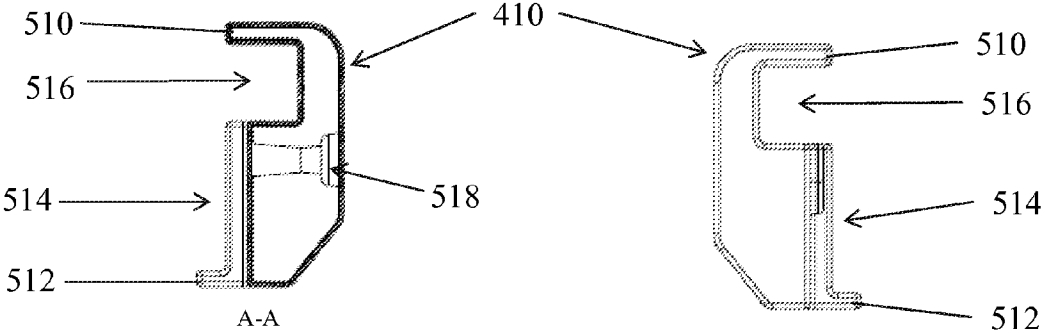
FIG. 39H
FIG. 39G

412

412

416

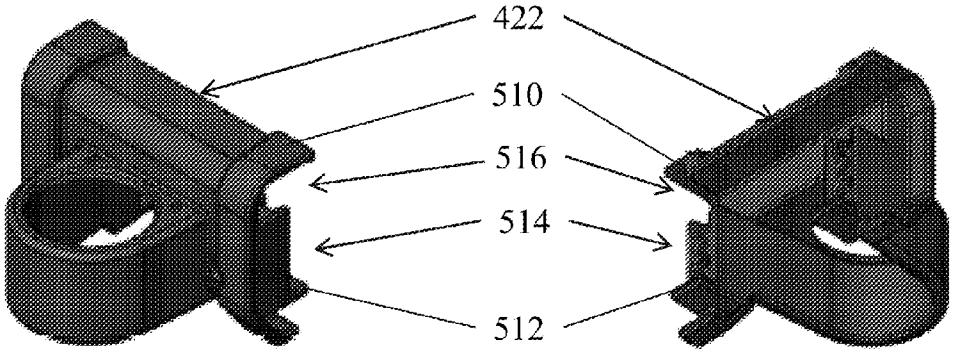
FIG. 45B
FIG. 45A
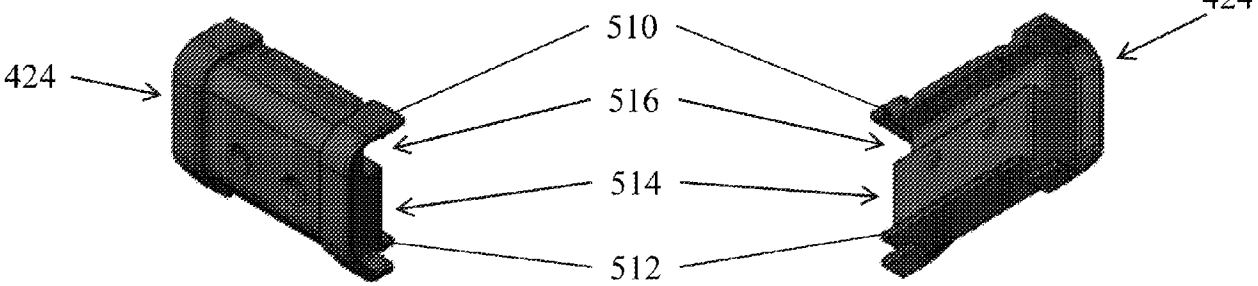
FIG. 46B
FIG. 46A

MODULAR ROUGH WATER DOCKING SYSTEM

This application claims priority to U.S. provisional patent application 61/290,727 filed Dec. 29, 2009 the contents of which are incorporated herein in their entirety for all purposes.

FIELD OF THE INVENTION

This invention is directed to floating dock units and a modular system for constructing floating docks.

BACKGROUND OF THE INVENTION

Floating docks are generally known and may be constructed from a variety of materials and formed into a variety of shapes and sizes. At least some known floating docks include a plurality of floating units coupled together to form a floating dock system. Generally, the floating units are designed to withstand a variety of environmental and weather conditions. More specifically, within at least some known floating units, pockets or cavities are defined that facilitate increasing the buoyancy of the dock, and thus facilitate maintaining the dock afloat.

Further, at least some known floating docks systems have coupling mechanisms that enable multiple configurations of the floating members to be assembled such that the dock can accommodate a variety of boat sizes and other uses. Generally, such coupling mechanisms include couplers designed to facilitate ease of assembly and disassembly of floating units, and coupler receivers or sockets are designed to receive a variety of couplers and dock accessories. More specifically, within at least some known coupling mechanisms, the couplers include multiple components. Although the couplers generally ensure the floating units remain connected, couplers that include multiple components may increase the assembly time of the docks and may reduce the reliability of the entire dock system.

Prior art individual unit assembly is made by using multiple parts for the bottom section, top section and side walls. Therefore, each of the units is subjected to individual stress at their point of assembly. In addition, while some floating dock units disclosed unitary floating members, their means of floatation was limited and their ability for transport and storage was greatly limited. For example, U.S. Pat. No. 7,243,608 describes a modular dock unit which includes a top and a bottom connected by side walls. The units are unitary pieces that are then clad with decking members. As will be appreciated by those of skill in the art, the dock units are cumbersome and hard to store and transport while also providing limited floatation capacity. Further, the connection of the individual units into a multiple unit dock system is by means of connectors which allow the individual units to move independently of each other. Those of skill in the art will appreciate that walking from one unit to another unit can, therefore, be difficult, especially at times when the water is rough and the weather is inclement. In addition, it should be appreciated that each connection also provides a point of stress between the units and is subject to breakage and or rupture independently.

U.S. Pat. No. 6,695,541 describes modular floating dock sections. The sections described are hollow dock units. The units are molded to include the top and bottom portions connected by the side walls. The individual units are connected to each other by male type anchors fitted into female receiving sockets molded into the side wall of each unit. The anchors are then secured to each other using a tie-rod. While the system disclosed in the '541 patent directly connects the individual units to each other, eliminating independent movement of each unit in relation to each other, the units are bulky, hard to transport and, in addition, the connecting anchors and tie-rod are exposed to the environment and, thus, subject to weather, corrosion and rupture.

Therefore, it would be advantageous to provide a modular dock system that eliminated independent movement between units but that also provided ease of shipment and storage and which further allowed connecting units, and hardware to be removed from exposure to the elements but also provided a secure and direct form of attachment between the individual units.

SUMMARY OF THE INVENTION

A modular dock unit and system for making large modular dock systems is disclosed. The system includes a molded floatation shell, a molded decking piece and a molded dri-loc retainer ring. The floatation shell has column supports molded therein suitable for holding independent frame support members. In use, frame support members are placed in flanges molded into the support columns and the floatation shell rim. The dri-lock retainer is placed on the side support members and the decking piece is opposed to the dri-loc retainer. Mounting aids such as tongue and groove members are molded in opposing pieces of floatation shell, retainer and deck and secured where necessary. The dock unit also includes side rails that mate with the dock units also by molded mounting aids. When assembled, the dock unit comprises a water-tight floatation cavity protecting the internal frame components and providing buoyancy to the dock unit.

Therefore, in various exemplary embodiments, the invention disclosed herein provides a molded floatation shell including a bottom and side walls, a molded foam filled decking piece designed and configured to fit over the top of the floatation shell, and a molded dri-lock retainer ring designed and configured to fit between the decking piece and the floatation shell. Upon securing of decking piece to the floatation shell, with the retainer ring interposed therebetween, a water-tight floatation chamber is created. Each assembled unit thereby provides a floating dock unit.

In some exemplary embodiments, the molded floatation shell, the foam decking piece and the dri-loc retainer ring are made by rotational molding. In still other exemplary embodiments, the floatation shell is further molded to include support columns in the interior of the floatation shell ascending from the bottom of the shell to the upper rim of the shell. In various exemplary embodiments, the columns are hollow in the interior. In these exemplary embodiments, the shells are stackable, nesting within each other such that each additional shell increases the height of the stack by little more than the thickness of the shell. In various exemplary embodiments, the thickness of the shell may be as little as about, approximately one-quarter inch up to 6" depending on the thickness of the floatation shell as a single wall part up to and including a double wall part that is also foam filled. Further, when nested together, the stacks of floatation shells are extremely space efficient and are easy to transport. However, those of skill in the art will recognize that the floatation shell, the decking piece and the dri-loc retainer ring can be made by any suitable method, including conventional molding or milling. In some exemplary embodiments the dri-loc retainer ring and the decking piece are made using "one-step" foam rotational molded technology or a two-step foam molded technology.

Further, while in some exemplary embodiments, the floating dock units are rectangular, and have dimensions of approximately 24'×4'×2'; 24'×6'×2'; 24'×8'×2'; and 12'×24'×2', those of skill in the art will recognize that one advantage of molding the units is that they can be any size required such as circular, hexagonal, trapezoidal, etc. Therefore, there is very little limitation imposed upon the size and shape of the units disclosed according to the instant invention.

In various exemplary embodiments, the floatation shell is molded to include flanges disposed within side walls of the shell and the support columns. The flanges are designed and configured to accept support members such that when the dock unit is assembled, the support members are securely held in place in the watertight floatation chamber by the foam decking piece to which the support members also provide support. In still other various exemplary embodiments, the dock unit includes a molded side rail dimensioned and configured to intercalate between the decking piece and the dri-loc ring such that when the dock unit is assembled, the side rail is securely held in place. In addition, in various other exemplary embodiments, the molded side rail is hollow providing a flexing side rail, thereby eliminating the need for accessories such as boat bumpers.

In some exemplary embodiments, the invention also includes methods for connecting the modular dock units such that the dock units can be securely attached to each other in any desired configuration. In these exemplary embodiments, the dock units are connected directly to each other allowing multiple units to move in unison with each other, eliminating independent movement of each unit as it floats on the water. In addition, according to various exemplary embodiments, the hardware used for connecting the dock units is enclosed within the floatation chamber so as to eliminate exposure to water and elements.

In other exemplary embodiments, the invention further includes a modular floating dock system. In these embodiments, the modular floating dock system includes two or more modular floating dock units, each unit including a molded floatation shell, a foam filled decking piece, and a dri-loc retainer ring interposed between the floatation shell and the decking piece. In these exemplary embodiments, the assembled dock units creates a water-tight floatation chamber therein. In various exemplary embodiments, support members are located inside the floatation chamber, thereby removing them from exposure to the water and the environment. In some exemplary embodiments, the two or more floatation shells are connected so as to eliminate independent movement between the two or more dock units. In these exemplary embodiments, the hardware connecting the modular dock units is located inside the floatation chamber, thereby removing it from exposure to the water and the environment. In some embodiments, the modular floating dock system further includes a linear boat bumper that surrounds the dock system.

In various other exemplary embodiments, the invention includes a linear boat bumper system suitable for use on an aquatic dock comprising a plurality of hollow molded bumper units the bumper units being optimized to provide an upper lip, an expansion pocket, a side rail recess and a lower lips such that a deck edge and side rail of the aquatic dock are encased in the linear boat bumper unit, the hollow unit having resilience and providing a cushion for object moored against the linear boat bumper unit, the boat bumper units combinable to allow for various aquatic dock designs.

In these exemplary embodiments, the floatation shells are molded to include support columns disposed therein. In these embodiments, the support columns extend from the floor of the floatation shell to about the rim of the floatation shell. In these exemplary embodiments, the rim of the floatation shell and the support columns have flanges molded therein dimensioned and configured to accept the support members. In various exemplary embodiments, when the dock unit is assembled, the support members are securely held in place by the decking unit disposed thereon.

These and other features and advantages of the present invention will be set forth or will become more fully apparent in the description that follows, the drawings and in the appended claims. The features and advantages may be realized and obtained by means of the elements and combinations particularly pointed out in the appended claims. Furthermore, the features and advantages of the invention may be learned by the practice of the invention or will be apparent from the description, as set forth hereinafter.

BRIEF DESCRIPTION OF THE FIGURES

Various exemplary embodiments of the compositions and methods according to the invention will be described in detail, with reference to the following figures wherein:

FIGS. 39A-H show various perspectives of a 24 ft side rail portion of one embodiment of a linear boat bumper according to the invention. FIG. 39A is a perspective rendering of the side rail. FIG. 39B is a bottom plan view of a portion of the side rail. FIG. 39C is a side plan view of the side rail. FIG. 39D is a cross section of the side rail taken along line B-B of the view shown in FIG. 39C. FIG. 39E is a top-plan view of a portion of the side rail. FIG. 39F is a back-plan view of a portion of the side rail. FIG. 39G is a cross section of the side rail taken along line A-A of FIG. 39F. FIG. 39H is a right end view of the side rail.

FIG. 40C is a schematic diagram of a perspective top-plan view of the cover. FIG. 40D is a schematic diagram of a bottom-plan view of the cover. FIG. 40E is a side plan view of the cover. FIG. 40F is a cross section of the cover taken along line C-C of FIG. 40. FIG. 40G is a cross section of the cover taken along line A-A of FIG. 40E.

FIG. 41A is a perspective top-plan view of the cleat bracket cover according to one embodiment of the invention. FIG. 41B is a side-plan view of this embodiment. FIG. 41C is a cross section through lines A-A shown in FIG. 41B. FIG. 41D is a top-plan view of the cleat bracket. FIG. 41E is a cross section of the cleat bracket taken along lines B-B of FIG. 41D.

FIG. 42A is a perspective, top-plan outside view of the bumper part. FIG. 42B is a perspective bottom-plan view of the bumper part according to the invention. FIG. 42C is a schematic side-plan view of the bumper part. FIG. 42D is a cross section taken along lines A-A of FIG. 42C. FIG. 42E is a cross section of the bumper part taken along lines C-C of FIG. 42C. FIG. 42F is a perspective end-plan view of the bumper part and FIG. 42G is a cross section through the bumper along lines B-B shown in FIG. 42F.

FIG. 43A is a perspective top-plan view of the bumper piece. FIG. 43B is a right side view while FIG. 43C is a cross section view taken through line A-A of FIG. 43B. FIG. 43D is a left side view and FIG. 43E is a cross section of FIG. 43D taken along lines B-B. FIG. 43F is a bottom plan view of the bumper part and FIG. 43G is a top plan view of the bumper FIG. 44A is a perspective top-plan view. FIG. 44B is a perspective bottom-plan view. FIG. 44C is a schematic diagram of a side plan view while FIG. 44D is a cross section of the bracket cover taken along lines A-A of FIG. 44C.

FIGS. 45A-45B illustrate one embodiment of a small piling bracket cover according to one embodiment of a linear boat bumper system according to the invention. FIG. 45A is a perspective top-plan view while FIG. 45B is a perspective bottom-plan view of the small piling bracket cover.

FIGS. 46A-46B illustrate one embodiment of a splice bracket cover according to one embodiment of a linear boat bumper system according to the invention. FIG. 46A is a perspective top-plan view of the bracket cover and FIG. 46B is a perspective, inside bottom-plan view.

FIG. 47A is a top-plan perspective view. FIG. 47B is a side-plan view. FIG. 47C is a cross section view taken along line A-A of FIG. 47B. FIG. 47D is a top-plan view and FIG. 47E is a cross section of FIG. 47D taken through line B-B.

FIG. 48A is a perspective top-plan view. FIG. 48B is a perspective bottom-plan view.

FIG. 49A is a perspective top-plan.

DETAILED DESCRIPTION OF THE EXEMPLARY EMBODIMENTS

Figure 1:
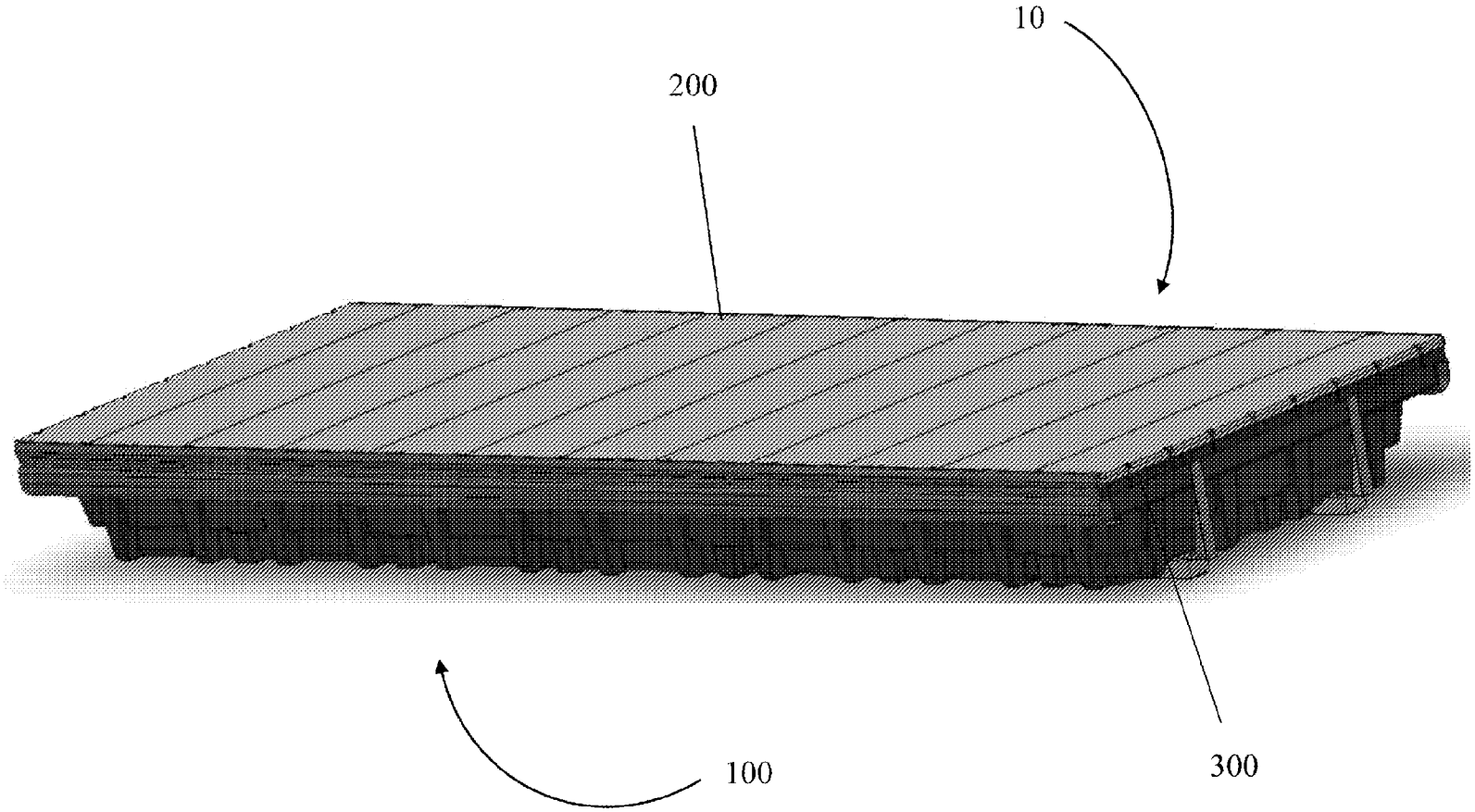
FIG. 1 is a perspective view of a completed dock unit according to one exemplary embodiment of the invention.

A modular dock unit and system for making large modular dock networks is disclosed. The system includes a rotational molded floatation shell, a rotational molded decking piece and a rotational molded dri-loc retainer ring. The floatation shell has column supports molded therein suitable for holding support members. In use, support frame members are placed in flanges molded into the support columns and the floatation shell rim. The dri-lock retainer is placed and attached on the side support members and the decking piece is opposed to the dri-loc retainer. Mounting aids such as tongue and groove members are molded in opposing pieces of floatation shell, retainer and deck and secured where necessary. The dock unit also includes side rails that mate with the dock units also by molded mounting aids. When assembled, the dock unit comprises a water-tight flotation cavity protecting the internal components and providing buoyancy to the dock unit.

Therefore, in various exemplary embodiments, the invention disclosed herein provides a molded floatation shell including a bottom and side walls, a molded foam decking piece designed and configured to fit over the top of the floatation shell, and a molded dri-lock retainer ring designed and configured to fit between the decking piece and the floatation shell. Upon securing of decking piece to the floatation shell, with the retainer ring interposed therebetween, a water-tight floatation chamber is created. Each assembled unit thereby provides a floating dock unit.

In some exemplary embodiments, the molded floatation shell, the foam decking piece and the dri-loc retainer ring are made by rotational molding. In still other exemplary embodiments, the floatation shell is further molded to include support columns in the interior of the floatation shell ascending from the bottom of the shell to the upper rim of the shell. In various exemplary embodiments, the columns are hollow in the interior. In these exemplary embodiments, the shells are stackable, nesting within each other such that each additional shell increases the height of the stack by little more than the thickness of the shell. In various exemplary embodiments, the floatation shell is between about 3/16 to about 1/4 inches in thickness. However, those of skill in the art will appreciate that the floatation shell can be any thickness desirable that is amendable either a single wall or a double wall part which is foam filled utilizing a foam molding fabrication. Further, when nested together, the stacks of floatation shells are extremely space efficient and are easy to transport. Those of skill in the art will recognize that the floatation shell, the decking piece and the dri-loc retainer ring can be made by any suitable method, including conventional molding or milling. In some exemplary embodiments, the dri-loc retainer ring and the decking piece are made using "one-step" rotational molded technology. In other exemplary embodiments, the molded dock unit components are made using two-step molding technology.

Further, while in some exemplary embodiments, the floating dock units are rectangular, and have dimensions of approximately 24'×4'×2'; 24'×6'×2'; and 24'×8'×2'; and 12'×24'×2', those of skill in the art will recognize that one advantage of molding the units is that they can be any size required such as circular, hexagonal, trapezoidal, etc. Therefore, there is very little limitation imposed upon the size and shape of the units disclosed according to the instant invention.

In various exemplary embodiments, the floatation shell is molded to include flanges disposed within side walls of the shell and the support columns. The flanges are designed and configured to accept support members such that when the dock unit is assembled, the support members are securely held in place in the watertight floatation chamber by the foam decking piece to which the support members also provide support. In still various other exemplary embodiments, the dock unit includes a molded side rail dimensioned and configured to intercalate between the decking piece and the dri-loc ring such that when the dock unit is assembled the side rail is securely held in place. In addition, in various exemplary embodiments, the molded side rail is hollow and allows flexing, thereby eliminating the need for accessories such as boat bumpers.

In some exemplary embodiments, the invention also includes methods for connecting the modular dock units such that the dock units can be securely attached to each other in any desired configuration. In these exemplary embodiments, the dock units are connected directly to each other allowing multiple units to move in unison with each other eliminating independent movement of each unit as it floats on the water. In addition, according to various exemplary embodiments, the hardware used for connecting the dock units is enclosed within the floatation chamber so as to eliminate exposure to water and elements.

In other exemplary embodiments, the invention further includes a modular floating dock system. In these embodiments, the modular floating dock system includes two or more modular floating dock units, each unit including a molded floatation shell, a foam decking piece, and a dri-loc retainer ring interposed between the floatation shell and the decking piece. In these exemplary embodiments, the assembled dock units create a water-tight floatation chamber therein. In various exemplary embodiments, support members are located inside the flotation chamber, thereby removing them from exposure to the water and the environment. In some exemplary embodiments, the two or more floatation shells are connected so as to eliminate independent movement between the two or more dock units. In these exemplary embodiments, the hardware connecting the modular dock units is located inside the floatation chamber, thereby removing it from exposure to the water and the environment.

In these exemplary embodiments, the floatation shells are molded to include support columns disposed therein. In these embodiments, the support columns extend from the floor of the floatation shell to about the rim of the floatation shell. In these exemplary embodiments, the rim of the floatation shell and the support columns have flanges molded therein dimensioned and configured to accept the support members. In various exemplary embodiments, when the dock unit is assembled, the support members are securely held in place by the decking unit disposed thereon.

In various other exemplary embodiments, the invention includes a linear boat bumper system suitable for use on an aquatic dock comprising a plurality of hollow molded bumper units the bumper units being optimized to provide an upper lip, an expansion pocket, a side rail recess and a lower lips such that a deck edge and side rail of the aquatic dock are encased in the linear boat bumper unit, the hollow unit having resilience and providing a cushion for object moored against the linear boat bumper unit, the boat bumper units combinable to allow for various aquatic dock designs.

Referring now to FIG. 1, a top-plan, perspective view of one dock unit 10 according to one exemplary embodiment of the invention is illustrated. As shown, the dock unit 10 includes a molded floatation shell 100, a foam filled decking piece 200 and a dri-lock retainer interposed between the two.

Figure 2:
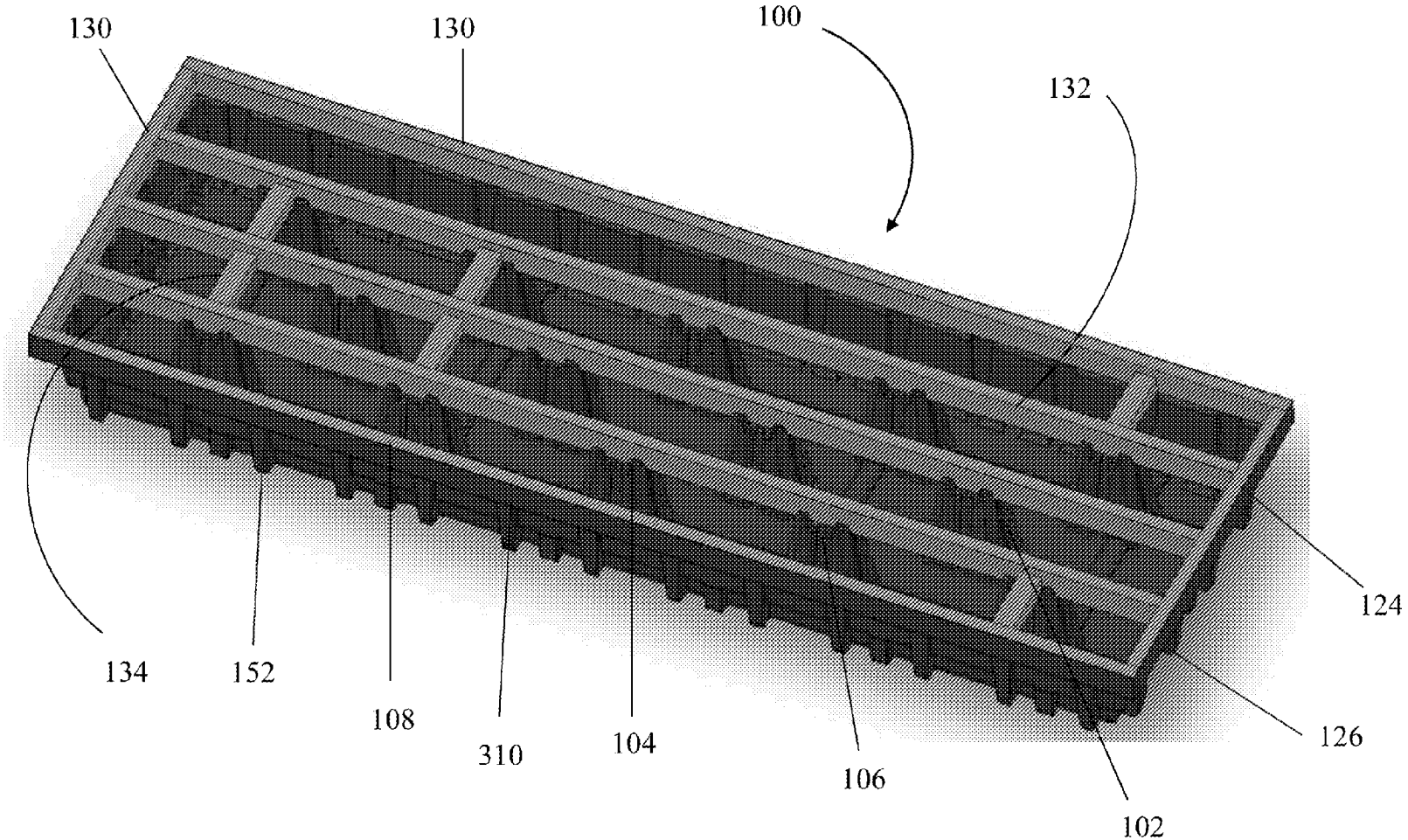
FIG. 2 is a top-plan, perspective view of the interior of the molded floatation shell according to the embodiment of the invention illustrated in FIG. 1.

FIG. 2 illustrates the interior of the floatation shell 100. As shown, the floatation shell 100 is of unitary construction comprising a bottom and in the rectangular embodiment illustrated, four side walls. In some exemplary embodiments, the floatation shell is made by rotational molding. While the embodiments shown illustrates the floatation shell having a rectangular size, those of skill in the art will recognize that the floatation shell can have any size desired limited only by the limits of rotational molding construction. As shown in FIG. 2, the floatation shell has four side walls 124 with each side molded to include a lip or rim 126 thereon dimensioned and configured to side support member 130. The floatation shell 100 also includes support columns 102 regularly spaced therein and about equal in height to the side walls. In various exemplary embodiments, the support columns further include flanges 104 projecting upward from the end and configured to create grooves 106 or pockets therein dimensioned and configured to accept longitudinal 132 and transverse 134 support members. Therefore, those of skill in the art will appreciate that the depth of the floatation shell can be any depth that is great enough to accommodate the support column and the support members. In various exemplary embodiments, the floatation shell has a depth of approximately two feet. However, as will become apparent, the depth can be as small as about one foot and can be any greater depth as desired.

Figure 3:
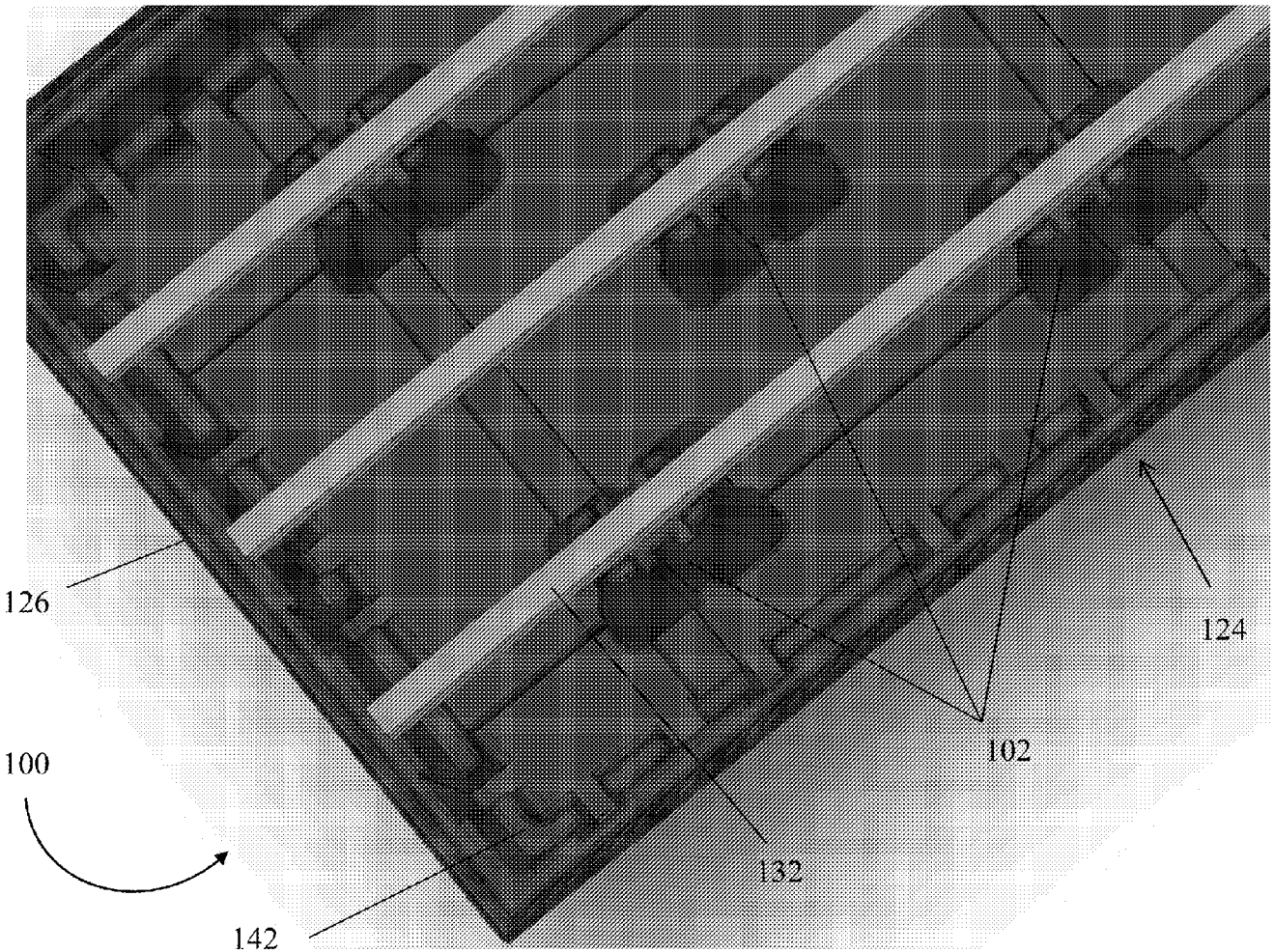
FIG. 3 is a partial top-plan, perspective view of the interior of the floatation shell illustrating the support columns holding the support members.

As illustrated in FIGS. 2 and 3, the floatation shells 100 can be molded to include regularly spaced support columns 102 as desired. Thus, in various exemplary embodiments, larger floatation shells will have more support columns while smaller floatation shells would have fewer support columns. As discussed above, the shells 100 and columns 102 are dimensioned and configured to accept support members 128 including side support members 130, longitudinal support members 132 and transverse support members 132. In various exemplary embodiments, side walls 124 and top rims 126 are adapted to accept side support members 130 (not shown) that fit into the side walls 124 of the floatation shells 100. In various exemplary embodiments, flanges 142 are molded into the side walls 124 of the floatation shells 100 to facilitate securing the side support members 130 to the floatation shell as shown in FIG. 3.

Figure 4:
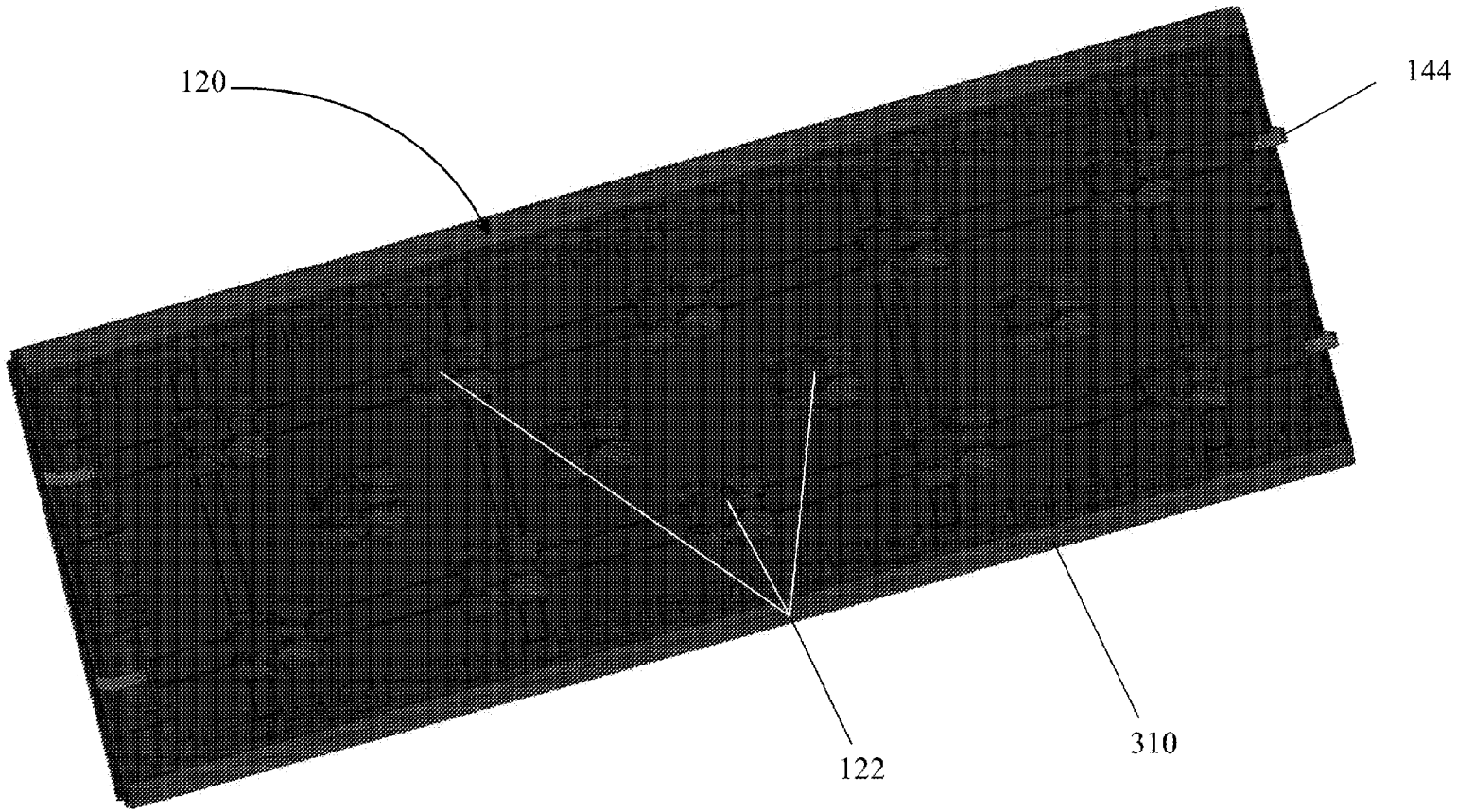
FIG. 4 is a perspective view of the bottom of molded flotation shell according to the embodiment of the invention shown in FIG. 1.

FIG. 4 is a perspective view of the underside 120 of a floatation shell 100 according to the exemplary embodiment of the invention shown in FIGS. 1-3. FIG. 4 illustrates the 3-dimensional nature of the floatation shell 100 and hollow support columns 122 disposed therein allowing the stacking or nesting of multiple floatation shells 100 for storage or shipment. Also shown, the interior of the support columns 122 comprise pockets for accepting a drag rail tongue securing the drag rail (not shown) to the underside 120 of the floatation shell 100. A support bracket 144 for the drag rail is also illustrated.

Figure 11:
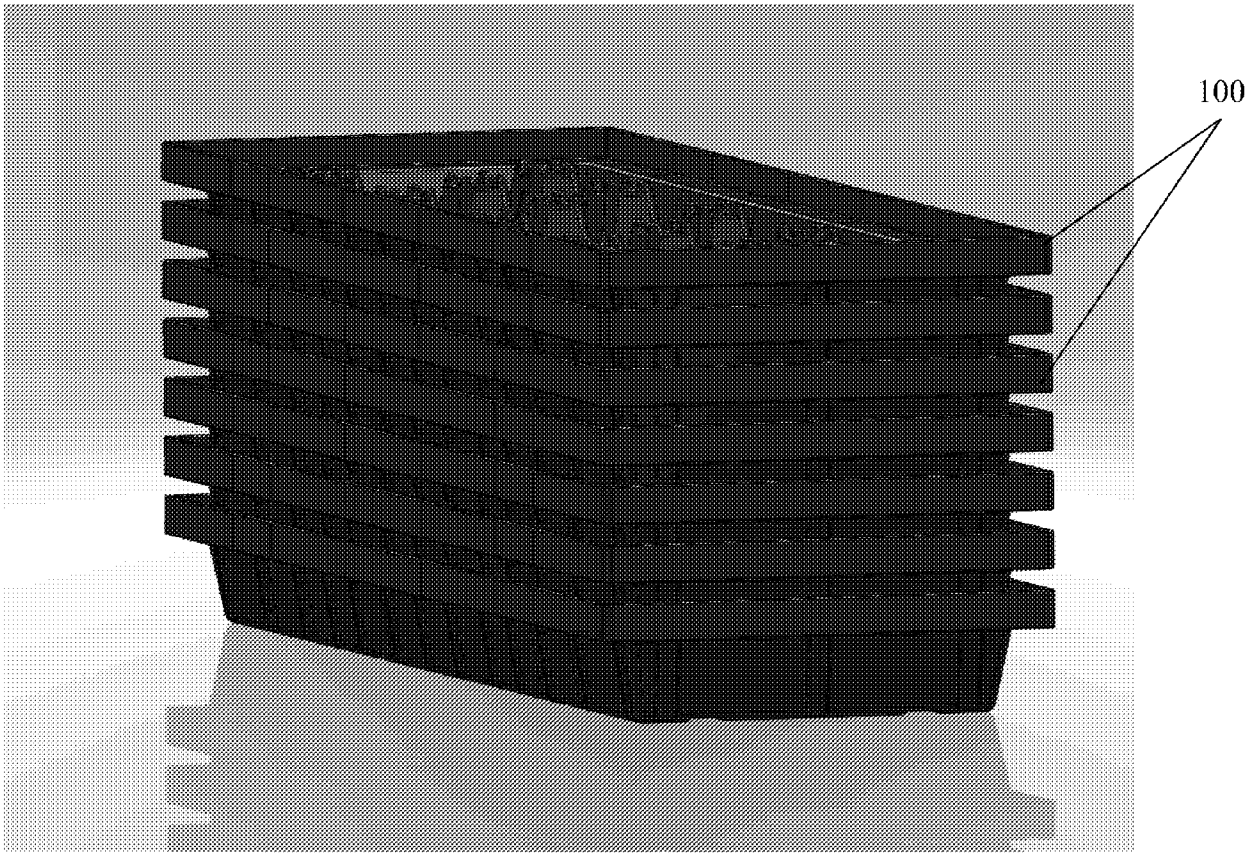
FIG. 11 is a side-plan, perspective view of multiple eight-foot sections of molded floatation shells nested in each other according to one exemplary embodiment of the invention. The flotation shells can be transported stacked and stored stacked, greatly increasing the economy for transportation and storage.

One advantage of providing hollow support columns 102 is illustrated diagrammatically in FIG. 11, showing that nesting stacked shells results in as little as about, approximately, a 4" to 16" increase in the size of the stack for each additional shell. Those of skill in the art will appreciate that the savings of space provided by nesting multiple floatation shells greatly reduces the cost of shipping compared to non-nesting units which require multiple trucks to transport the same number of floatation shells as when nested.

Figure 5:
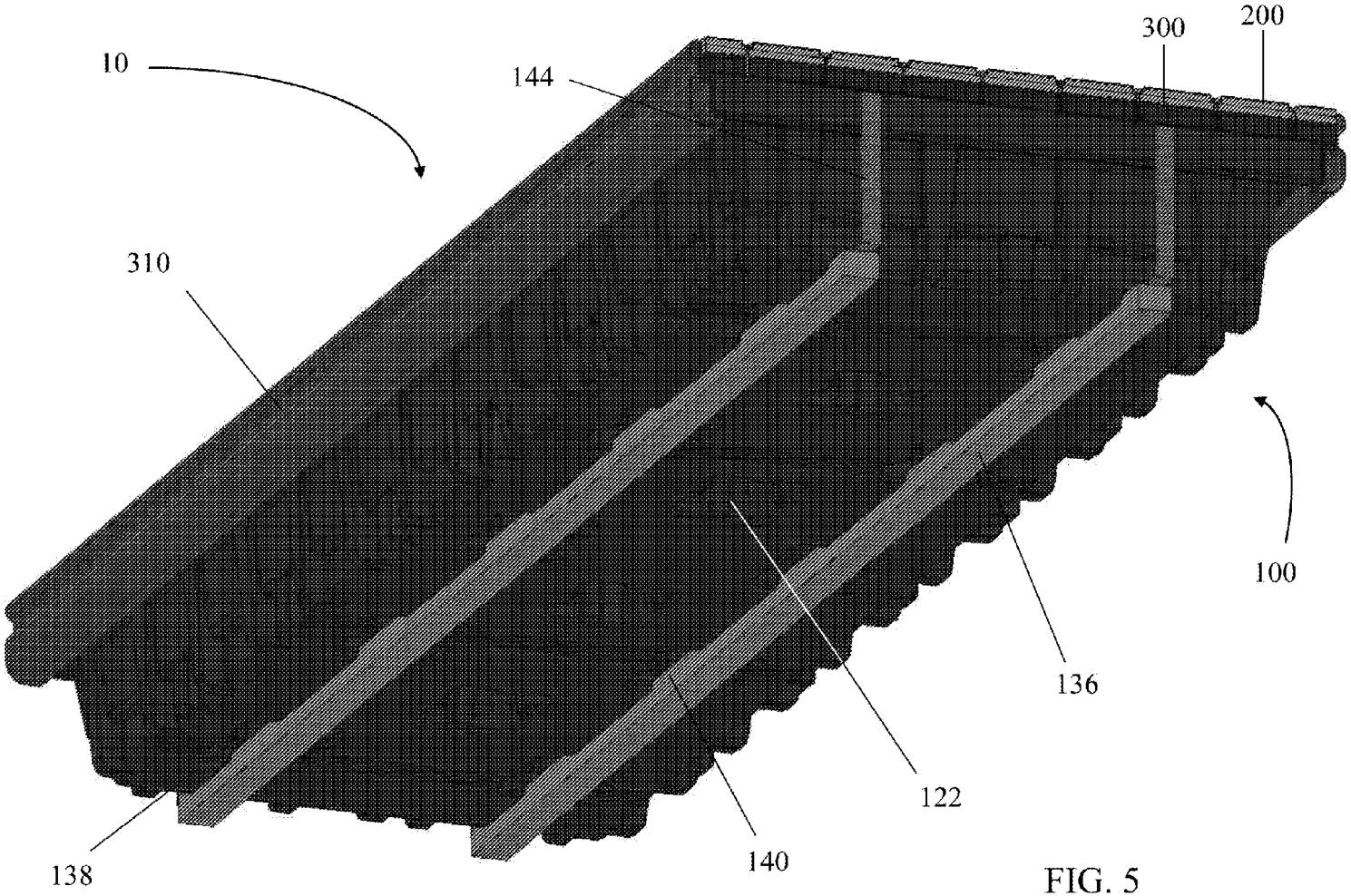
FIG. 5 is a bottom-plan, perspective view of an assembled dock unit according to the embodiment illustrated in FIG. 1

FIG. 5 is a bottom perspective view of a partially assembled dock unit 10. In this embodiment of the invention, drag rails 136 are included. Those of skill in the art will appreciate that drag rails 136 are only necessary on those dock units that contact the littoral bottom such as the first in a series of units along a lake, a river or an ocean. The drag rails 136 then accept the stress and deterioration resulting from constant impact and friction with the littoral bottom, thereby rescuing the floatation shell 100 from constant wear and tear. Further, according to the exemplary embodiment illustrated, the drag rails are easily affixed to the floatation shell bottom and can be easily removed and/or replaced as needed. Therefore, in various exemplary embodiments, the floatation shell can be molded such that the underside of the support columns 102 comprise a slot 138 dimensioned and configured to accept a tongue 140 on the drag rail 136 as illustrated in FIGS. 4 and 5. For ease of mounting, the drag rails need only be attached to the dock unit by use of a single drag rail support bracket 144 at the end of each drag rail 136. The drag rail support bracket 144 is bolted into the drag rail 136 at one end and at the other end is bolted through the floatation shell 100 into the side support member 130. Because the drag rail tongues 140 mate with the slots 138 molded into the bottom of the flotation shell 100, the drag rail 136 is easily yet securely affixed to the bottom of the flotation shell. Of course, those of skill in the art will appreciate that the drag rail is further affixed to the shell by use of any other necessary hardware such as bolts, nuts, screws, etc. Further, because only one mold is necessary to fabricate each size of floatation shell desired features, such as slots 138, are molded into every shell, each drag rail is replaceable with similar drag rails for all sizes of dock units 10.

Figure 6:
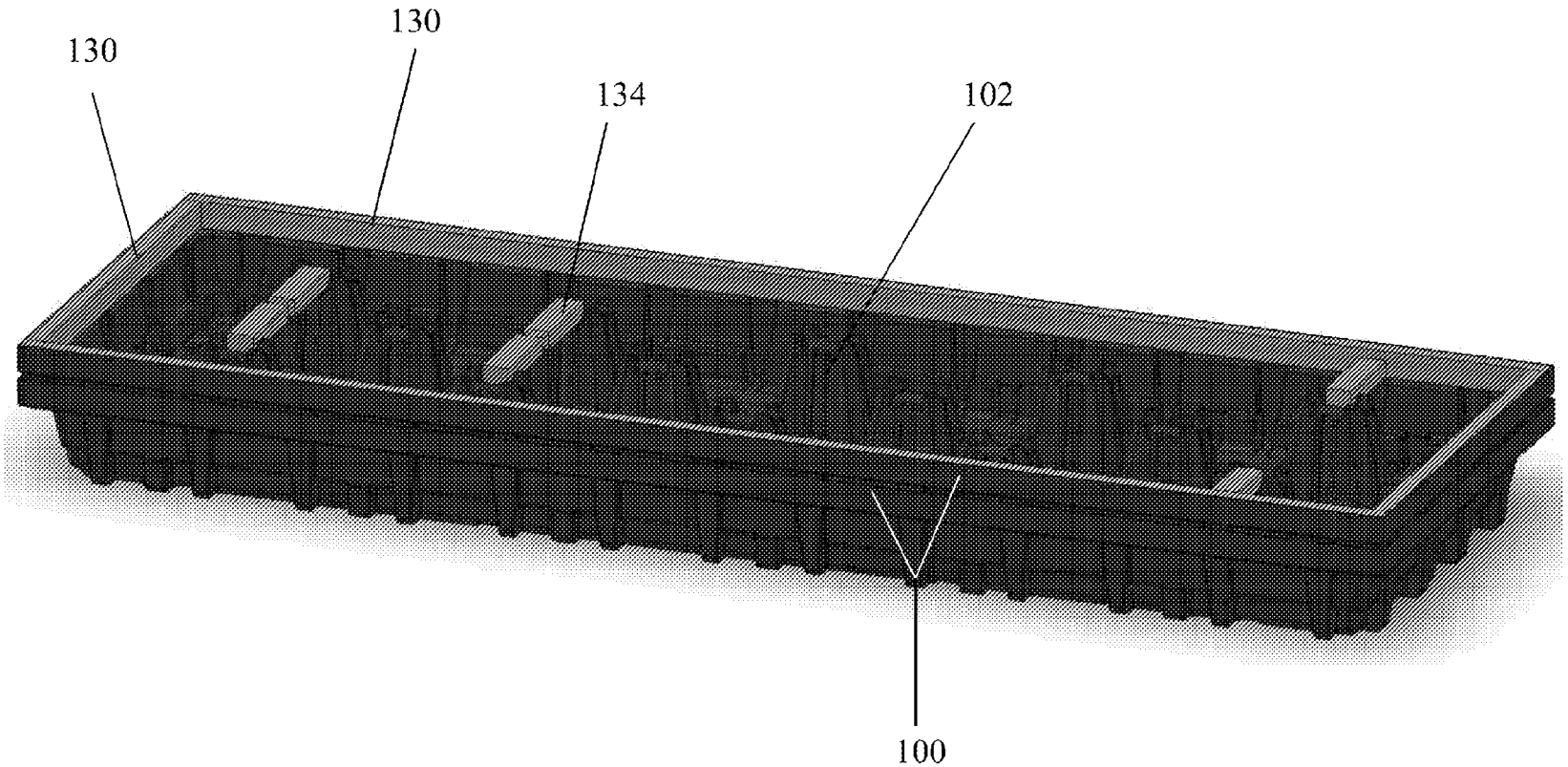
FIG. 6 is a top-plan, perspective view of two molded floatation shells nested for storage or shipment according to the exemplary embodiment illustrated in FIG. 1.

FIG. 6 is an illustration showing two floatation shells nested together. As discussed above, the fabrication of identical floatation shells by molding technology results in 3-dimensional, stackable floatation shells with the addition of each additional shell increasing the height of the stack by only approximately eight inches, e.g., the thickness of the shell. This feature greatly increases the economy of shipping and storing dock units and further increases the ease of assembly. Also illustrated in FIG. 6 are transverse support members 134 and side support members 130.

Figure 7:
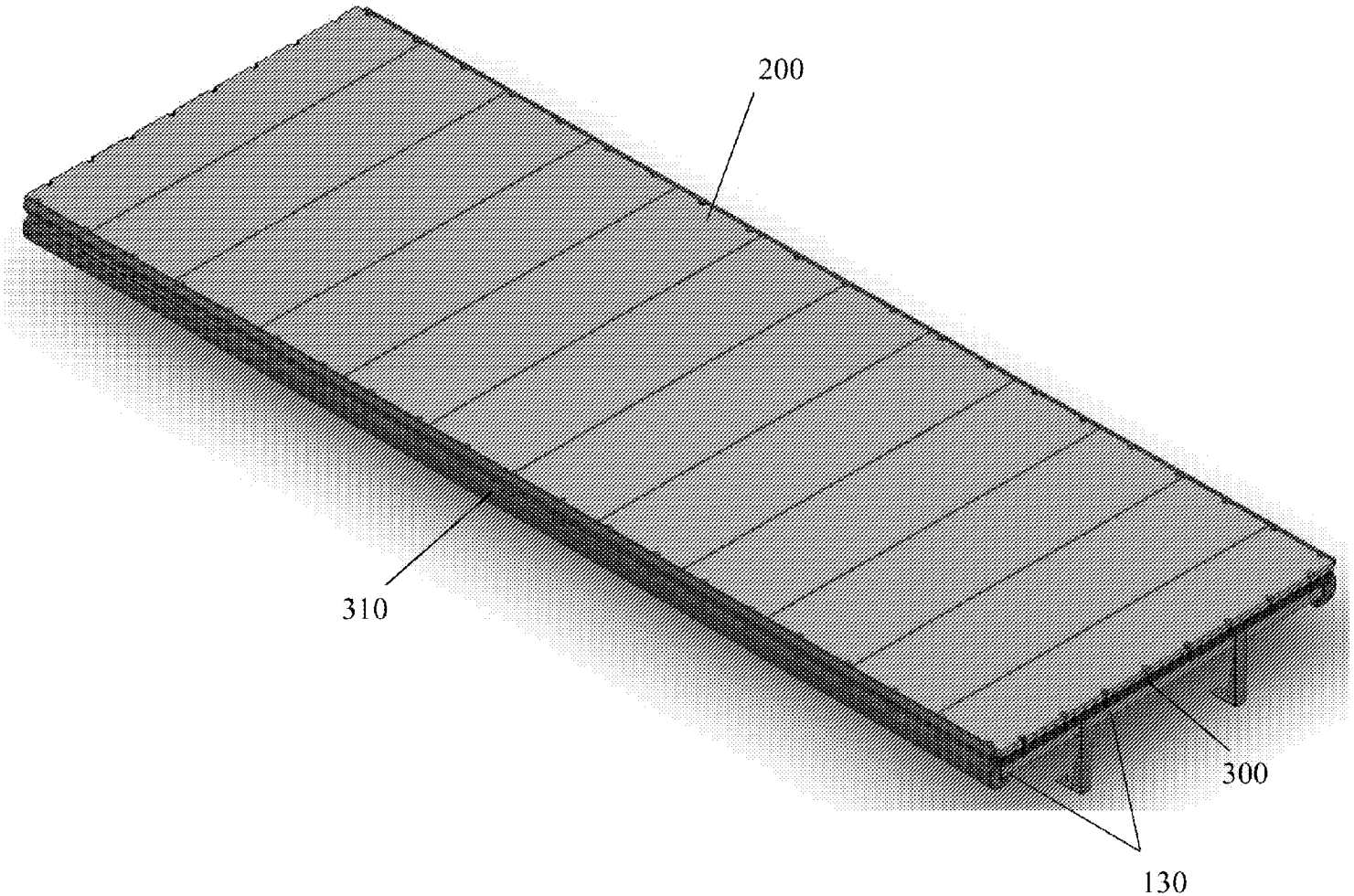
FIG. 7 is a top-plan perspective view of a foam filled decking piece according to the exemplary embodiment of the invention illustrated in FIG. 1.
Figure 8:
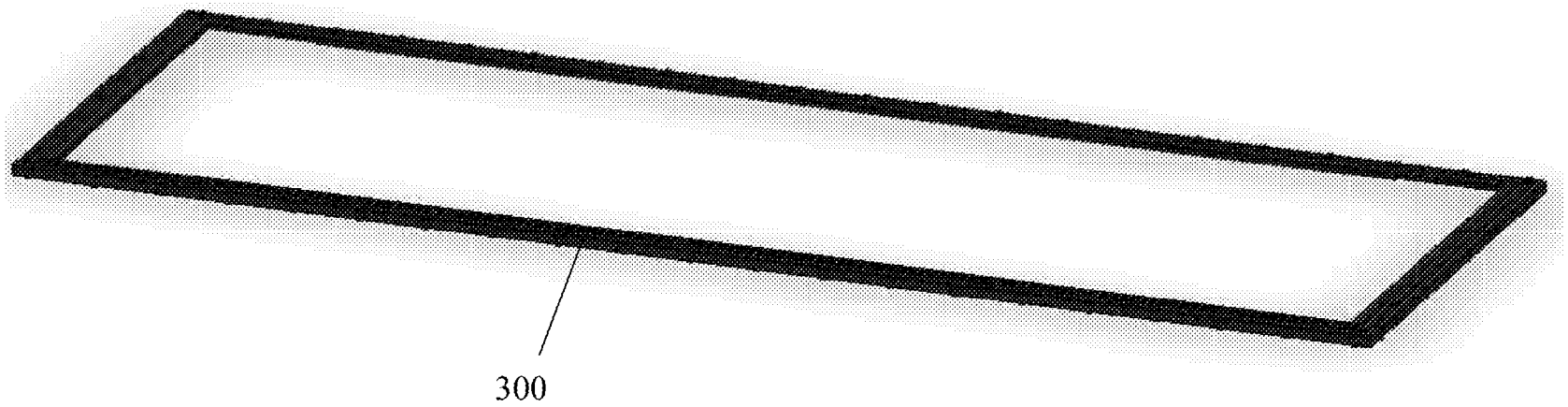
FIG. 8 is a perspective view of a dri-loc retainer ring according to one exemplary embodiment of the invention.

FIG. 7 illustrates a foam filled decking piece 200 according to one exemplary embodiment of the invention. As illustrated in FIG. 7, each decking piece 200 is unitary and molded to be matable to the floatation shell 100. Interposed between the floatation shell, the side support member 130 and the decking is a dri-loc retainer ring 300. Also illustrated is a side rail 310 configured to clad all deck units as desired. In various exemplary embodiments, the dri-loc retainer 300 is fabricated from polymers such as LLDPE resins (linear low-density polyethylene). Any type of resin used in conventional molding may be utilized. Examples of other types of resins useful in the method of this invention include polycarbonates, nylons, polyvinylchlorides, and polyesters. Additional useful resins include ABS, acetals, acrylics, cellulosics, epoxies, fluorocarbons, phenolics, polystyrenes, polyurethanes, SAN polymers, and silicone polymers EVA copolymers and EBA. The dri-loc retainer can be fabricated using moldable technology and is fabricated in any size necessary to conform to the dimensions of the floatation shell 100 and decking piece 200. FIG. 8 provides a schematic diagram of one exemplary embodiment of a dri-loc retainer ring 300.

Figure 9:
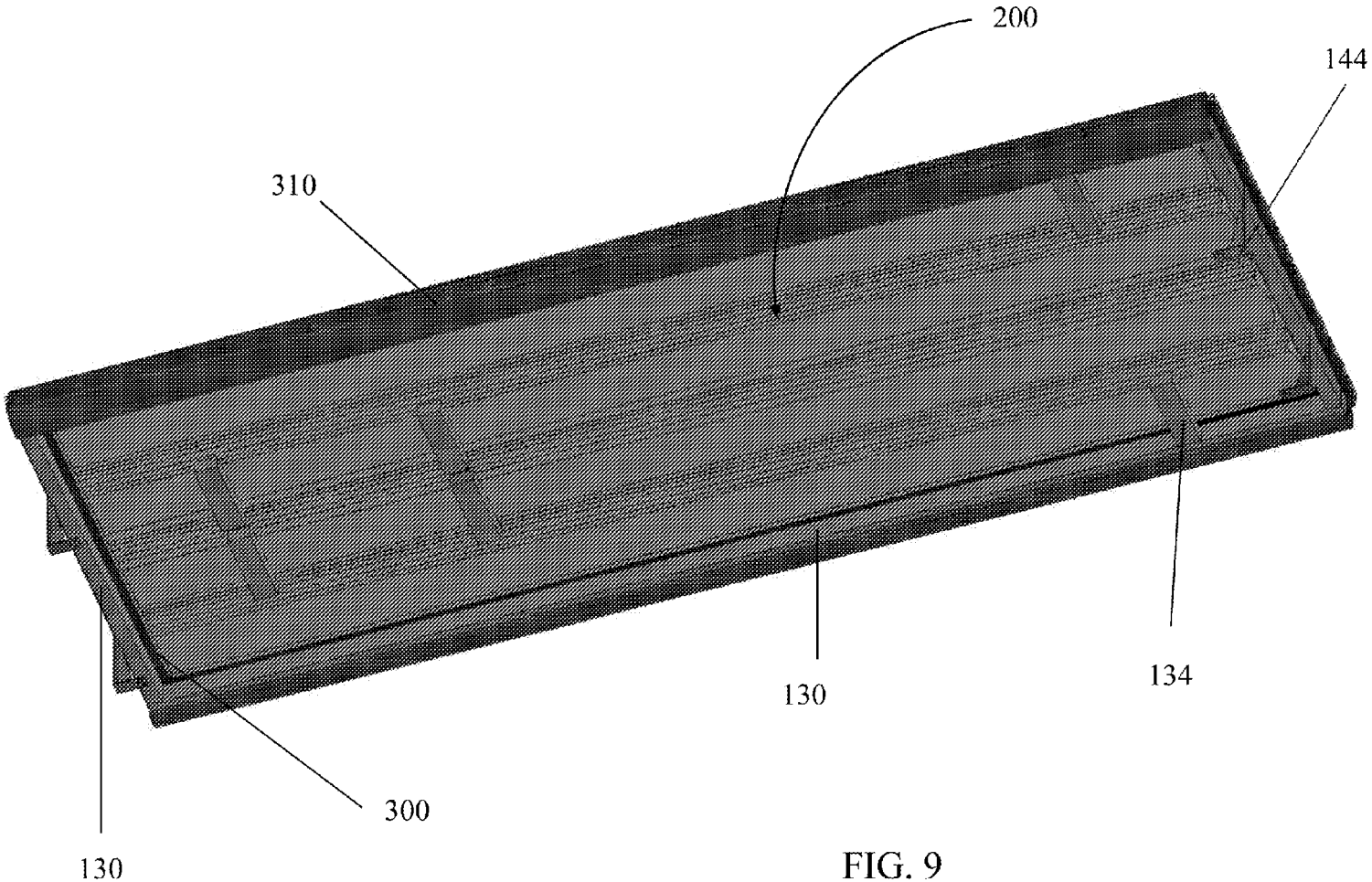
FIG. 9 is a perspective view of the bottom of a foam filled deck piece shown in FIG. 5, according to the exemplary embodiment shown in FIG. 1.

FIG. 9 is a perspective view of the underside of the decking piece 200. In this view, the side rails 310 are attached to the side of the decking piece on the longitudinal sides while the transverse sides of the decking piece have not had the side rails 310 yet attached. On the transverse or ends of the decking piece the side support members are still visible showing attachment of the drag rail supports 134. Several transverse support members 134 are also illustrated.

Figure 10:
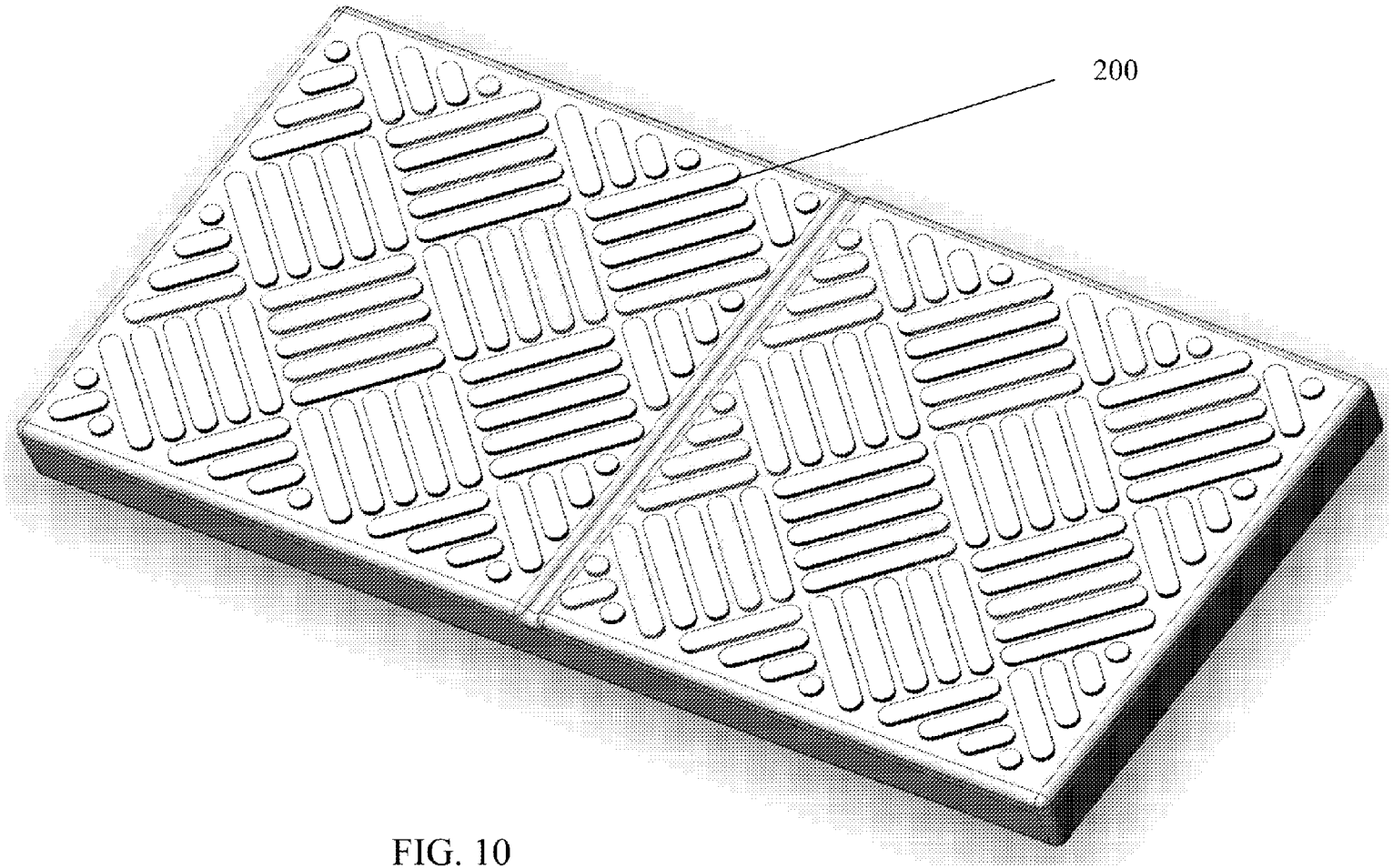
FIG. 10 is a perspective view of a second exemplary embodiment of a foam filled decking piece according to the exemplary embodiment of the invention illustrated in FIG. 1.

FIG. 10 illustrates an alternative embodiment of a one-piece molded decking piece 200. Those of skill in the art will appreciate that because the decking pieces are fabricated by the rotational molding process, any desired pattern for the decking can be achieved. Thus, the patterns illustrated in FIGS. 1, and 10 should not be considered limiting in any way.

Figure 12:
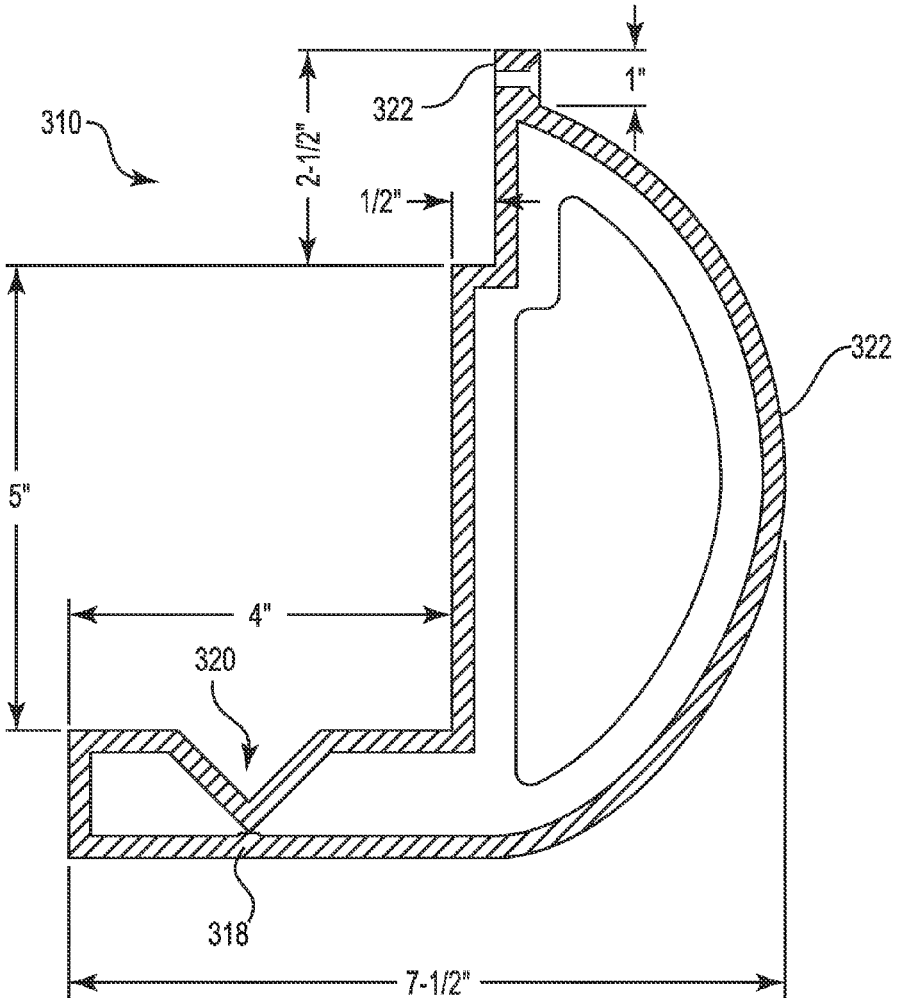
FIG. 12 is a diagram showing a side rail in cross-section according to one exemplary embodiment of the invention.
Figure 13:
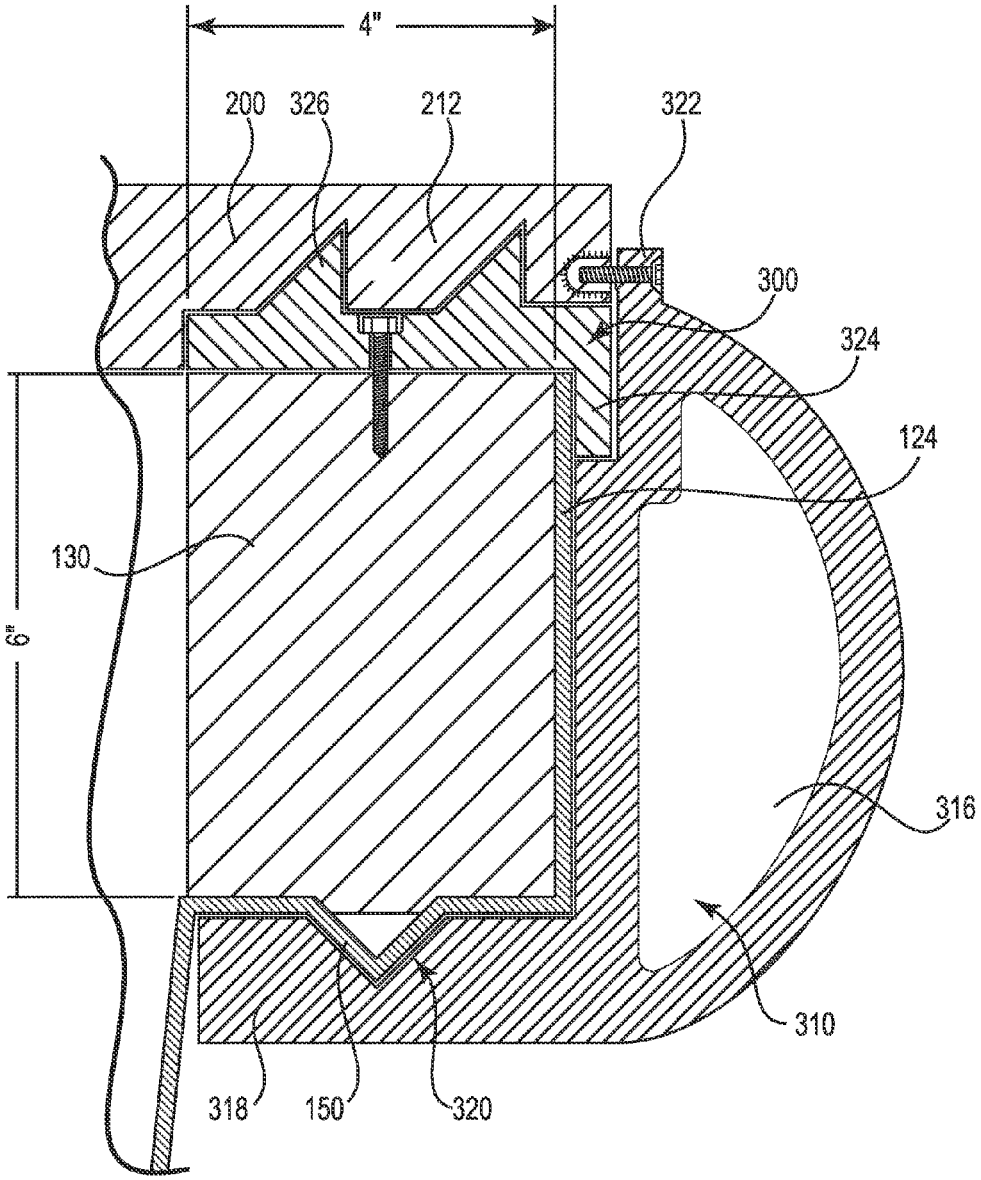
FIG. 13 is a diagram of the exemplary embodiment of the side rail illustrated in FIG. 12 but in position on a fully assembled dock unit.

FIGS. 12 and 13 illustrate the molded side rails 310. FIG. 12 illustrates the side rail 310 in a cross-sectional view before installation on the dock unit 10. As illustrated, the side rail is roughly 'L' shaped having a rounded contact side 316 and a bottom transverse side 318 with a locking 'V' or groove 320. Also illustrated is a locking tab 322 at the top of the contact side 316. FIG. 13 is a cross sectional view of the side rail 310 affixed to an assembled dock unit 10. As shown in FIG. 13, in one exemplary embodiment the rim 126 of the flotation shell 100 is molded to project from the side wall 124. The underside of the rim 126 includes a locking mechanism, such as a tongue 150 designed and configured to mate with the locking 'V' or groove 320 molded into the side rail 310. Further, as shown in FIG. 13, the side support members 130 fit within the top rim 126 of the flotation shell 100.

The dri-loc retainer ring 300 is configured to overlay the support member 130 and includes an overhanging flange 324 that projects over the side of the rim 126 covering the junction of the floatation shell rim 126 and the side support member 130. In addition, the retainer ring 300 also includes one or more upwardly projecting tongues 326 and are designed and configured to matingly engage corresponding grooves 212 on the underside of the foam deck 200. The side rail locking tab 322 creates a notch 336 in which the retainer ring overhang 324 sits while the locking tab projects above the retainer ring 300 and abuts the side of the one-step deck 200. In various exemplary embodiments, the side rail locking tab 322 is then secured to the deck piece 200 using any suitable method. In the exemplary embodiment illustrated in FIG. 13, a screw is inserted into a locking nut in the decking piece through a hardware opening molded into the side rail 310. In addition, the dri-lock retainer ring 300 is affixed to the side support member 130 by multiple screws through spaced, recessed lag bolt holes molded into the retainer ring as illustrated. However, those of skill in the art will recognize that any usable method of maintaining the dri-lock retainer in position is contemplated such as, for example, an adhesive.

Figure 30:
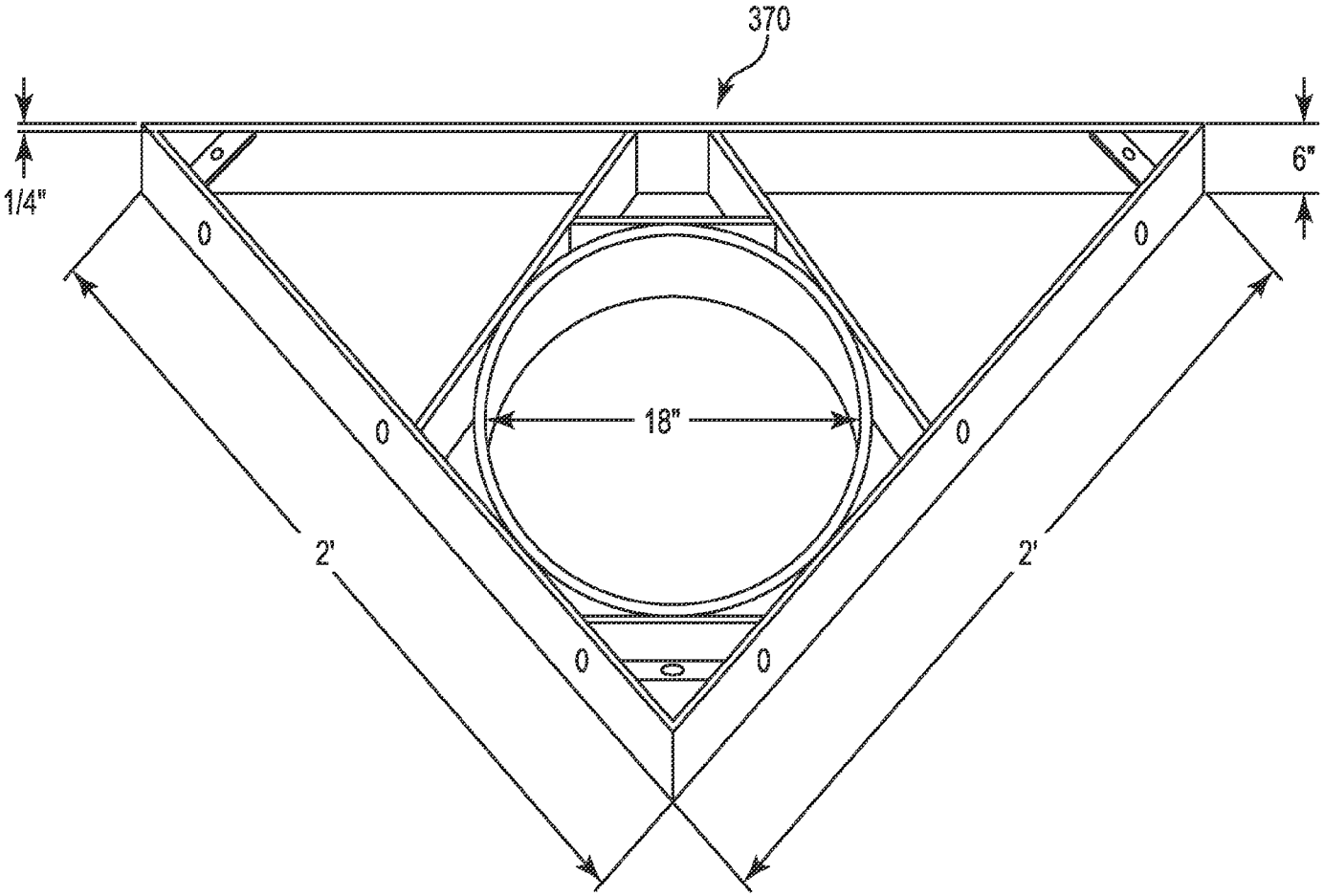
FIG. 30 is large piling bracket according to one exemplary embodiment of the invention.
Figure 31:
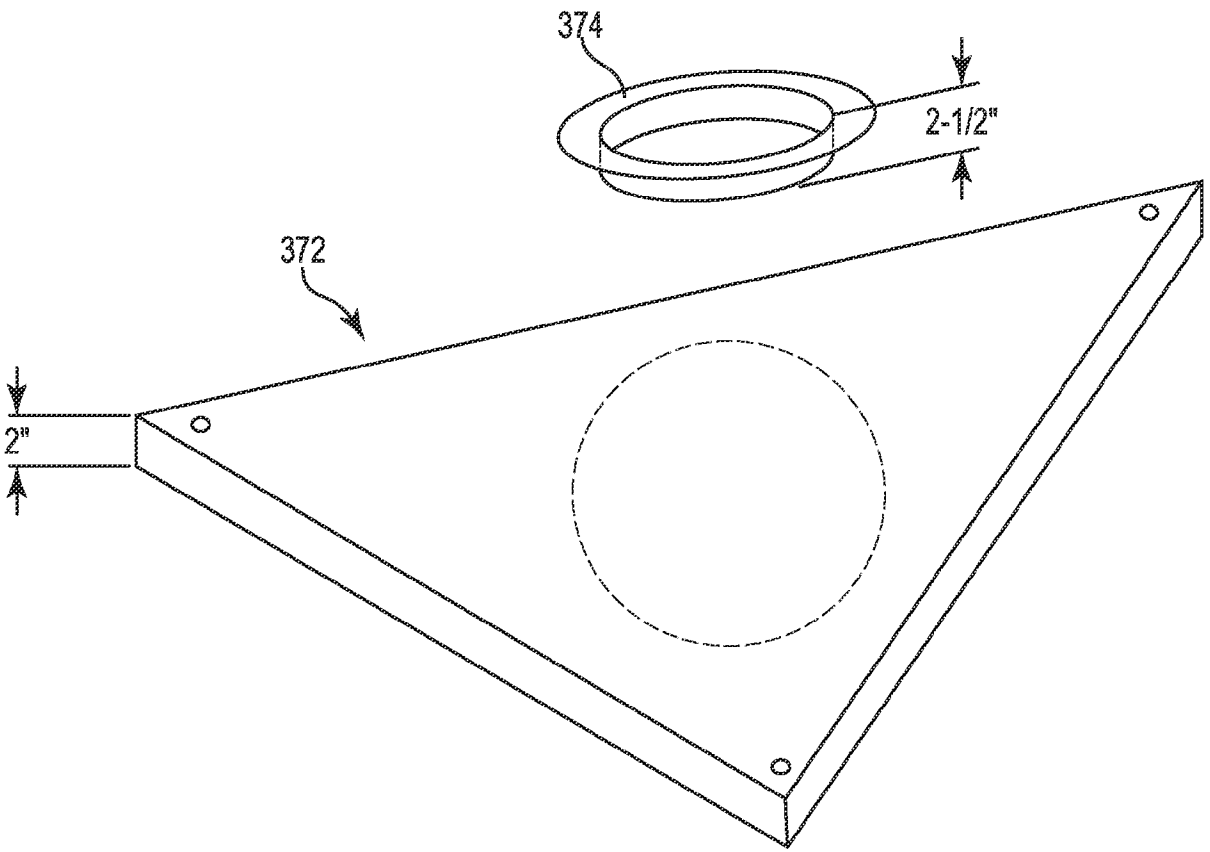
FIG. 31 is a drawing illustrating a boat slip corner deck unit according to one exemplary embodiment of the invention.

Those of skill in the art will appreciate that the support members 128 (e.g., side support members 130, longitudinal support members 132 and transverse support member 134) can be any size that is necessary to accommodate the support columns 102 including the flanges 104 and grooves 106 formed thereby to provide support for the decking pieces 100. Therefore, in various exemplary embodiments, the support members can be 4"×6", 6"×6", 6"×8" or any other convenient size. Advantageously, when necessary, hardware such as a washer, lock washer and nut fit into the locking tongue or 'V' groove 150 of the floatation shell so as not to interfere with the seal of the dri-loc ring 300 interposed between the support member 130 and the deck piece 200. FIG. 30 illustrates a large piling bracket 370 for use with one exemplary embodiment of a corner deck piece 372 as shown in FIG. 31. Also shown is a trim ring 374 usable with the piling bracket 372.

Figure 14:
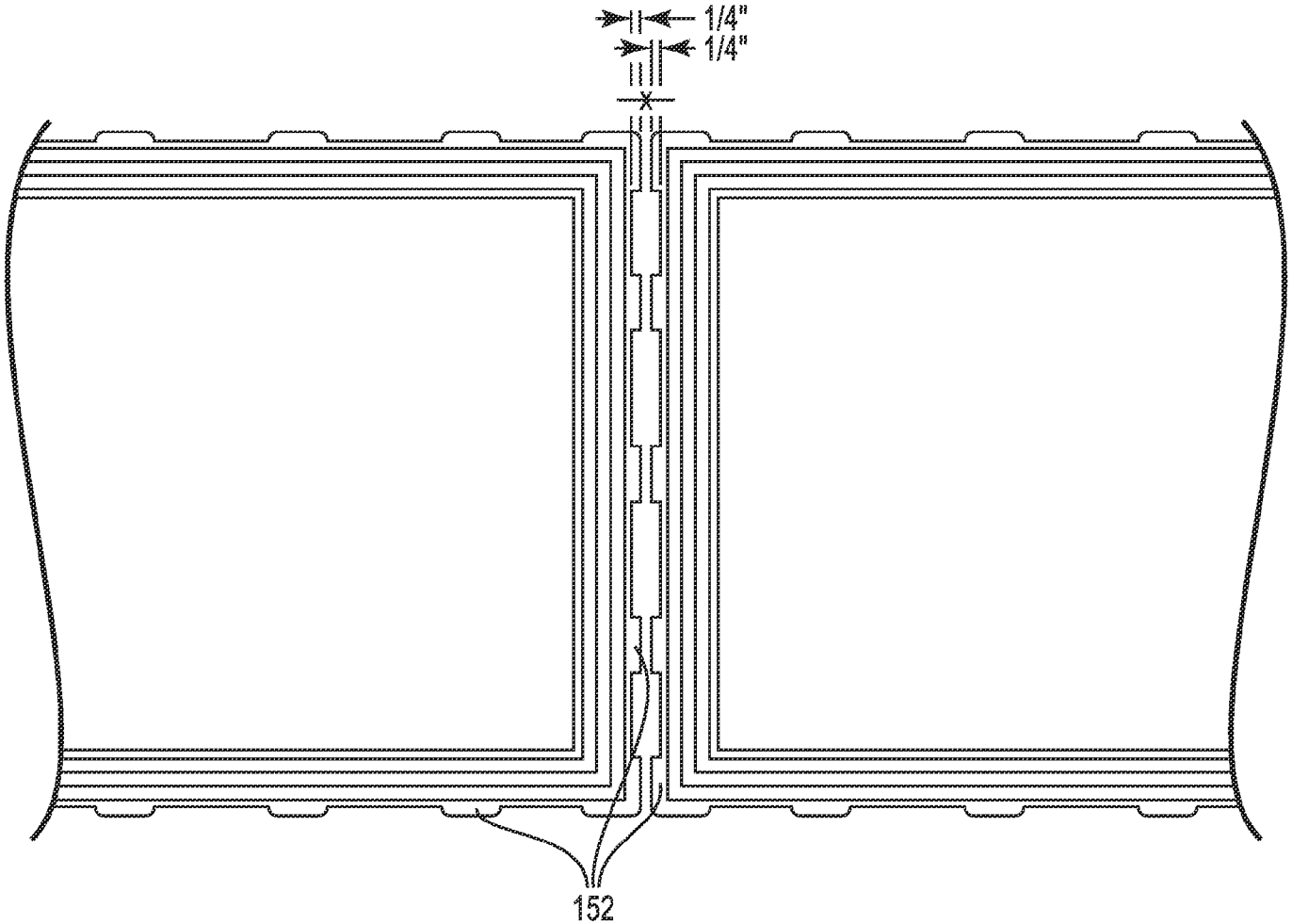
FIG. 14 is a schematic, top plan view of two dock units abutted for connecting together. This view shows the outside of the floatation shells molded with buttresses to result in open channels for water drainage.
Figure 15:
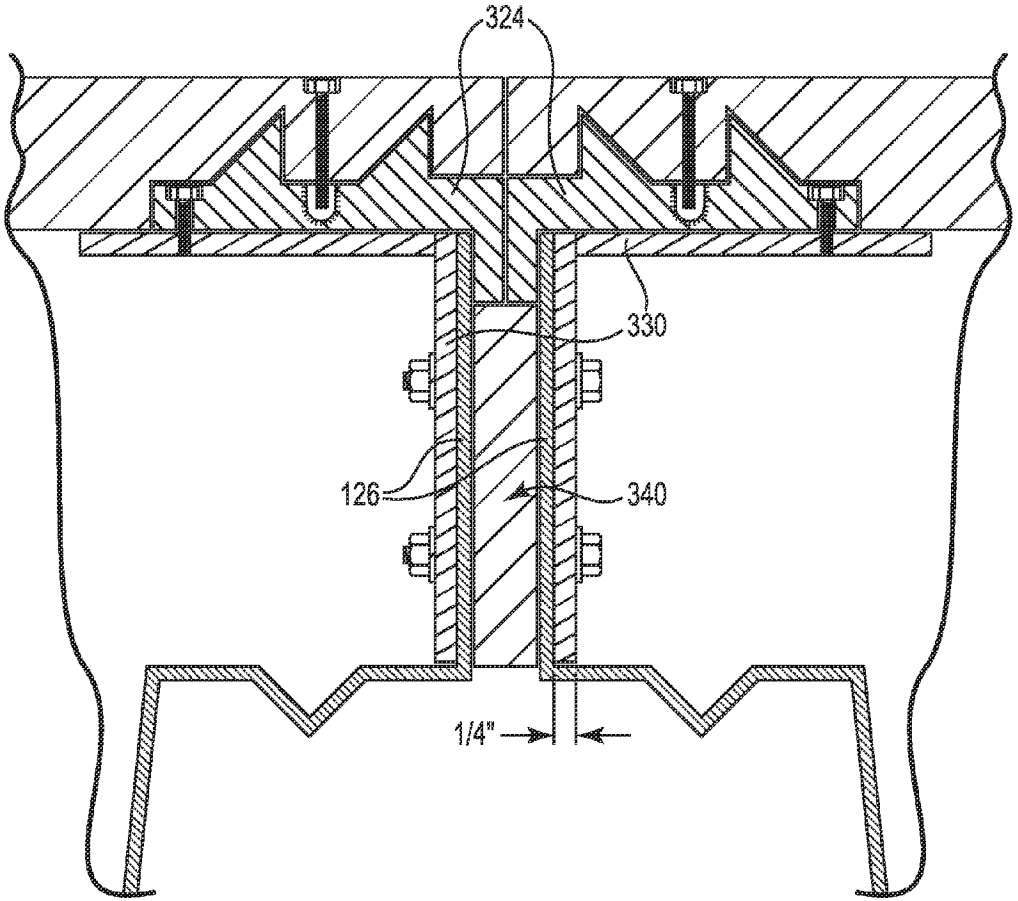
FIG. 15 is a diagram showing one embodiment of two dock units connected.

FIG. 14 is a schematic top-plan view of two dock units abutted. As illustrated, in some exemplary embodiments, the floatation shells 100 are designed to have protruding buttresses 152 molded therein such that when fixed together in multiple units, the opposing buttresses create openings between them allowing water to drain from the decking FIG. 15 is a close-up view illustrating one exemplary embodiment of connecting adjoining dock units. As shown in some exemplary embodiments, when the units 10 are to be connected, the side rail is not affixed to the abutting sides. A spacer 340, such as a high density polyethylene (HDPE) panel is then interposed between the two units below the dri-loc retainer ring overhang 324. As illustrated, the spacer 340 runs the length of the side of the decking units being abutted, is the width of two retaining ring overhangs and is the height of the portion of the rim not covered by the retaining ring overhang. An upside down 1' type bracket 330 is then mounted on the inside of the rim 126 such that the upper portion of the retainer ring is affixed to the bracket such as by screws, bolts are then placed through the bracket and the spacer, holding the two units together. However, those of skill in the art will appreciate that in other exemplary embodiments, a side support member 130 would be placed in the overhang as illustrated in FIG. 13 and, with the HDPE panel 340 interposed between the two dock units, the units would be bolted together through the support members 130.

Figure 16:
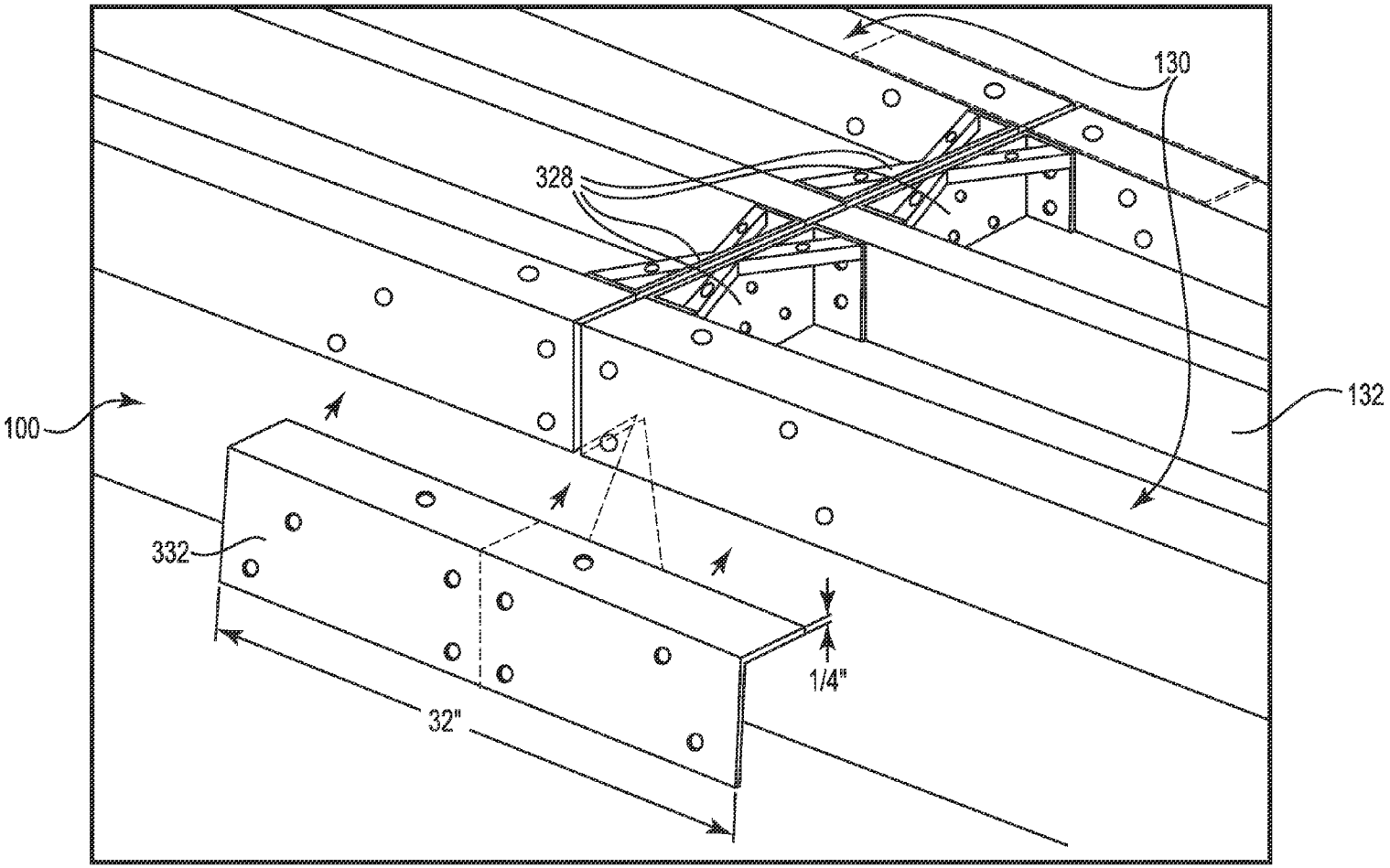
FIG. 16 is a drawing illustrating a second exemplary embodiment of connecting to dock units according to the invention. Illustrated are a joint connector edge piece and internal brackets for connecting two dock units of the invention.
Figure 17:
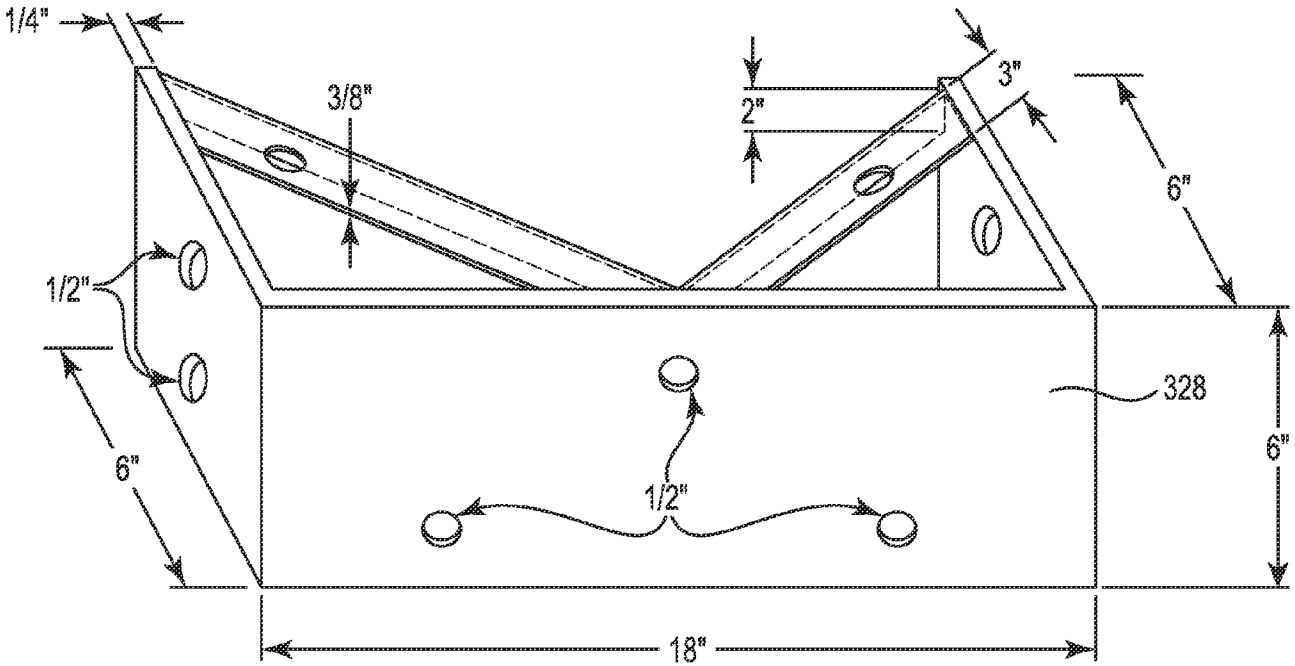
FIG. 17 is a drawing illustrating an enlarged view of the end bracket used for connecting two dock units according to the exemplary embodiment of the invention illustrated in FIG. 16.

FIGS. 16 and 17 illustrate a second exemplary embodiment of connecting two or more dock units. FIG. 16 illustrates side joint connectors 332 which span the outside of the floatation shells along the joint and are fastened through the floatation shell into the support members 130 while FIG. 17 illustrates the internal end brackets 328. As illustrated in FIG. 17, one end bracket is fastened to side support member 130 inside one opposing floatation shell and fastened to the longitudinal support members 132 while a second opposing bracket is juxtaposed in the opposite dock unit such that the end bracket 328 are fastened to each other through the shell 100 joining the two dock units 10 together. In the exemplary embodiment illustrated in FIGS. 16 and 17, a side support member 130 on the abutted end is not used and the brackets 328 are fastened to the longitudinal support member 132.

Figure 18:
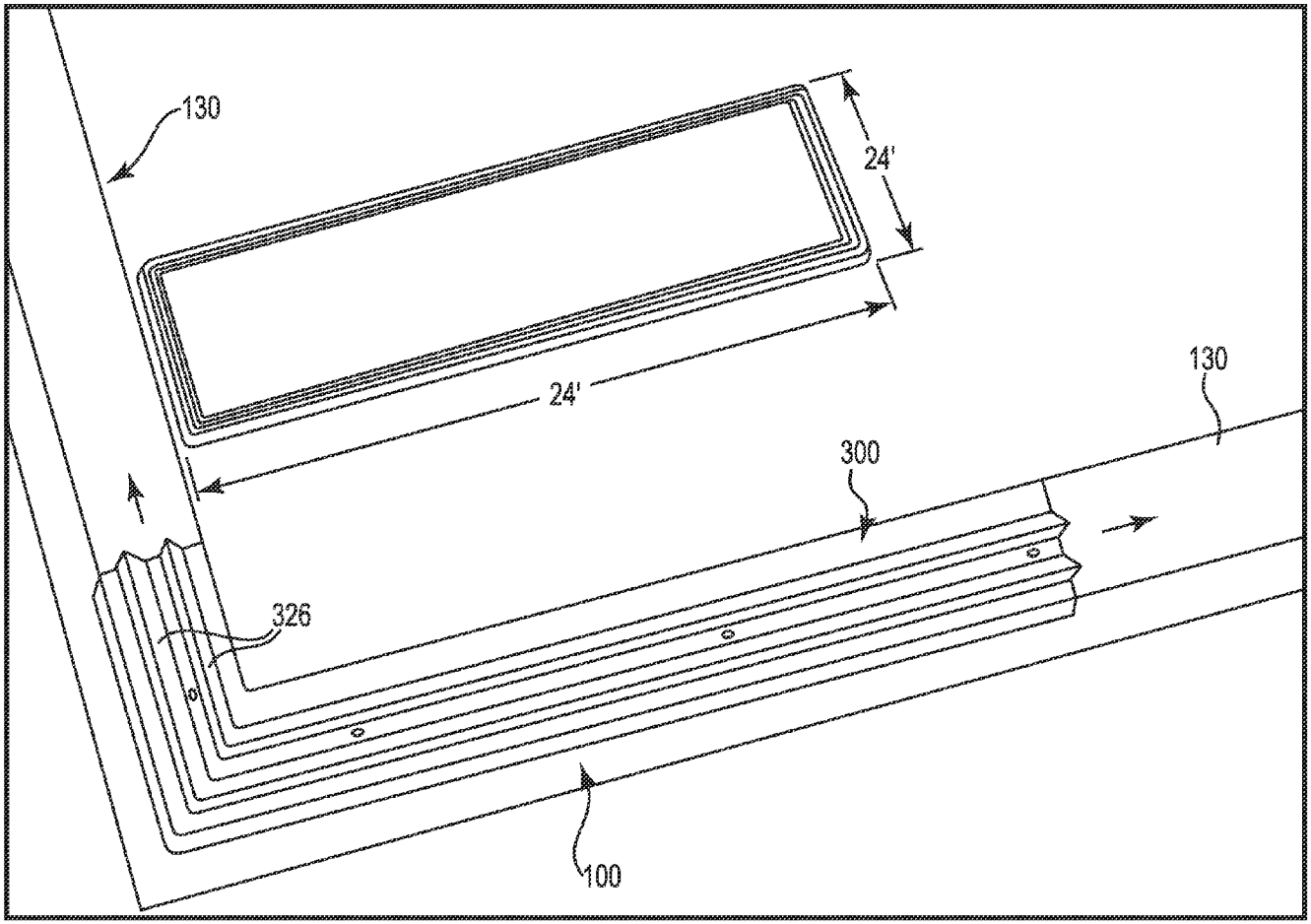
FIG. 18 is a schematic partial, top-plan view illustrating the application of the dri-loc retainer ring to the floatation shell prior to the installation of the one-step foam decking piece. Inset shows the dri-loc retainer applied to the entire floatation shell rim.

FIG. 18 is a partial top-plan view of the retaining ring 300. As shown, the retaining ring sits on top of the side support members 130. The locking tongues 326 project upward and the side rails 310 have been affixed to the floatation shell 100. In some exemplary embodiments, screw holes may be molded into the retainer ring 300 upon fabrication to facilitate attachment to the support member 130. The inset shows one embodiment of a floatation shell 100 with the dri-loc retainer 300 in place awaiting positioning of the deck piece 200.

Figure 19:
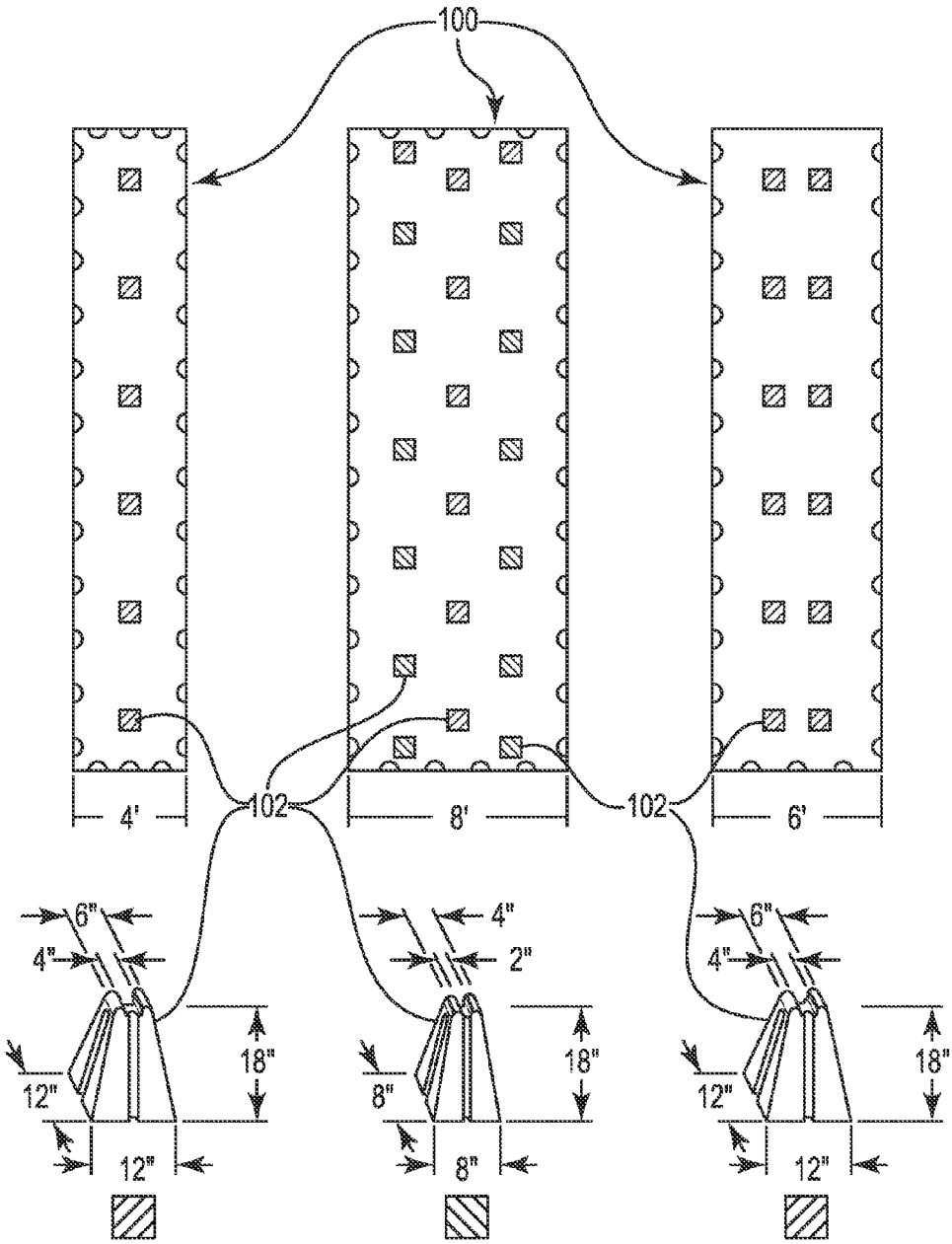
FIG. 19 is a schematic diagram illustrating three exemplary embodiments of the floatation shell according to the invention. Illustrated are three sizes of shell 4'×2'×12', 8'×2'×12' and 6'×2'×12', each with a different configuration of support columns as is desired to support the decking piece. In some embodiments, the floatation shells have different size support columns as may be desired. For example, the 8' shell has a middle row of support columns that have a larger footprint than the outer rows.

FIG. 19 is a schematic top-plan view of three exemplary embodiments of floatation shells according to the invention. The embodiments illustrated show a 4'×24' floatation shell with a single row of support columns molded therein; an 8'×24' floatation shell with three rows of support columns molded therein and a 6'×24' floatation shell with two rows of support columns molded therein. Not illustrated are 12'×24' shells having either three or four rows of support columns 102. Further, it should be noted that the embodiment illustrated of the 8'×24' floatation shell the middle row of columns is offset from the outer rows thereby providing greater support for the support members and the overlaying decking. The bottom of the figure shows that the size of the support columns can be optimized for each size floatation shell used. For example, the 4' shell having only a single row of support columns may have a rectangular frustoconical shape with the supports 110 in the smaller shells generally having a larger base than those in the larger units. As illustrated, in some exemplary embodiments, the 4' shell has a single row of support columns 102 that are 12"×12" along the base while the 8' shell having 3 rows of columns 102 are 8"×8" at the base. It should be noted that while in some exemplary embodiments the shell is 24" deep the height of the support columns in each case is 18" with the height of the top rim of the floatation shell being approximately six inches. The height of the support members is 6 inches, allowing the frame support members to be completely enclosed and protected in the assembled deck unit when foam deck 200 is in place. As will be appreciated, when the floatation shells are 4'×24', 6'×24', 8'×24' and 12'×24' the size of the retainer ring is also 4', 6', 8' and 12'×24'. Further, while the retainer ring 300 can be any thickness necessary to seal the decking onto the shell, in some exemplary embodiments, the retainer ring is three inches thick.

Further, those of skill in the art will appreciate that while the support members 130, 132, 134 can be any robust linear material, in some exemplary embodiments the support members are beams such as, for example, wood, including Douglas fir, lam beams and steel such as galvanized steel. In addition, as discussed previously, when each dock unit is assembled the interior of the floatation shell comprises a water-tight interior. Therefore, none of the interior components, such as beams and hardware, come into contact or are degraded by the atmosphere or water. In addition, although the interior is water-tight, air bladders can be added or removed from the interior compartment thus changing the buoyancy of the dock unit 10. In addition, while the sealed dock unit provides inherent buoyancy, those of skill in the art will appreciate that additional buoyancy can be added to units where needed by inserting a foam billet or an adjustable air bladder into the floatation chamber or by connecting an auxiliary flotation unit such as those shown in FIGS. 32 and 33 (discussed below).

Further, as illustrated in the previous and following figures, a variety of brackets, connectors and other hardware can be used with the modular dock units according to the invention. Those of skill in the art will appreciate that all hardware contemplated for use may be galvanized steel, e-coat steel or stainless steel or similar resistant materials that may, in the future, become available. As discussed above, the floatation shells, decking units and dri-loc rings are, in some exemplary embodiments, fabricated using the techniques of rotations molding. The advantages of fabricating the units using rotation molding techniques include that each unit is exactly the same as all other units. Therefore, once the molds have been cast, such as from steel or aluminum, the individual components can be fabricated and shipped to the destination of installation and the units can be assembled on-site without any further refinement or modification of the individual pieces.

The techniques of rotational molding are well known by those of skill in the art. Briefly, a model is made of the product. A mold is then made using the model of the finished product. Once the mold is made, the mold is filled with beads of plastics such as polyethylene, polycarbonate, polyester, nylon, etc. The mold is heated, by for example, putting it in an oven and melting the plastic material inside. The mold is then rotated, generally along two axes, causing the melted plastic to come into contact with and stick to the walls of the mold. The mold is then allowed to cool and the molded plastic piece removed from the mold.

While the general concepts of rotational molding provide a background for the fabrication of the instantly disclosed dock units, these methods can be optimized to provide more robust docking pieces. For example, the floatation shells and decking pieces can be fabricated from resins such as LLDPE resins (linear low-density polyethylene). Any type of resin used in conventional rotational molding may be utilized. Examples of other types of resins useful in the method of this invention include polycarbonates, nylons, polyvinylchlorides, and polyesters. Additional useful resins include ABS, acetals, acrylics, cellulosics, epoxies, fluorocarbons, phenolics, polystyrenes, polyurethanes, SAN polymers, and silicone polymers EVA copolymers and EBA. Further, floating dock units of the size currently contemplated were not available due to limitations in size and capacity of rotational machinery needed to rotate molds of the current size used.

Figure 20:
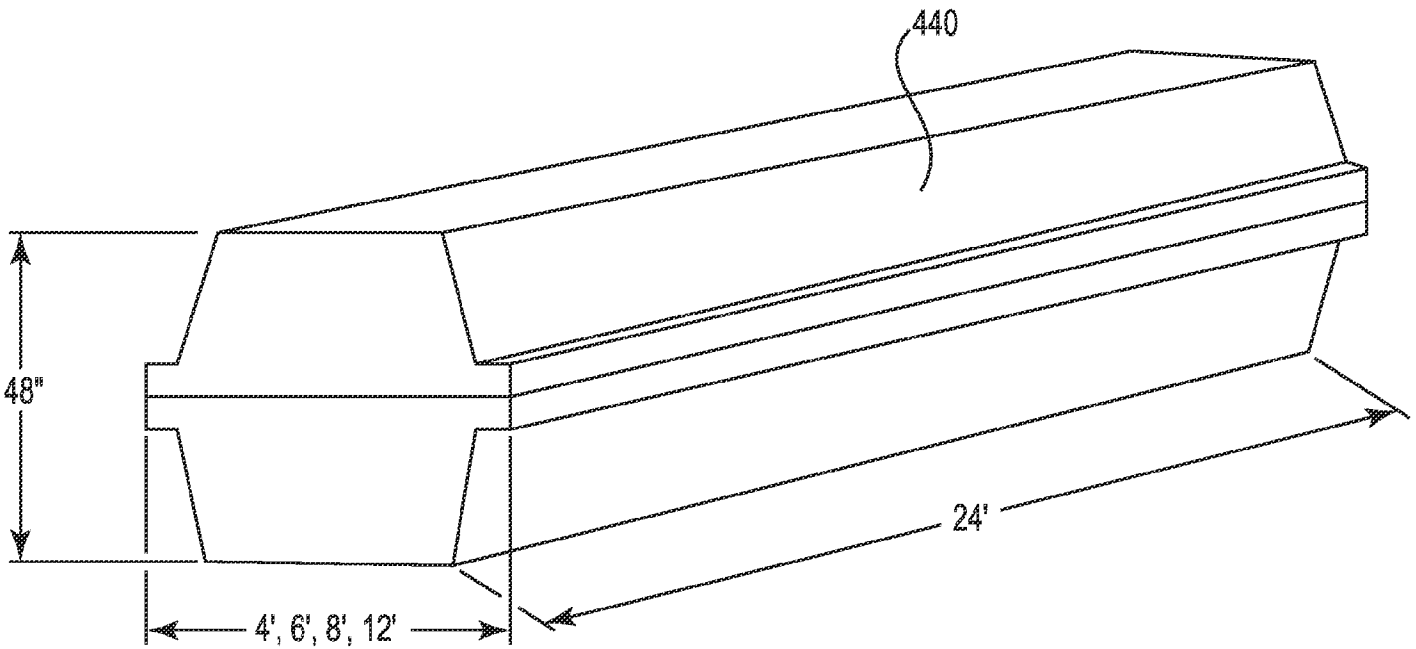
FIG. 20 is a perspective view of one exemplary embodiment of a rotational mold useful in fabricating the floatation shells according to the present invention. The embodiment shown represents a "2 UP" mold, fabricating two shells at the same time.

A schematic diagram of one exemplary embodiment of a mold 440 used for the fabrication of the floatation shells is provided in FIG. 20. This figure illustrates a "2-up" mold 440 because it comprises a top half and a bottom half each half forming a mold for a complete floatation shell 100. It should be appreciated that the foam floatation shells 100 and decking pieces 200 can be fabricated by any desirable method. For example, while in some embodiments "one-step" foam technology is used. In other exemplary embodiments such as, for example, "two-step" foam molding technology is sued. Two-step foam technology uses a "drop box". In other exemplary embodiments a secondary post molding "foam injection" method is used. Further the fabrication technology can comprise rotational molding ("rotomolding") or conventional molding technologies.

Figure 21:
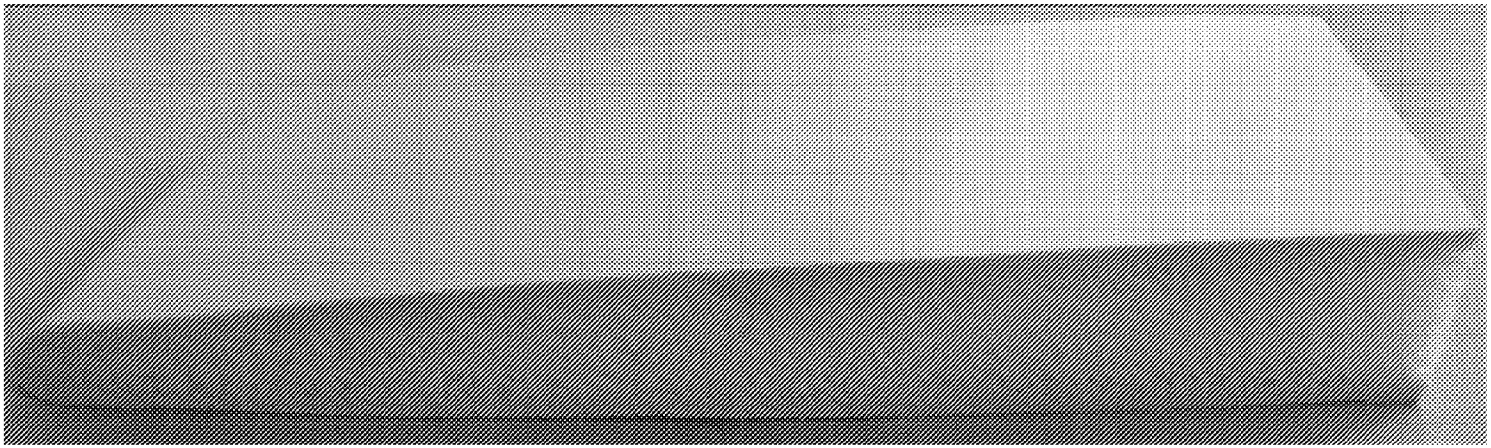
FIG. 21 is a photograph showing a piece of one-step foam such as that used for fabricating the dri-loc retainer ring and the decking pieces according to one exemplary embodiment of the invention. Illustrated is the hard outer skin with an interior foam core.

In addition, in various exemplary embodiments, both the decking units 200 and the dri-loc retainer rings 300, will be fabricated from new rotomolding techniques such as "one-step" foam molding, available from Chroma Corporation Inc, McHenry, Ill. See, for example, U.S. Pat. No. 6,833,410 hereby incorporated by reference in its entirety for all purposes. In the one-step rotational molding technique, a foam product is provided using both resin pellets and resin powder. The process results in a rotationally molded object that is characterized by a hard outer polyethylene skin and an air-filled expanded foam interior. FIG. 21 is a photograph showing a section of a one-step foam piece showing the outer skin and the inner foam. While the one-step process is relatively new in the rotational molding field of art, it has, to the inventor's knowledge, not previously been used for applications such as the instant invention. However, the inventor's realization that the unique properties of one-step foam fabrication could be useful in the fabrication of pieces for the instant invention provides a unique product with previously unavailable qualities. These qualities include, strength, durability, economy of manufacture, economy of shipment and transport.

In contrast, in the "two-step" process an initial outer skin is formed and then the inner foam core is added later. For example, PVC pellets are first added in the mold in a desired "charge weight", the mold is then heated and the PVC skin is formed. Drop boxes then open and a measured "charge weight" of PVC is dropped into the mold that forms a further layer of PVC inside the previously formed layer. While the second charge may not be necessary, the second charge adds to the thickness of the outer PVC layer increasing its strength. The PVC outer layer is then removed from the mold and a post-foam process is utilized to pressure fill the cavity with a variety of foam agents which will harden during the cooling process creating additional rigidity and floatation to the part.

Figure 22:
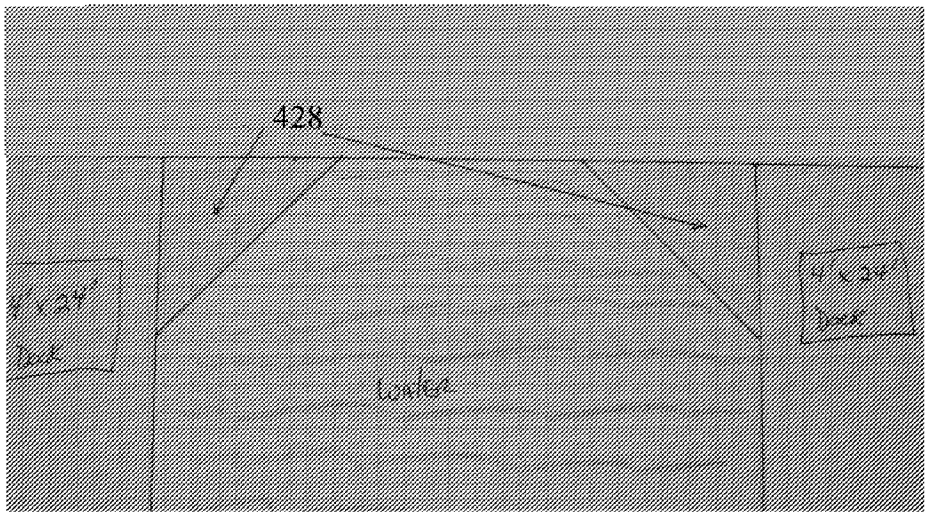
FIG. 22 is a schematic drawing illustrating the use of corner deck units to provide a boat slip according to one exemplary embodiment of the invention.
Figure 23:
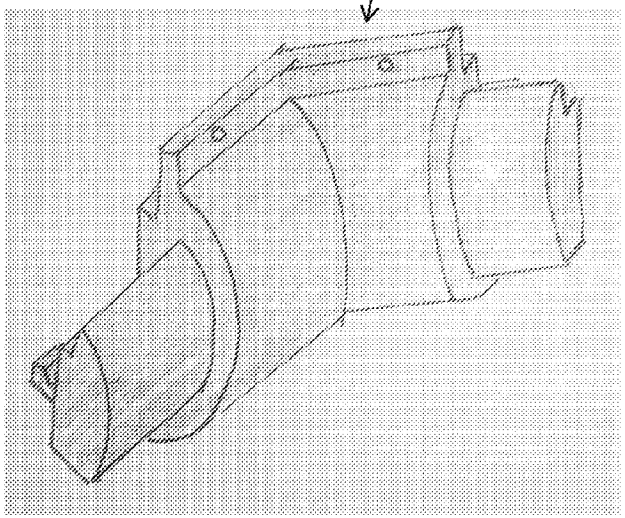
FIG. 23 is a drawing illustrating one embodiment of an inner 90° corner splice unit for a side rail boat bumper system according to one exemplary embodiment of the invention.
Figure 24:
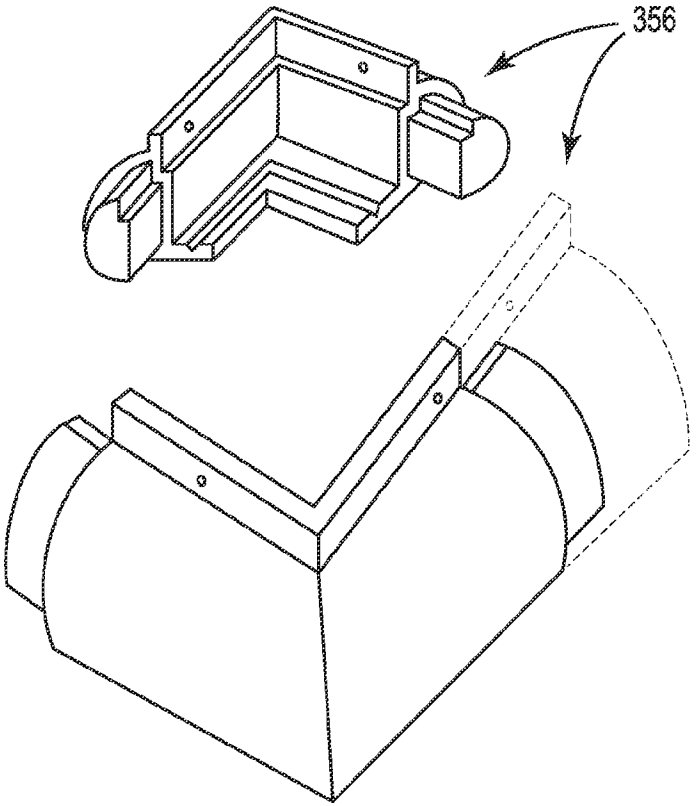
FIG. 24 is a drawing illustrating one embodiment of an outer 90° or corner splice unit for a side rail boat bumper system according to one exemplary embodiment of the invention.
Figure 37:
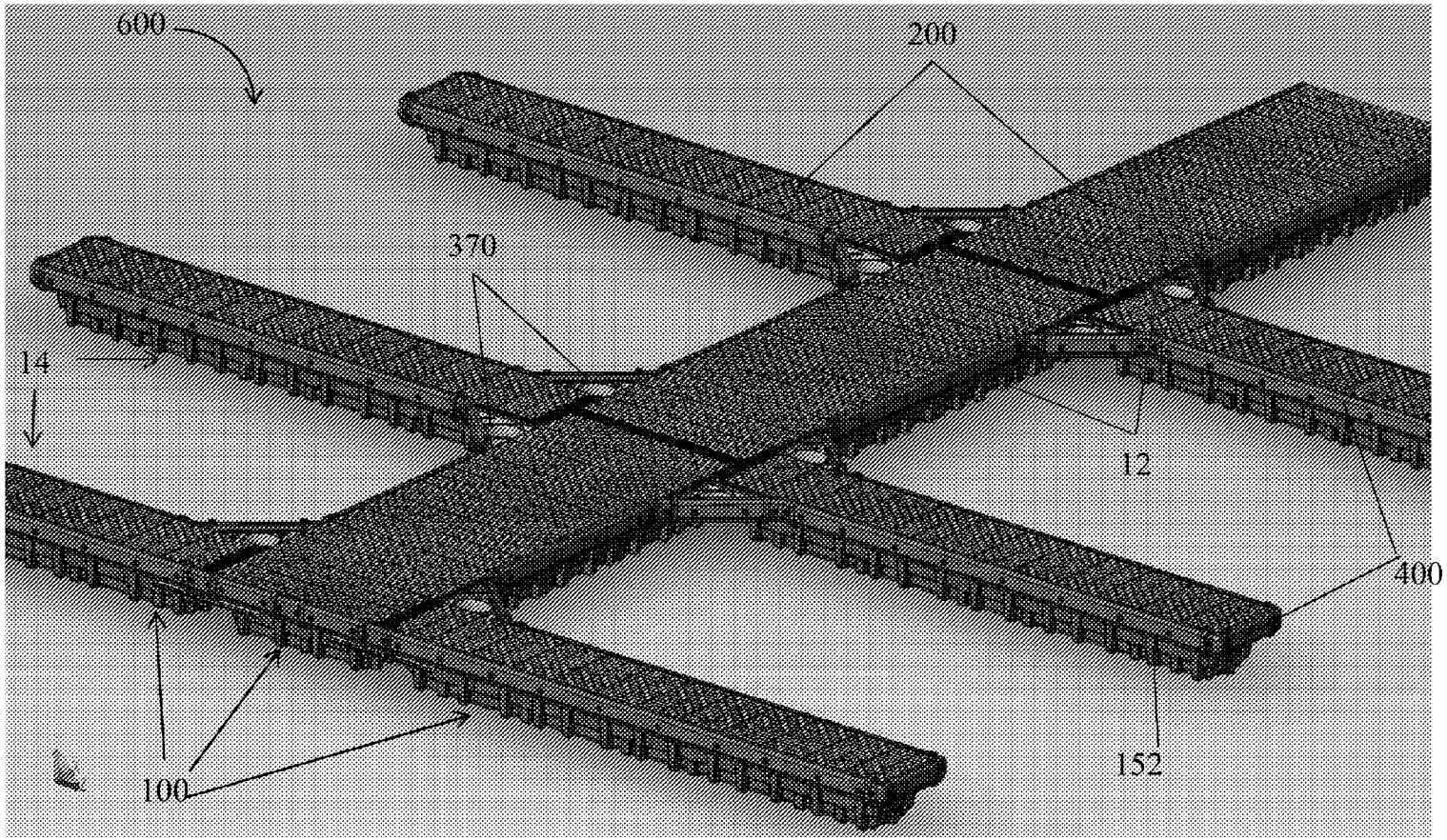
FIG. 37 is a rendering of a dock assembly system. In this embodiment, the middle dock assembly units are 24'×8' while the perpendicular units are 24'×4'.

In addition, while the general characteristics of the dock units 10 according to the invention have been described above, it should be appreciated that various and supplementary attachments, brackets and hardware pieces are usable and contemplated for use with the invention so as to provide a complete multi unit dock system 600 (FIG. 37). Therefore, corner deck covers 428 as illustrated in FIG. 22 are useful in boat slips or when there is a step-down in deck size and are contemplated for use in one exemplary embodiment of the invention. In addition, those of skill in the art will recognize that, when different size dock units are connected or when multiple dock units are connected at right angles, the side rail 310 must follow the perimeter of the connected dock units. Therefore, 90° inside corner splice units 354 such as the exemplary embodiment illustrated in FIG. 23 are usable in such instances. Similarly, 90° outside corner splice units 356 such as the exemplary embodiments illustrated in FIG. 24 can be used to create an outside corner.

Figure 25:
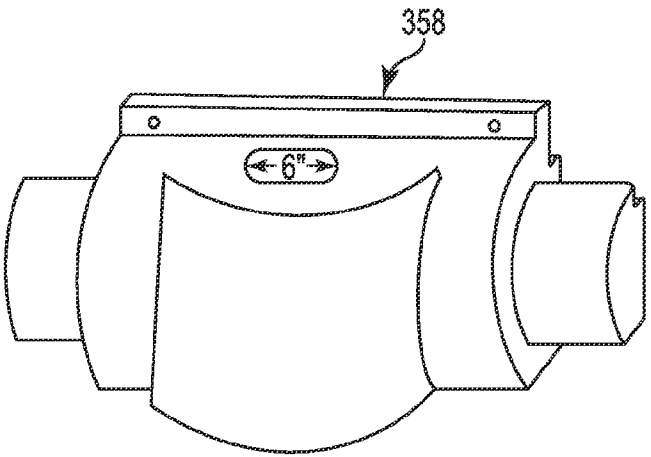
FIG. 25 is a drawing illustrating one embodiment of a pipe bracket housing splice unit for a side rail boat bumper system according to one exemplary embodiment of the invention.
Figure 26:
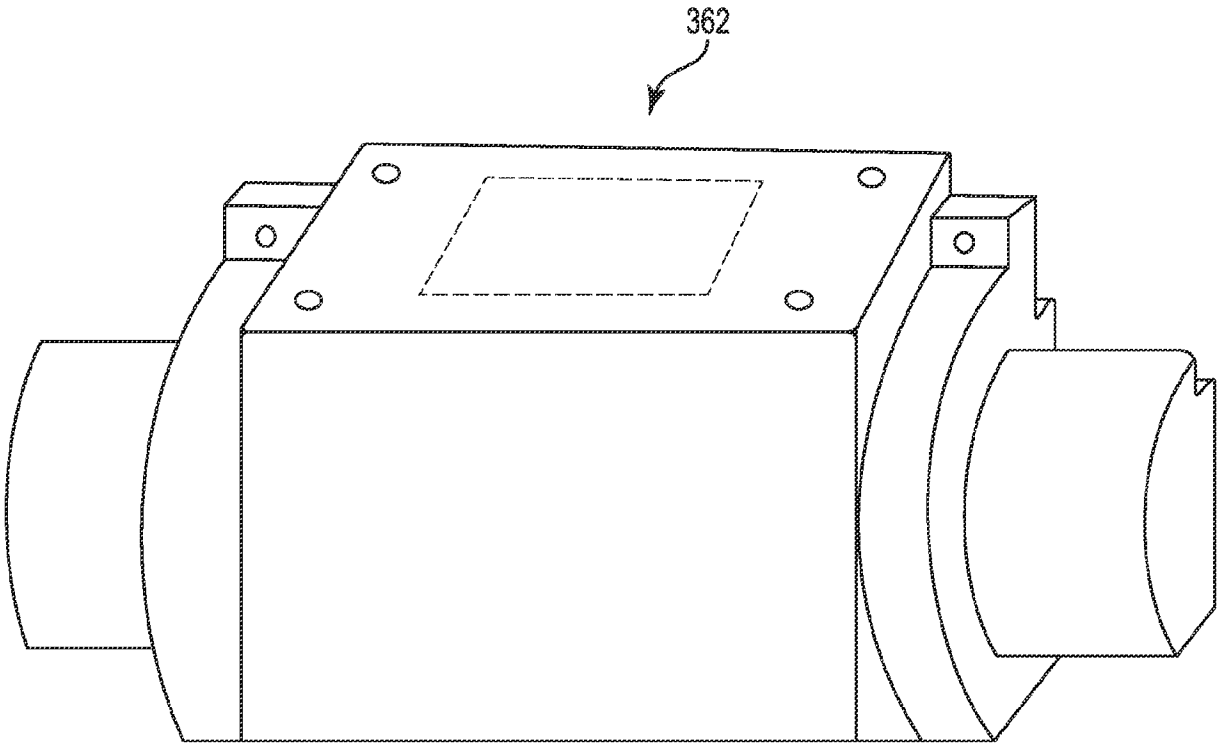
FIG. 26 is a drawing illustrating one embodiment of a power pedestal splice unit for a side rail boat bumper system according to one exemplary embodiment of the invention.
Figure 27:
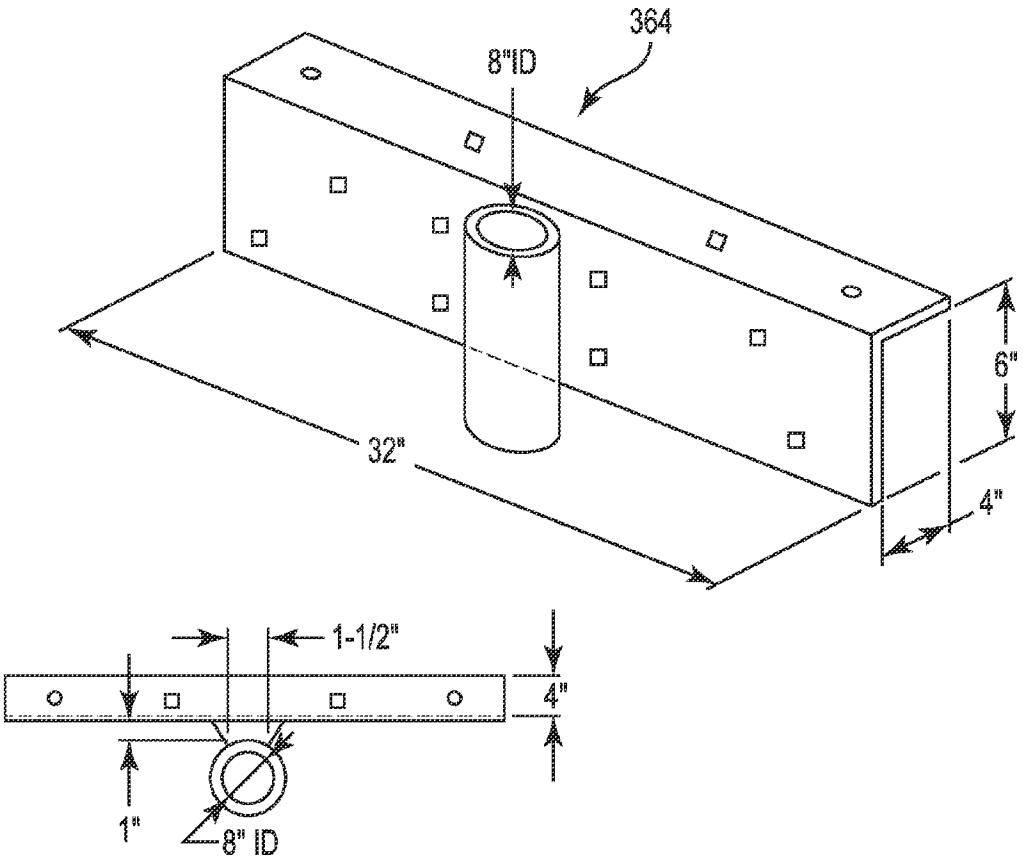
FIG. 27 is a drawing illustrating an outside piling bracket and joint connector for the modular dock system according to one exemplary embodiment of the invention.
Figure 28:
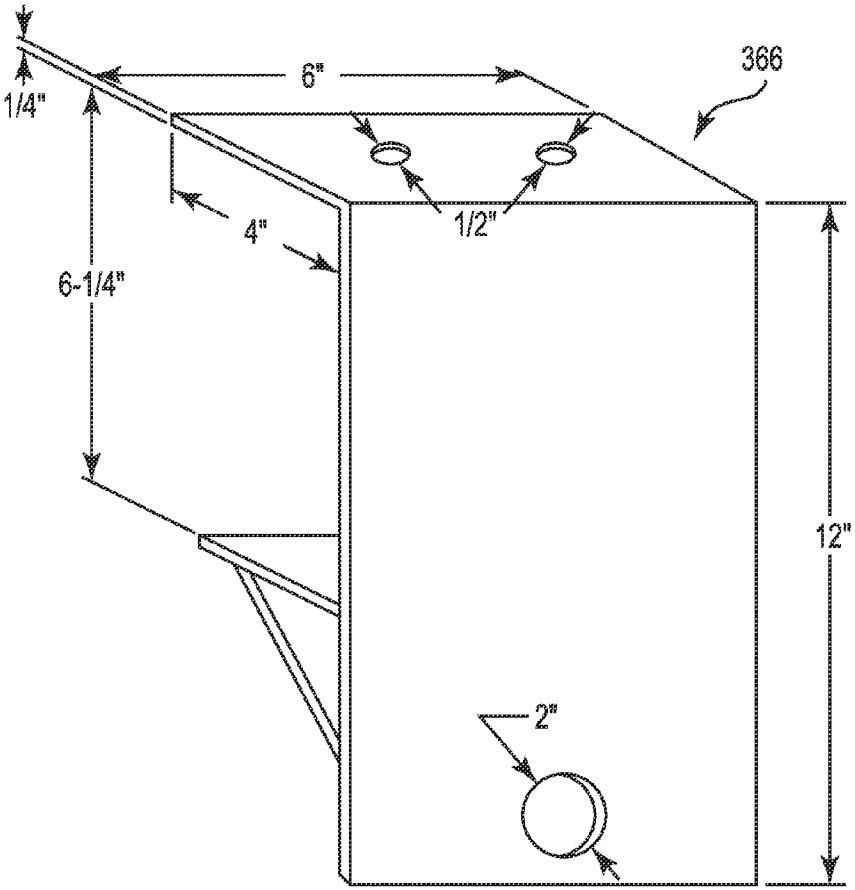
FIG. 28 is a drawing illustrating an anchor chain attachment bracket according to one exemplary embodiment of the invention.
Figure 29:
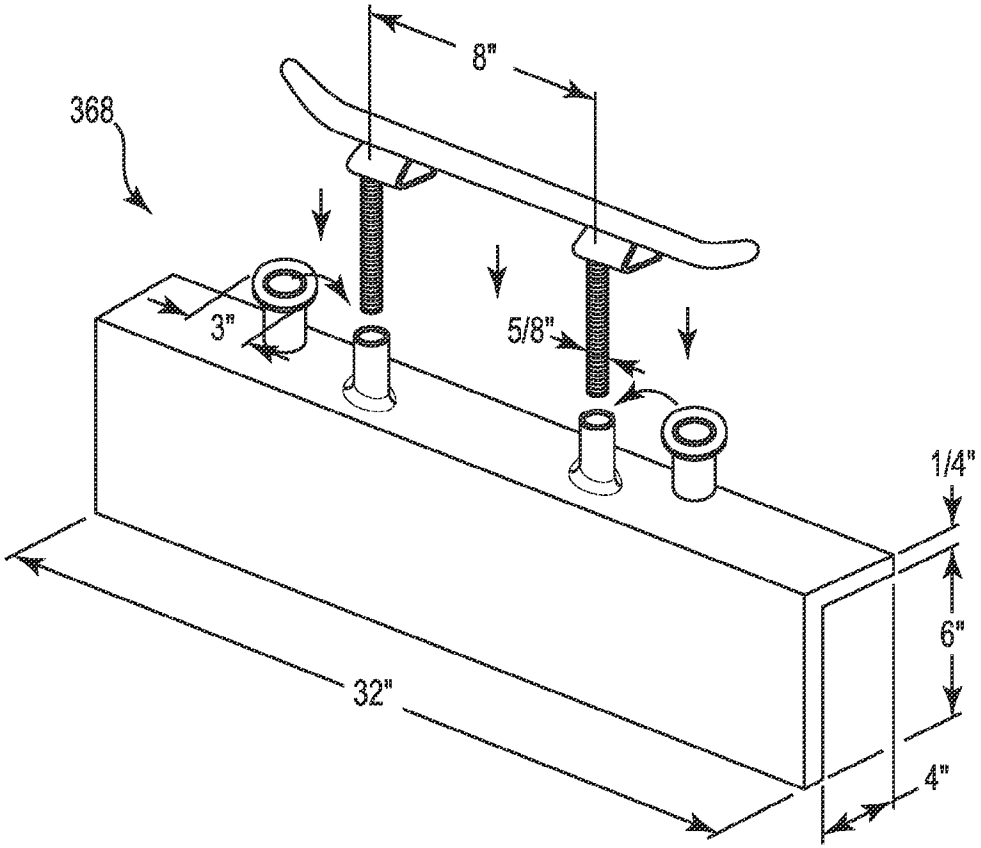
FIG. 29 is a drawing illustrating a tie off cleat bracket according to one exemplary embodiment of the invention.

In addition, the modular nature of the side rail 310 allows the use of various other splice units to safely include other utilities and attachments. For example, FIG. 25 illustrates a side rail splice unit 358 that incorporates a pipe bracket housing. In some exemplary embodiments of this unit, the backside of the unit includes a pocket molded to fit around a metal piling bracket. FIG. 26 illustrates one exemplary embodiment of a power pedestal bracket 362. The molded unit can be marked for cutout to access water and power from the bottom of cavity. As illustrated the power pedestal bracket 362 mounts to the top of the splice unit and extends over the edge of the deck 200. FIG. 27 is an illustration of one exemplary embodiment of an outside piling bracket, in this embodiment the bracket is a small piling bracket 364. In this embodiment, the piling bracket also acts as a joint connector. The inset provides a top view of the bracket 364. FIG. 28 is a perspective view of an anchor chain attachment bracket 366. As illustrated, the bracket fits over the side rail with screw holes to securely fasten the bracket to the underlying support member 130. FIG. 29 illustrates a "tie off" cleat bracket 368 according to one exemplary embodiment of the invention. As with the small piling bracket (FIG. 27), the cleat bracket shown in FIG. 29 may also act as a joint connector. As illustrated, the cleat bracket bolts through the side support member 130.

Figure 32:
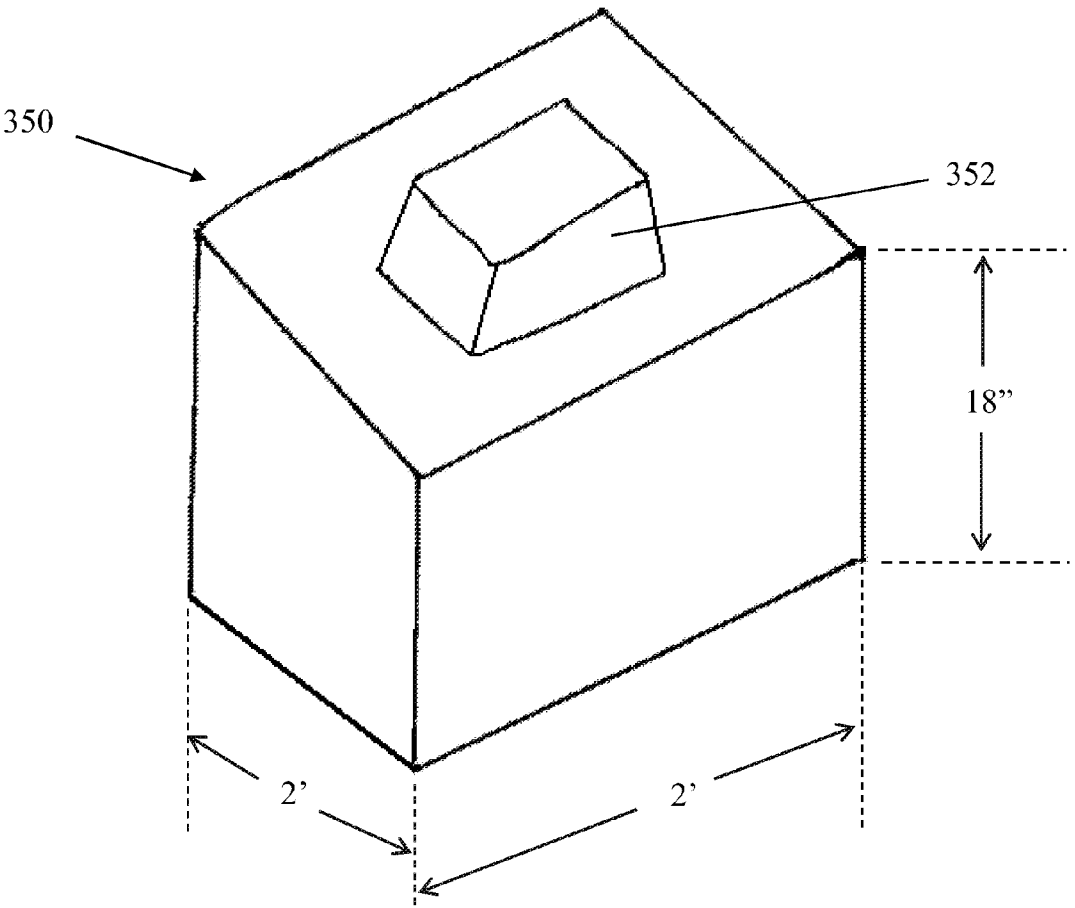
FIG. 32 is a drawing illustrating an accessory floatation unit according to one exemplary embodiment of the invention. In this embodiment the accessory flotation unit has a single fixation tab.
Figure 33:
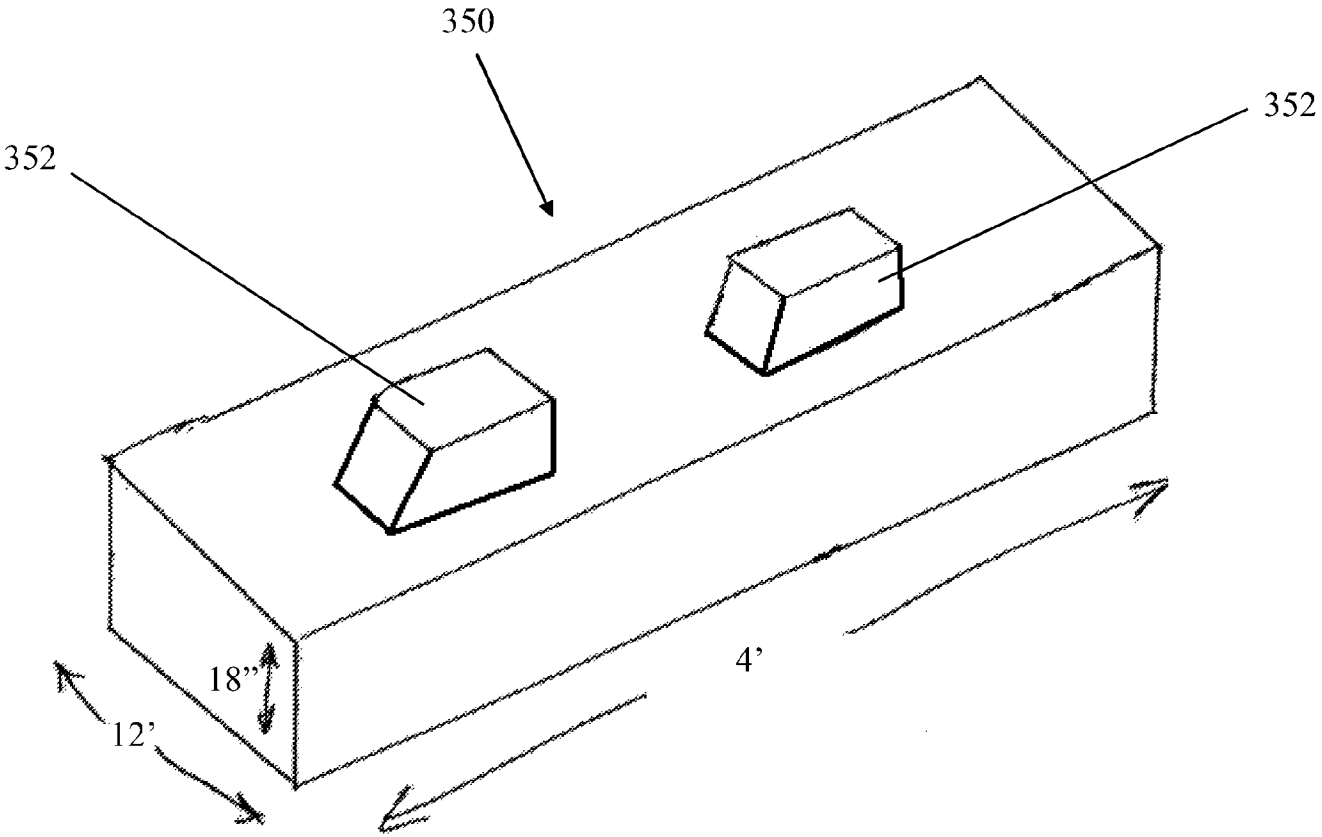
FIG. 33 is a drawing illustrating a second embodiment of an accessory floatation unit according to the invention. In this embodiment the accessory floatation unit is larger and includes two fixation tabs.

FIGS. 32 and 33 are schematic diagrams illustrating two exemplary embodiments of auxiliary floatation units 350 for use when greater buoyancy is desired for an individual floatation dock unit. As illustrated, the modular design allows the auxiliary floatation units 350 to be deployed easily simply by inserting the tab 352 into the opening of the support column 102 on the bottom of the floatation shell 100. Those of skill in the art will appreciate that the auxiliary floatation units can be any buoyant apparatus which can mate with the floatation shell support column 102. As shown in FIGS. 32 and 33, the auxiliary floatation unit 350 may comprise an air-bladder by having air pumped into the cavity using a curved pipe from the deck above. Similarly, when the buoyancy needs to be decreased, the air can be pumped out. Those of skill in the art will recognize that auxiliary floatation units such as those disclosed herein can be used at single dock unit in a modular docking system and they can remain in place even when not filled with air, such as, for example during a drought or period of low water. However, the units can remain in place ready for charging if environmental changes require.

Figure 34:
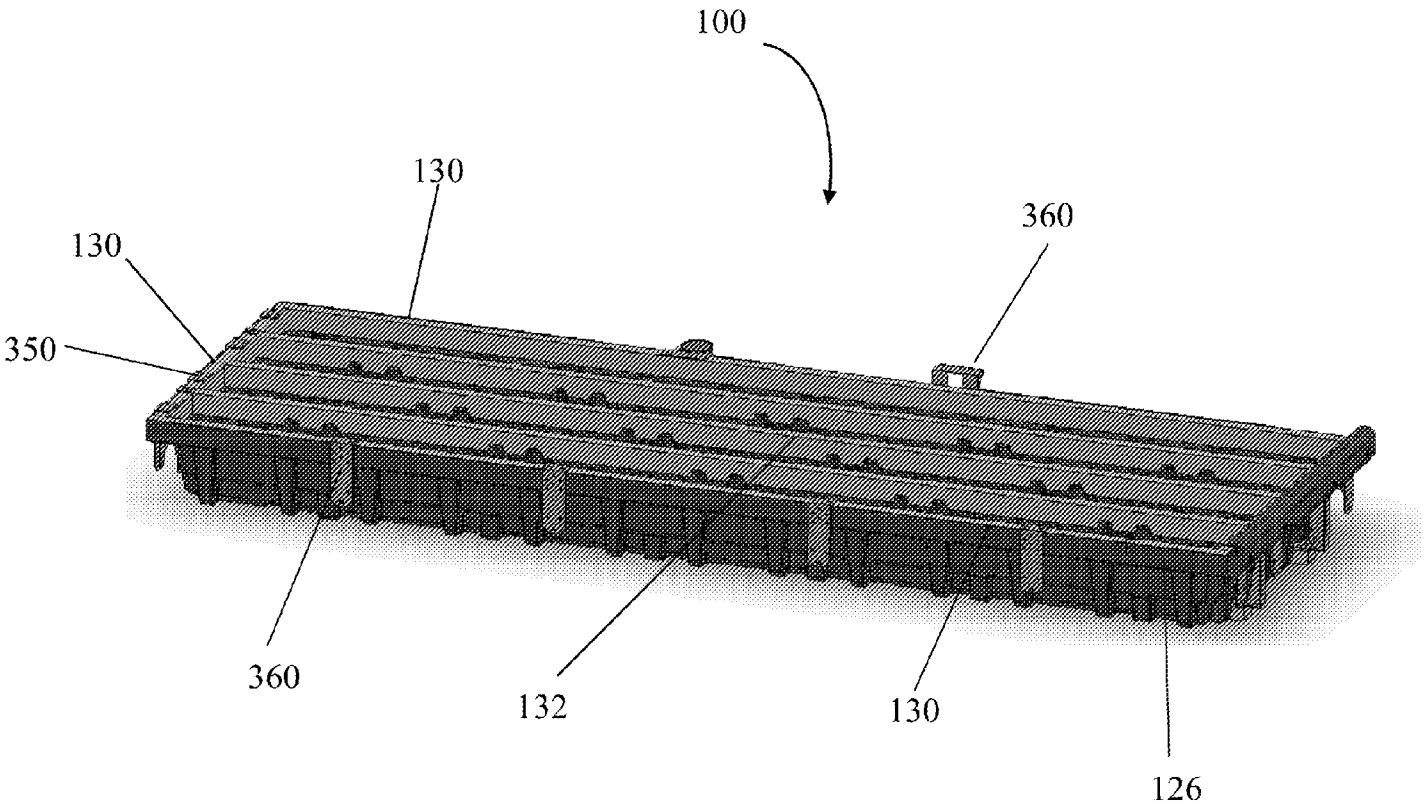
FIG. 34 illustrates another exemplary embodiment of the floating dock according to the invention showing the use of auxiliary deck brackets to reinforce the dock unit.
Figure 35:
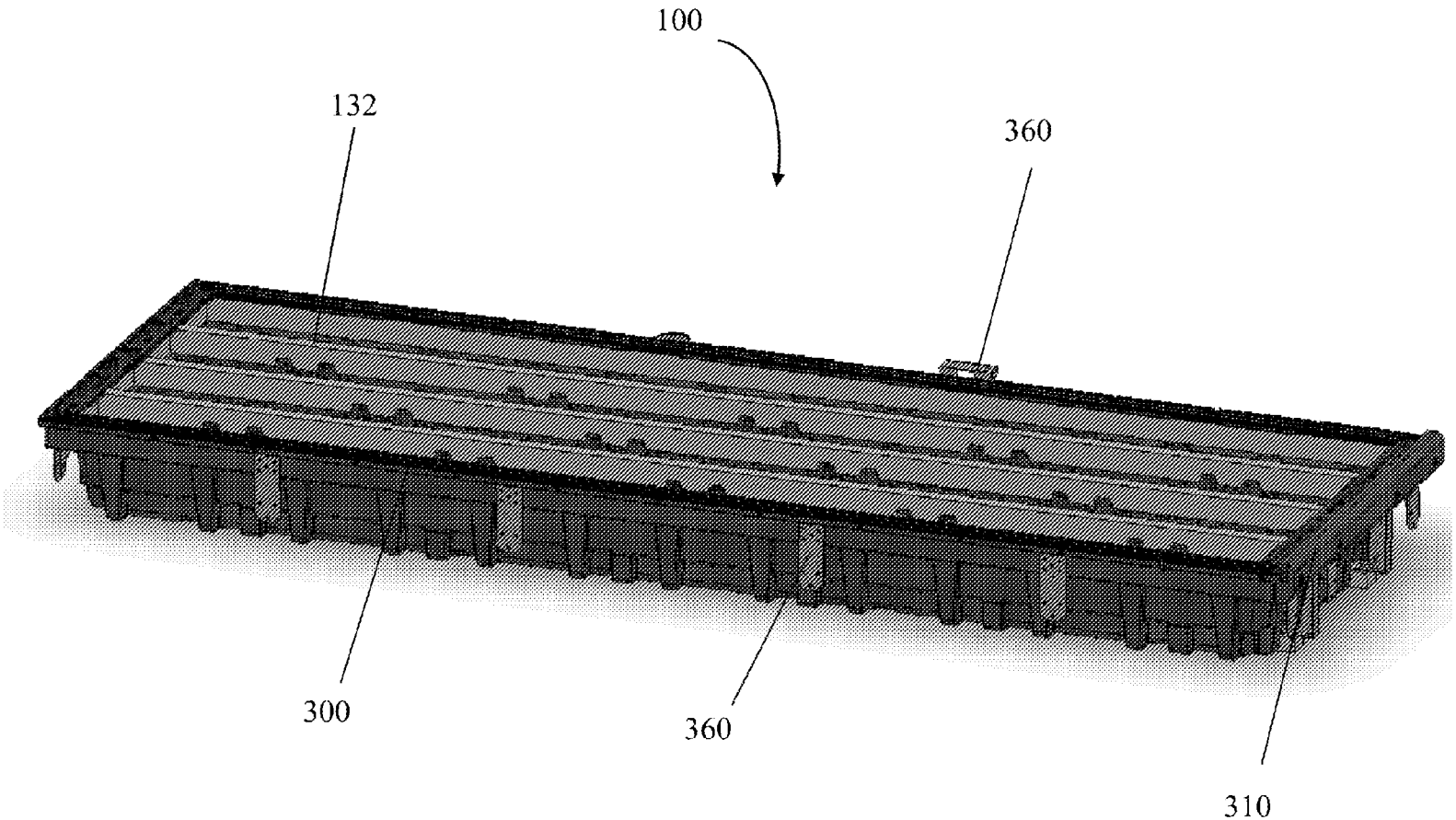
FIG. 35 illustrates the embodiment of the invention shown in FIG. 34 but with the dri-loc ring in place.
Figure 36:
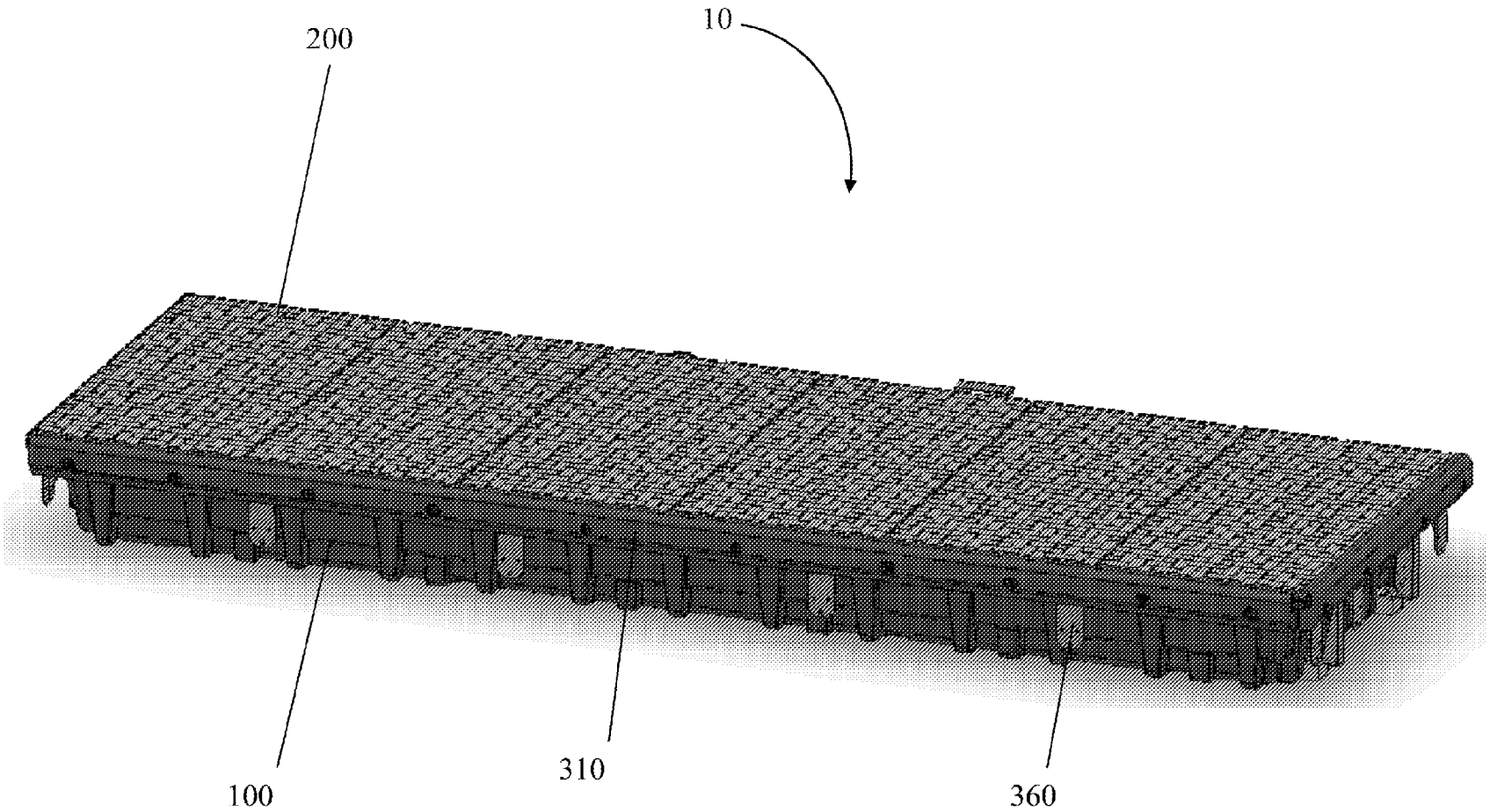
FIG. 36 illustrates the exemplary embodiment illustrated in FIGS. 34 and 35 with the deck installed.

FIGS. 34-36 illustrate another exemplary embodiment of the floating dock unit 10 according to the present invention. As illustrated, in FIG. 34, reinforcement brackets 360 can be used to further reinforce the attachment of the support member frame 130 to the floatation shell 100 for extra security during use in very rough water if desired. In this exemplary embodiment, as shown in FIG. 34, reinforcement brackets 360 are fastened through the floatation shell 100 into side support frame members 128. The side support members 130 are located inside the floatation shell 100 and the brackets 360 are bolted through the side of the floatation shell 100 and into the support frame members 128. The reinforcement brackets 360 can also be fastened (top to bottom) by bolting through the metal bracket 360 from the top down, through the side support member 130 and through the side wall 124 of the floatation shell 100. In this embodiment the connection of the side support member 130 to the floatation shell 100 can reinforced along the entire periphery of the dock unit 10 as needed by brackets 360. The dri-loc retainer ring 300 is installed on top of the reinforcement brackets 360 as shown in FIG. 35. FIG. 36 shows the foam deck 200 applied to the floatation shell 100 with the side rails 310 visible.

FIG. 37 illustrates one embodiment of a modular floating dock system 600 according to the invention. Illustrated are a plurality of modular floating dock units 10 connected to each other. In this embodiment, the middle dock units 12 are larger having a size of approximately 24'×8' while the perpendicular dock units 14 are 24'×4'. Of course those of skill in the art will appreciate that the dock units can be assembled in the system to comprise any convenient sizes. As illustrated, each of the units has a floatation shell 100 and a foam deck 200. Also illustrated are the supporting buttresses 152 of the floatation shell 100. In addition, when the floating dock units are assembled into a multiple unit system, corner brackets, such as the large piling bracket 370 can be used to reinforce the connection between the units as well as provide brackets for pylons to fix the dock system to the littoral floor. Also shown is a linear boat bumper system 400 that can be affixed to the perimeter of the dock units 10 to completely surround the perimeter of the dock system assembled from a plurality of the units 10.

Figure 38:
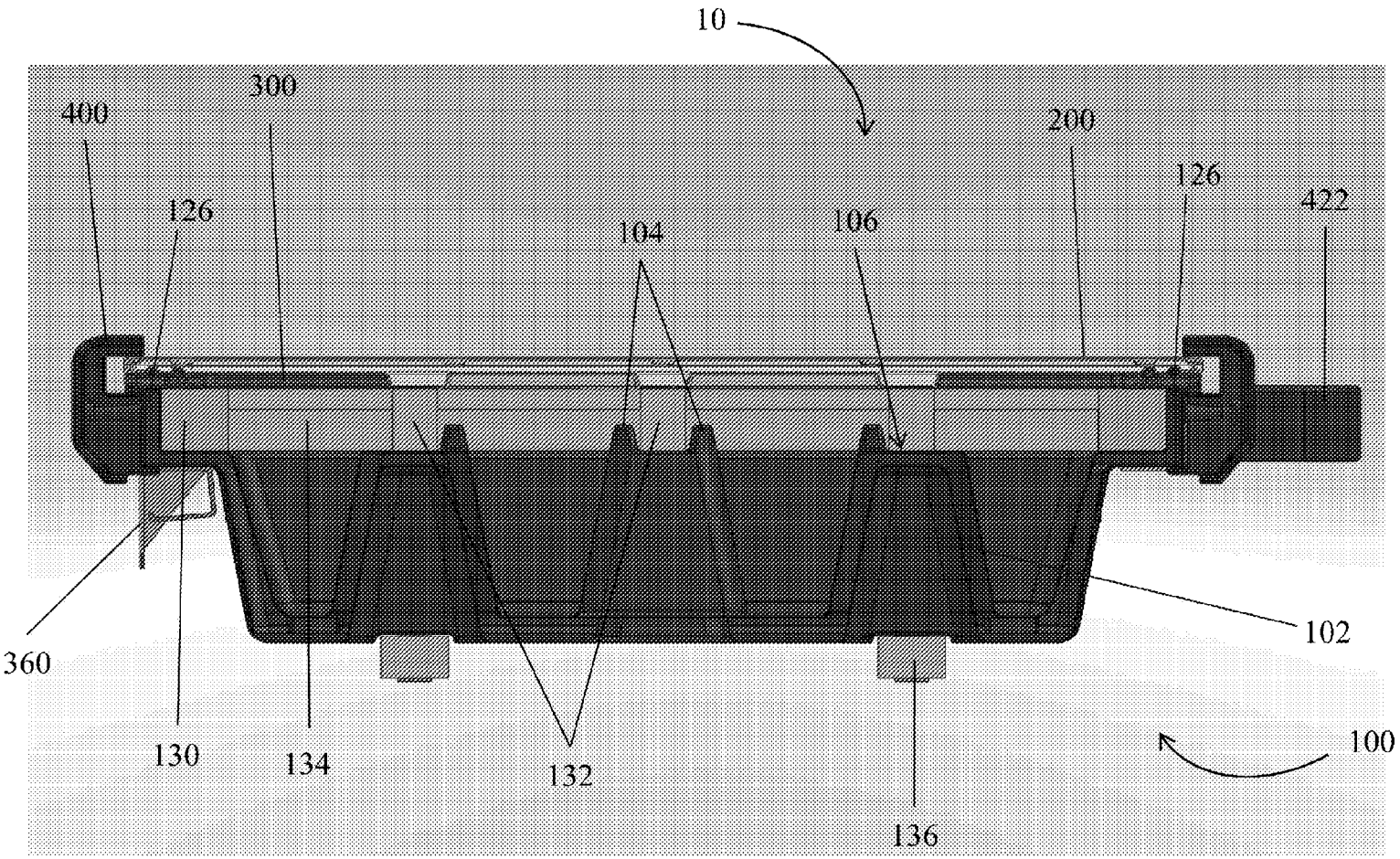
FIG. 38 is a cross section through a completed dock unit.
Figure 39A:
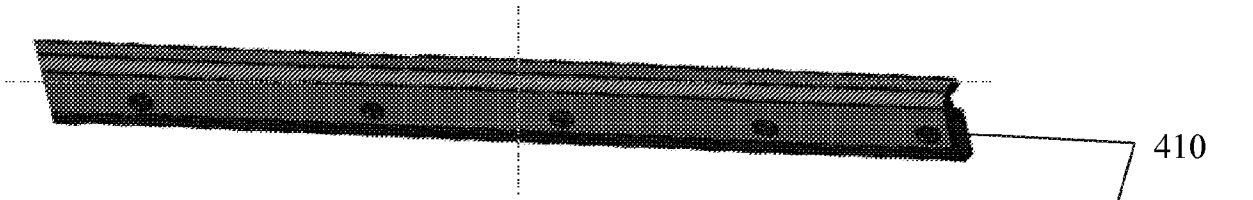
Figure 39B:
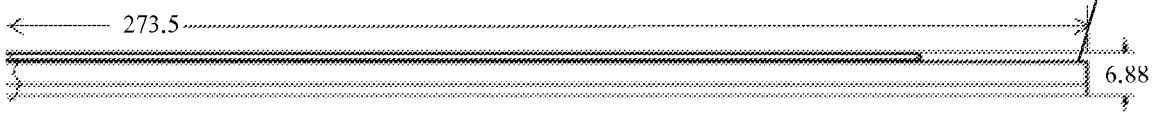
Figure 39C:
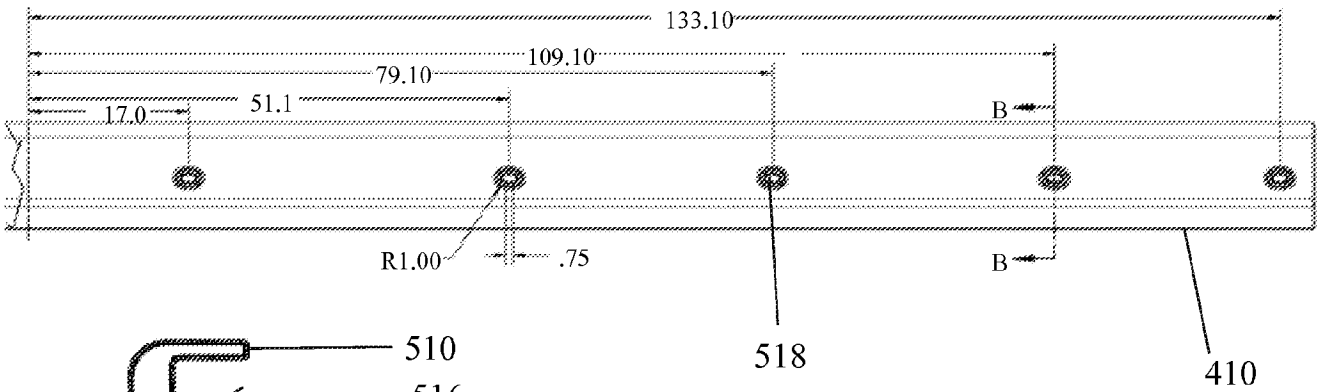
Figure 39D:
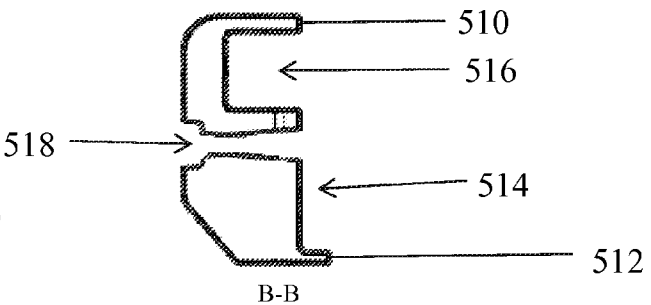

FIG. 38 is a cross section through a completed dock unit 10. In this view, the floating shell 100 is shown including support column 102 and the support column flanges 104 which provide support column groove 106. Also shown are the support frame members 128 comprising side support member 130, transverse member 134 and longitudinal support members 132 which fit within the flanges 104 of the support columns 102. The side rim 126 of the floatation shells 100 are also illustrated on top of which sits the dri-loc ring 300 with the foam deck 200 situated on top of the dri-lock ring 300. A shell reinforcement bracket 360 is visible below the edge of the dock unit 10. Surrounding the entire unit is a linear boat bumper 400 also visible is a small piling bracket cover 422 which covers the small piling bracket (not visible).

FIGS. 39-47 illustrate various embodiments of the linear boat bumper 400. FIG. 39H illustrate various embodiments of a 24' bumper rail 410 of the linear boat bumper system 400 according to one embodiment of the invention. In this embodiment, the straight section 410 is approximately 12" wide thereby approximating the size of the rim 126 of the flotation shell. FIG. 39A is a perspective rendering of the linear bumper rail 410. 39B is a bottom plan view of a portion of the linear bumper rail. 39C is a side plan view of the bumper rail also shown are lag-bolt holes 518 regularly spaced along the bumper 410 for attachment directly into the framing member 130 of dock unit 10. 39D is a cross section of the side rail taken along line B-B of the view shown in FIG. 39C. Shown in this view, the various members of the bumper system 400 generally have an upper lip 510, a bottom lip and a side rail recess and an expansion pocket 516. In use, the upper lip 510 extends over the top of the foam deck 200. The deck 200 fits into the expansion pocket and the remainder of the side rail 310 fits within the recess 514 defined by the bottom lip 512. The bottom lip 512 extends under the side rail 310 such that the entire side rail portion of the dock unit is protected by the bumper. This arrangement is illustrated in FIG. 38. Further, the expansion pocket allows the deck 200 to expand and contract depending on the temperature of the environment without disturbing the bumper alignment along the dock unit.

In the embodiment illustrated, the linear boat bumper system 400 can be made of any moldable polymer. Examples of such polymers include LLDPE resins (linear low-density polyethylene). However, any type of resin used in conventional molding may be utilized. Examples of other types of resins useful in the method of this invention include polycarbonates, nylons, polyvinylchlorides, and polyesters. Additional useful resins include ABS, acetals, acrylics, cellulosics, epoxies, fluorocarbons, phenolics, polystyrenes, polyurethanes, SAN polymers, and silicone polymers EVA copolymers and EBA. When molded the pieces of the linear bumper system are hollow they provide resilience and cushioning for boats moored to the dock units 10 as well as providing a sacrificial unit to protect other portions of the dock unit 10. In addition, it will be appreciated that the linear bumper rail can be cut to any length necessary to provide an exact fit for the linear bumper rail 400 when customized to any type of dock unit.

FIG. 39E is a top-plan view of a portion of the linear bumper rail. FIG. 39F is a side-plan view of a portion of the side bumper from the back. FIG. 39G is a cross section of the linear rail taken along line A-A of FIG. 39F. FIG. 39H is a right end view of the side rail 410. Both FIGS. 39G and H illustrate that, in cross section, the linear bumper sections include an upper lip 510, an expansion pocket 516, a side rail recess 514 and a lower lip 512 to surround and protect the side rails 310 of the floatation shells.

Figure 40B:
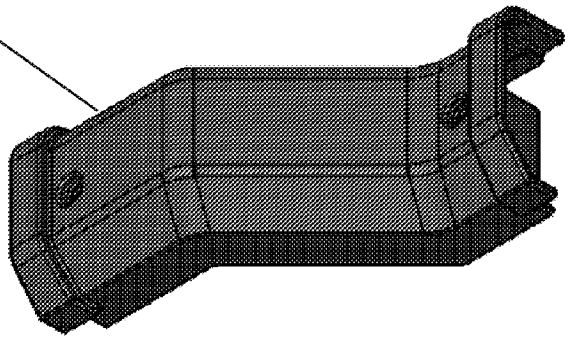
FIGS. 40A-40G illustrate one embodiment of a 45° reducing splice bracket cover in one embodiment of a linear boat bumper according to the invention. 40A is a perspective, top-plan view of the cover. 40B is a perspective bottom-plan view of the cover.
Figure 40A:
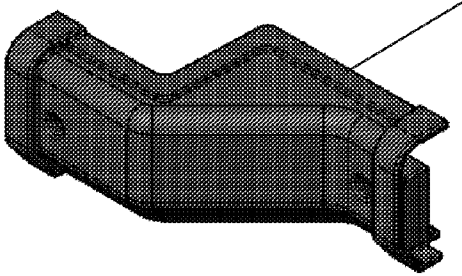
Figure 40C:
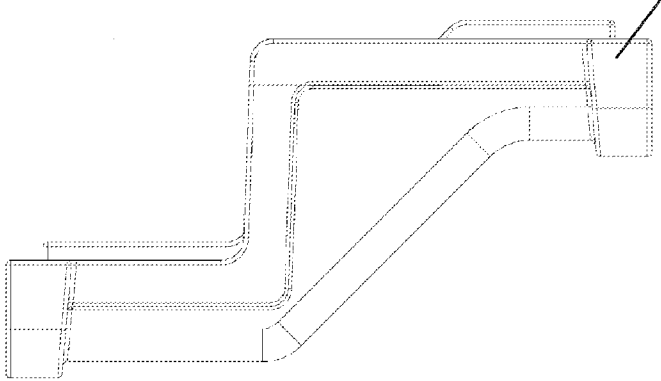
Figure 40D:
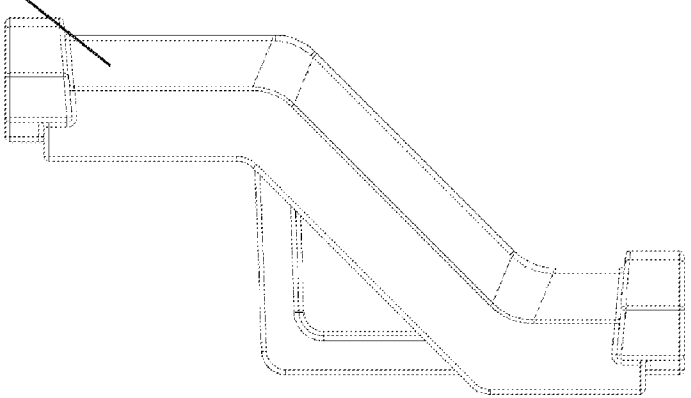
Figure 40E:
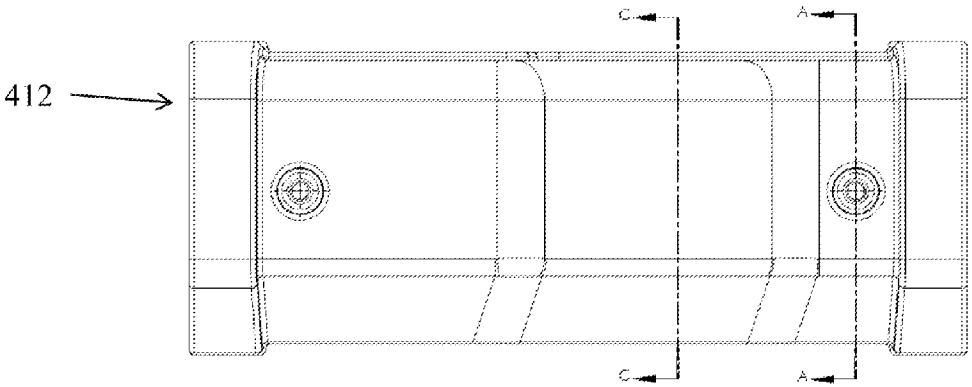
Figure 40G:
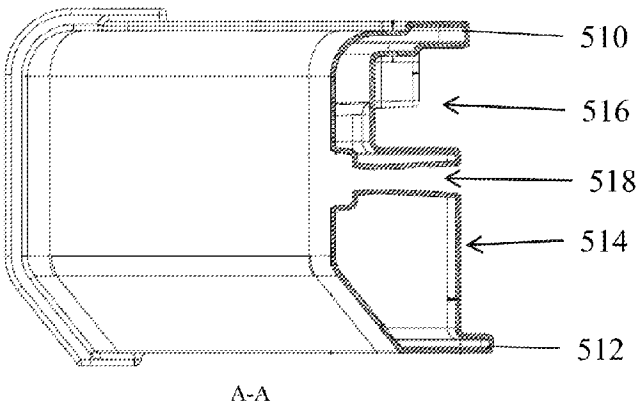
Figure 40F:
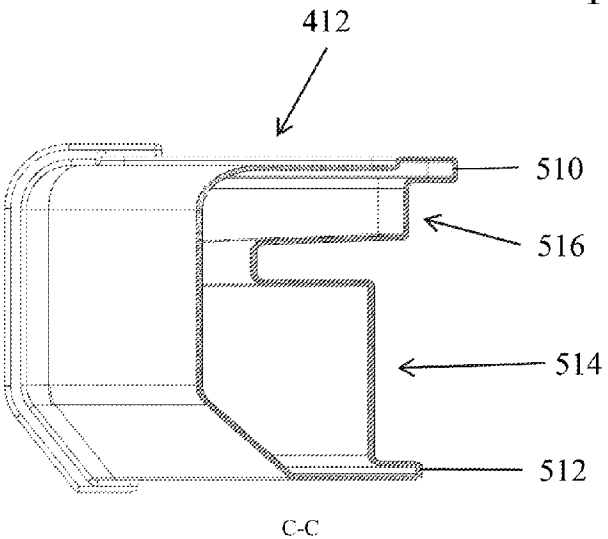

FIGS. 40A-40H illustrate one embodiment of a 45° reducing splice bracket cover 412 according to the invention. 40A is a perspective, top-plan view of the cover. 40B is a perspective bottom-plan view of the cover. FIG. 40C is a schematic diagram of a perspective top-plan view of the cover. FIG. 40D is a schematic diagram of a bottom-plan view of the cover. FIG. 40E is a side plan view of the cover. FIG. 40F is a cross section of the cover taken along line C-C of FIG. 40E. FIG. 40G is a cross section of the cover taken along line A-A of FIG. 40E. Both FIGS. 40F and 40G illustrate that each of the pieces includes a top lip 510, an expansion pocket 516, a side rail recess 514 and a lower lip 512.

Figure 41A:
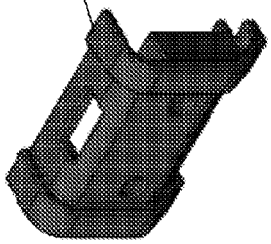
FIGS. 41A-41E illustrate a cleat bracket cover according to one embodiment of a linear boat bumper according to the invention.
Figure 41B:
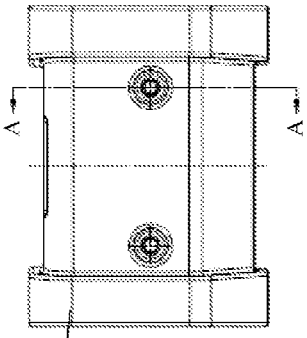
Figure 41C:
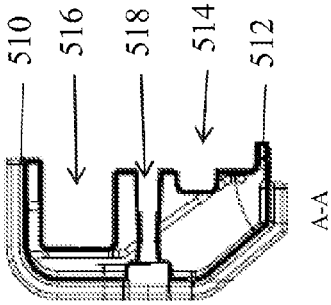
Figure 41D:
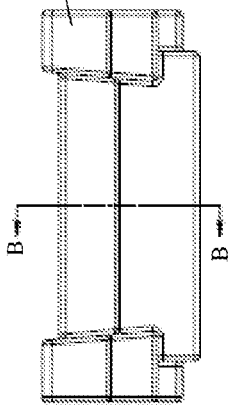
Figure 41E:
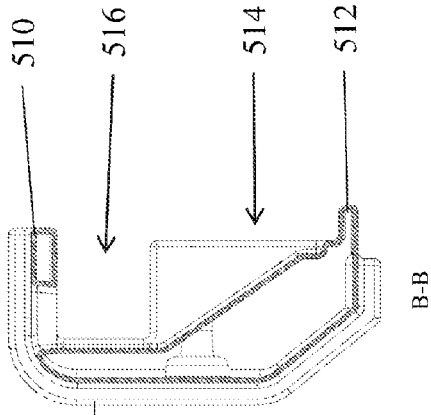

FIGS. 41A-41G illustrate a cleat bracket cover 414 according to one embodiment of the invention. The cleat bracket cover 414 is configured to cover a cleat bracket 368, such as illustrated in FIG. 29. FIG. 41A is a perspective top-plan view of the cleat bracket cover according to one embodiment of the invention. FIG. 41B is a side-plan view of this embodiment. FIG. 41C is a cross section through lines A-A shown in FIG. 41B. FIG. 41D is a top-plan view of the cleat bracket. FIG. 41E is a cross section of the cleat bracket taken along lines B-B of FIG. 41D. Both FIGS. 41C and 41E illustrate that, in cross section, the cleat bracket cover 414 includes the upper lip 510, expansion pocket 516, a side rail recess 514 and a lower lip 512.

Figure 42B:
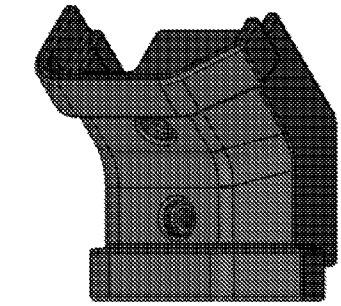
FIGS. 42A-42G illustrate one embodiment of a 45° inside corner bumper according to one embodiment of a linear boat bumper system according to the invention.
Figure 42E:
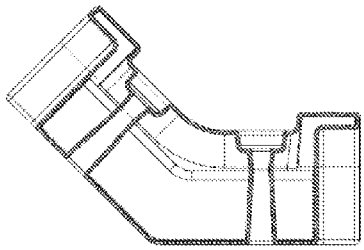
Figure 42C:
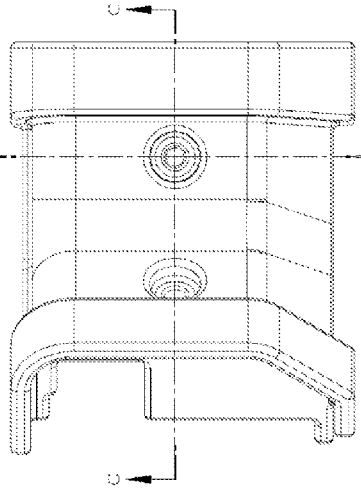
Figure 42A:
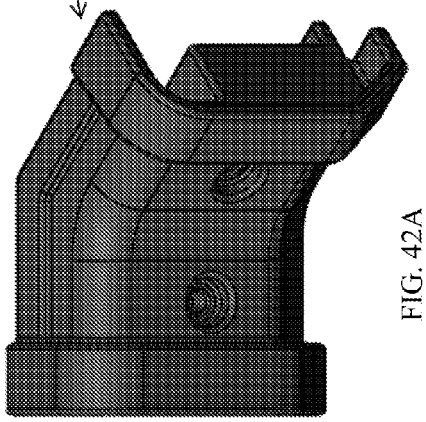
Figure 42D:
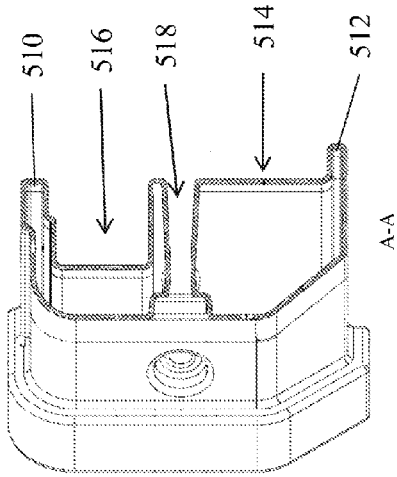
Figure 42G:
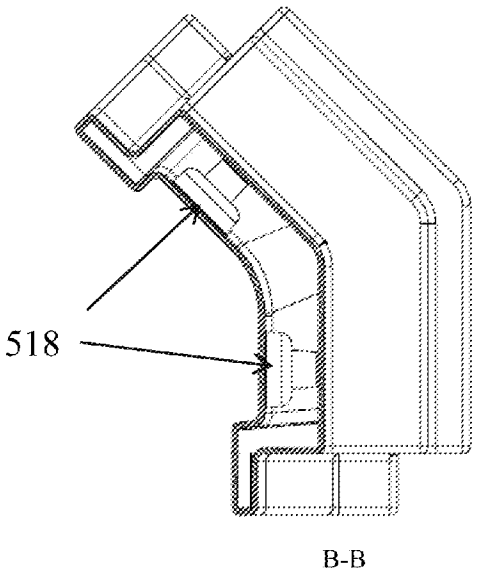
Figure 42F:
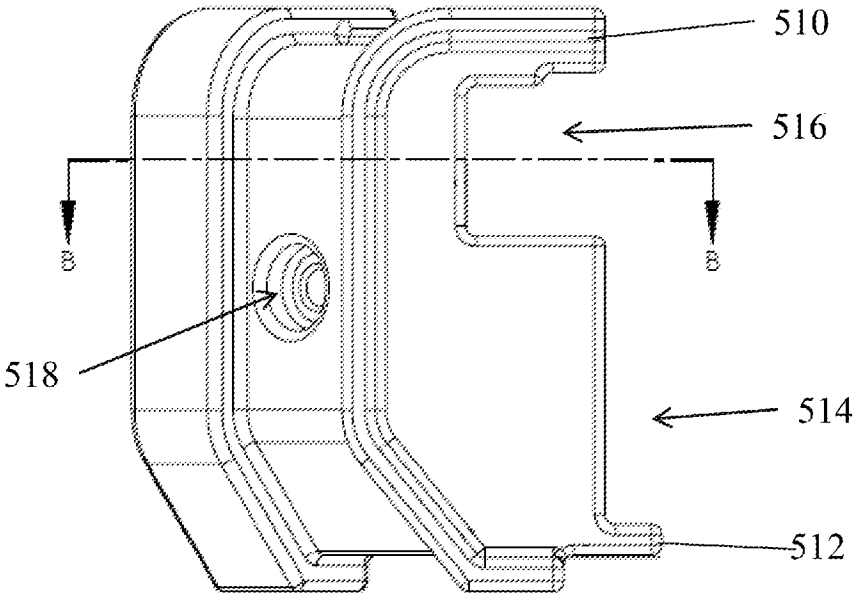

FIGS. 42A-G illustrate one embodiment of a 45° inside corner bumper 416 unit according to one embodiment of the invention. FIG. 42A is a perspective, top-plan outside view of the bumper unit. FIG. 42B is a perspective bottom-plan view of the bumper part according to the invention. FIG. 42C is a schematic side-plan view of the bumper part. FIG. 42D is a cross section taken along lines A-A of FIG. 42C. FIG. 42E is a cross section of the bumper part taken along lines C-C of FIG. 42C. FIG. 42F is a perspective end-plan view of the bumper part and FIG. 42G is a cross section through the bumper along lines B-B shown in FIG. 42F. As illustrated in FIGS. 42D and F the inside corner bumper 416 further includes upper lip 510, expansion pocket 516, a side rail recess 514 and a lower lip 512 also illustrated is lag-bolt hole 518 for attachment of the bumper unit 416 to the frame member 130 of the floatation shell.

Figure 43A:
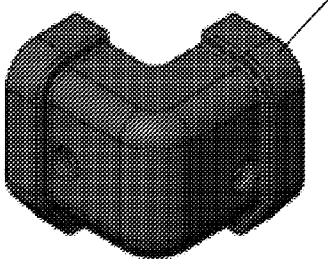
FIGS. 43A-43G illustrate one embodiment of a 90° outside corner bumper unit according to one embodiment of a linear boat bumper system according to the invention.
Figure 43B:
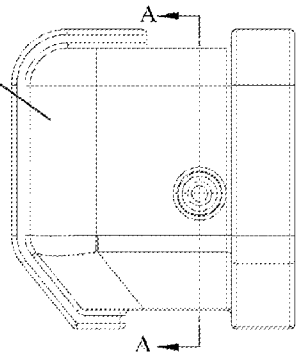
Figure 43C:
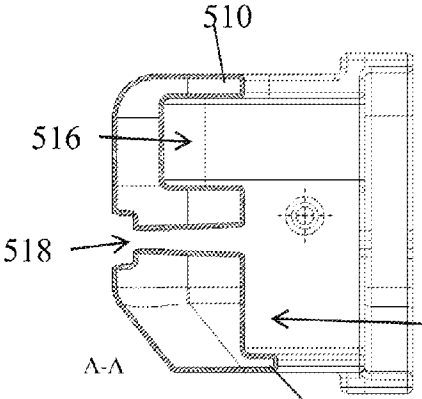
Figure 43D:
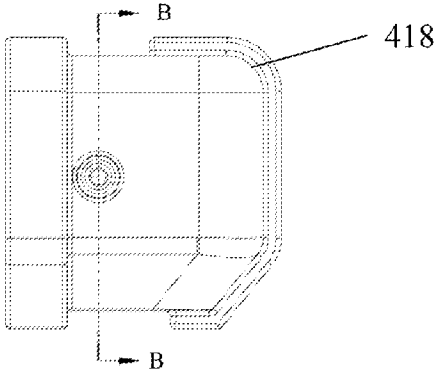
Figure 43E:
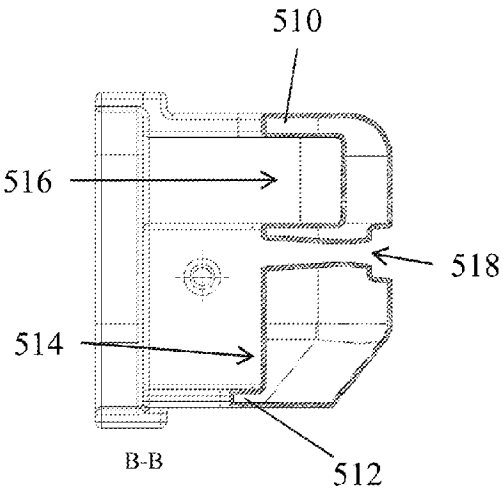
Figure 43G:
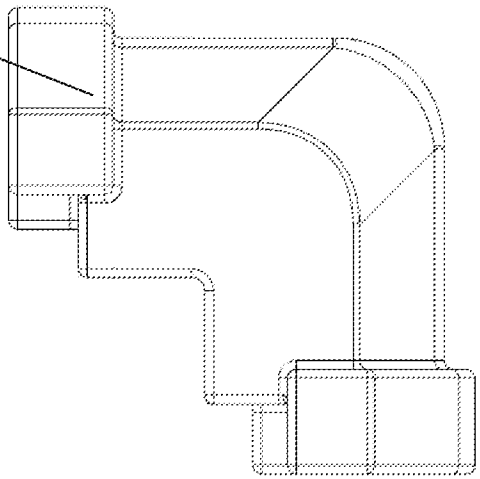
Figure 43F:
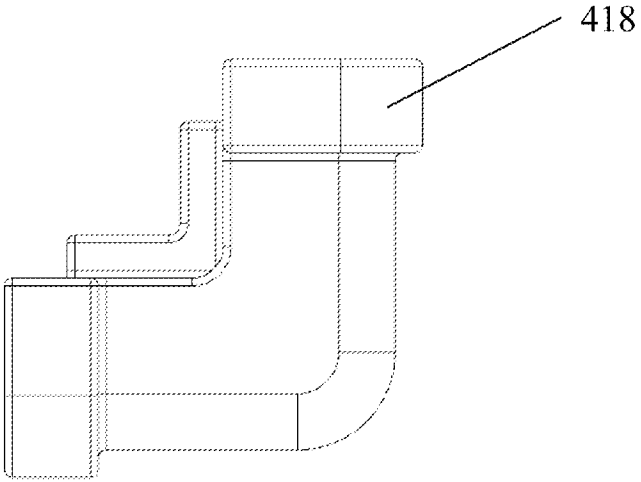

FIGS. 43A-G illustrate one embodiment of a 90° outside corner bumper piece 418 according to the invention. FIG. 43A is a perspective top-plan view of the bumper piece 418. FIG. 43B is a right schematic diagram of the bumper piece 418 while FIG. 43C is a cross section view taken through line A-A of FIG. 43B. FIG. 43D is a left side view and FIG. 43E is a cross section of FIG. 43D taken along lines B-B. FIG. 43F is a bottom plan view of the bumper part and FIG. 43G is a top plan view of the bumper. As illustrated in FIGS. 43C and E, the bumper piece 418 includes upper lip 510, expansion pocket 516, a side rail recess 514 and a lower lip 512 also illustrated is lag-bolt hole 518 for attachment of the bumper unit 418 to the frame member 130 of the floatation shell.

Figure 44B:
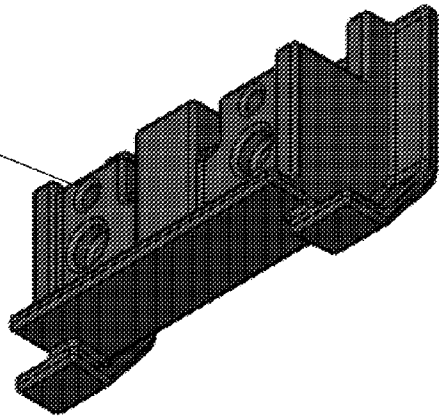
FIGS. 44A-44D illustrate one embodiment of a power pedestal bracket cover according to one embodiment of a linear boat bumper system according to the invention.
Figure 44A:
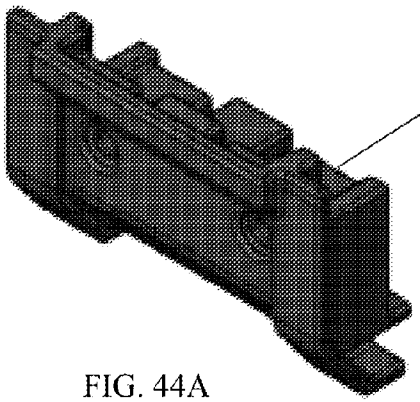
Figure 44D:
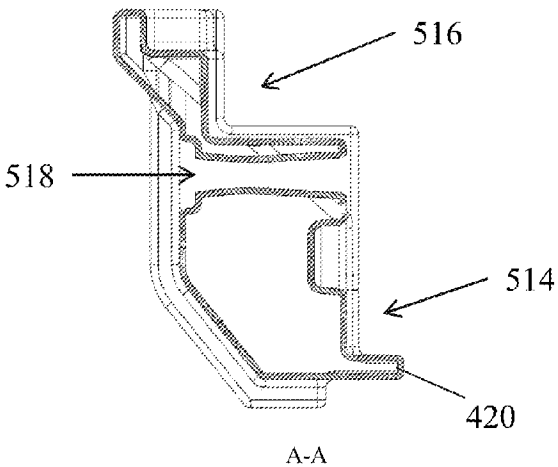
Figure 44C:
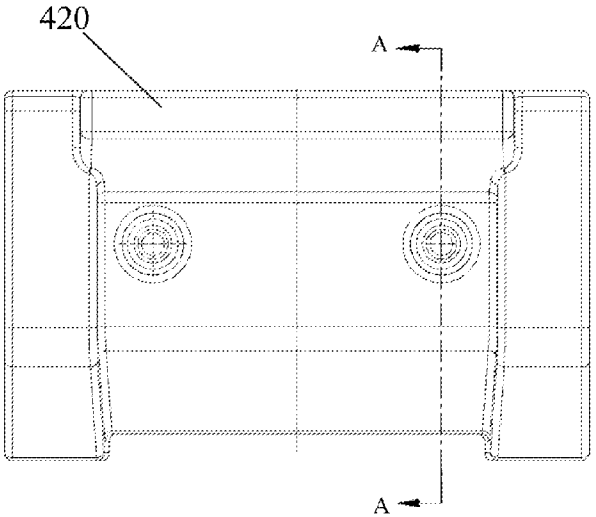

FIGS. 44A-44D illustrate one embodiment of a power pedestal bracket cover 420 according to the invention. The bracket cover 420 is configured to cover a power pedestal bracket such as, for example 362 illustrated in FIG. 26. FIG. 44A is a perspective top-plan view of cover 420. FIG. 44B is a perspective bottom-plan view of cover 420. FIG. 44C is a schematic diagram of a side plan view while FIG. 44D is a cross section of the bracket cover taken along lines A-A of FIG. 44C. As can be seen from FIG. 44A, because the bracket cover surrounds the power pedestal bracket, there is no upper lip 510. However, as seen in FIG. 44D, the bracket cover 420 includes expansion pocket 516, a side rail recess 514 and a lower lip 512 also illustrated is lag-bolt hole 518 for attachment of the bumper unit 416 to the frame member 130 of the floatation shell.

FIGS. 45A-45B illustrate one embodiment of a small piling bracket cover 422 according to the invention. Bracket cover 422 is suitable for use with small piling bracket 364 illustrated in FIG. 27. FIG. 45A is a perspective, top-plan view. FIG. 45B is a perspective bottom-plan view of the small piling bracket cover 422. FIGS. 45A and B illustrate the upper lip 510, expansion pocket 516, side rail recess 514 and lower lip 512 of the linear boat bumper system 400.

FIGS. 46A and 46B illustrate one embodiment of a splice bracket cover 424 according to the invention. FIG. 46A is a perspective top-plan view of the bracket cover and FIG. 46B is a perspective, inside bottom-plan view. FIGS. 46A and 46B illustrate the upper lip 510, expansion pocket 516, side rail recess 514 and lower lip 512 of the linear boat bumper system 400.

Figure 47C:
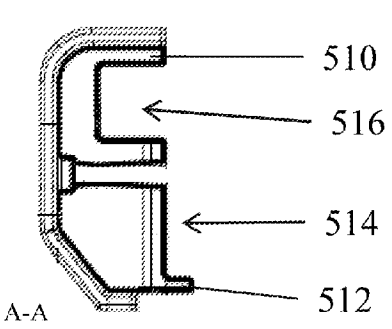
FIGS. 47A-47E illustrates utility anchor/drag rail bracket cover according to one embodiment of the invention.
Figure 47B:
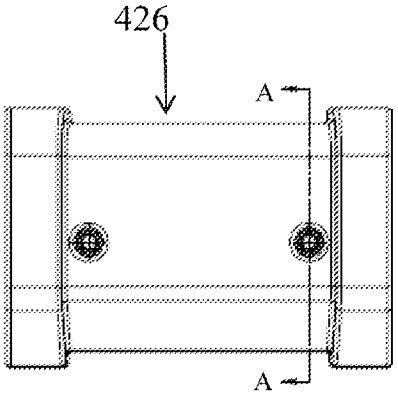
Figure 47A:
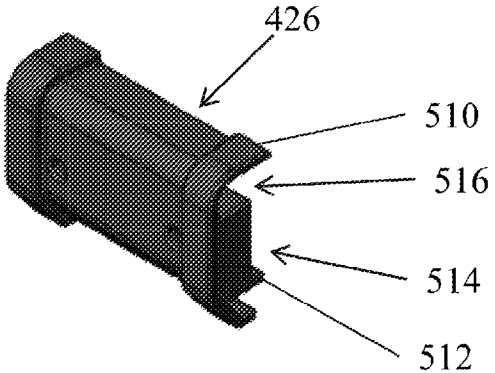
Figure 47E:
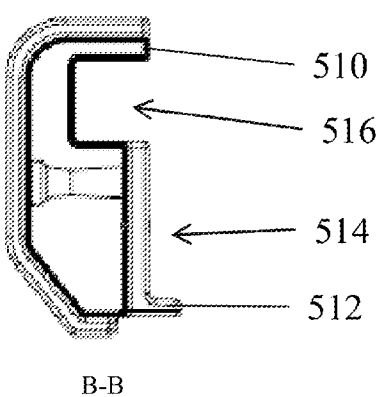
Figure 47D:
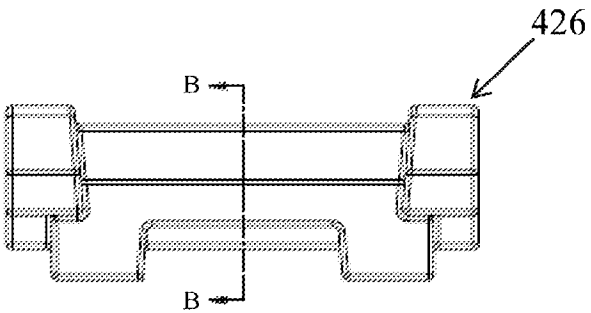

47A-E illustrate utility anchor/drag rail bracket cover suitable for use with the embodiment of anchor chain bracket 366 illustrated in FIG. 28 according to one embodiment of the invention. FIG. 47A is a top-plan perspective view. FIG. 47B is a side-plan schematic drawing. FIG. 47C is a cross section view taken along line A-A of FIG. 47B. FIG. 47D is a top-plan view and FIG. 47E is a cross section of FIG. 47D taken through line B-B. FIGS. 47A, 47C and 47E illustrate the upper lip 510, expansion pocket 516, side rail recess 514 and lower lip 512 of the linear boat bumper system 400.

Figures 48A, 48B, 49A, 49B:
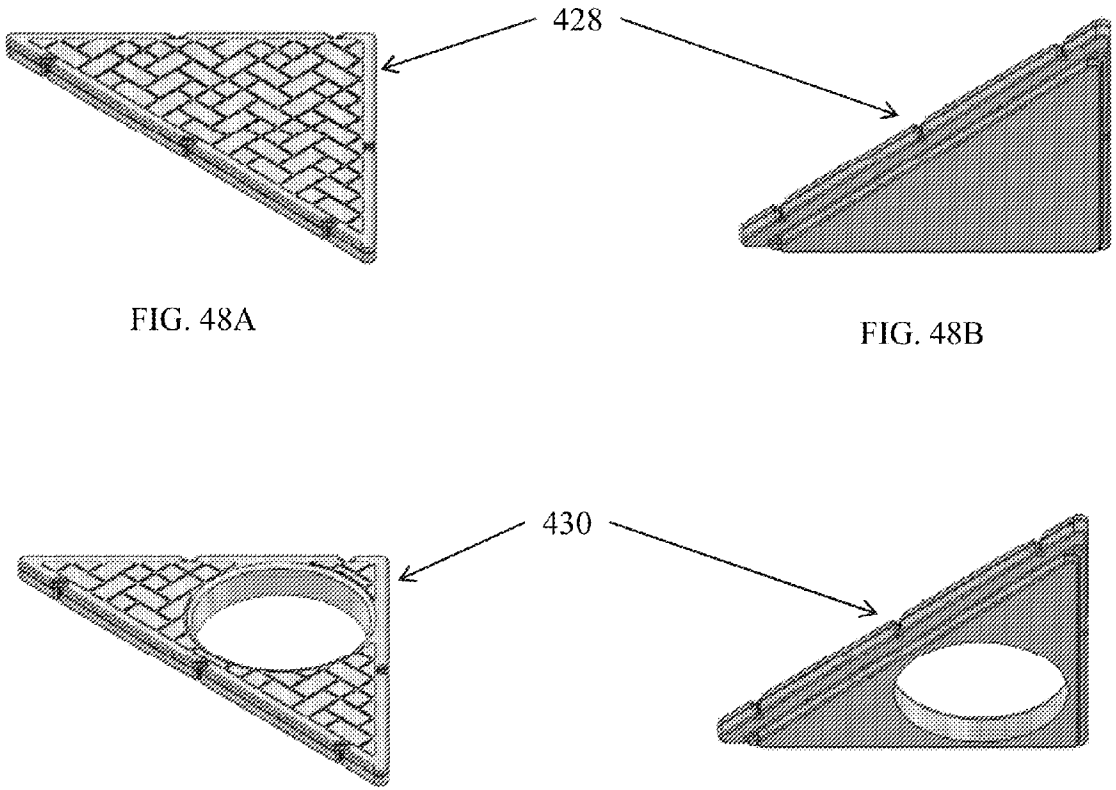
FIGS. 48A-48B illustrate one embodiment of a triangle corner deck cover with no hole.
FIGS. 49A-49B illustrate one embodiment of a triangle corner deck cover with a hole.

FIGS. 48A-B illustrate one embodiment of a triangle corner deck cover with no hole 428. FIG. 48A is a perspective top-plan view. FIG. 48B is a perspective bottom-plan view. Corner deck cover 428 is suitable for use with the embodiment of the large piling bracket 370 illustrated in FIG. 30, if no pylori is desired securing the corner bracket 370.

FIGS. 49A-B illustrate one embodiment of a triangle corner deck cover with a hole 430. FIG. 49A is a perspective top-plan view of cover 430. Corner deck cover 430 is suitable for use with the embodiment of the large piling bracket 370 illustrated in FIG. 30, when a pylori is desired securing corner bracket 370.

Those of skill in the art will appreciate that the floating dock units 10 can be arranged in multiple configurations with different size modular components to arrive at customized modular dock systems for the particular needs of each marine environment and locale. Further, while the linear boat bumper system 400 described herein is particularly suitable for use with the modular docking system 600, the linear boat bumper system is equally suitable for use on conventional wooden and/or modular docking systems. As described herein, the linear boat bumper system 400 is suitable to accommodate a convention dock deck within the expansion pocket 516 and a convention side rail within the side rail recess. Moreover, regularly spaced lag-nut holes 518 allow for the linear bumper system 400 to be secured directly to any underling side rail of any dock system. Furthermore, the linear dock system 400 being fabricated out of suitable polymer materials is easily customized to fit any length of previously constructed dock system.

Various exemplary embodiments of devices and compounds as generally described above and methods according to this invention will be understood more readily by reference to the following examples, which are provided by way of illustration and are not intended to be limiting of the invention in any fashion.

What is claimed is:

1. A modular floating dock unit comprising:

i) a molded flotation shell;

ii) a foam decking piece designed and configured to mate with the floatation shell; and iii) a water-tight retainer ring, designed and configured to fit in between the decking and the flotation shell;

wherein the molded floatation shell is designed and configured to nest within one or more other flotation shells for shipment and storage;

wherein the decking piece is mounted on the flotation shell with the water-tight retainer ring therebetween creating a water-tight flotation chamber thereby providing a modular floating dock unit.

2. The modular floating dock unit of claim 1, wherein the molded flotation shell is provided in different sizes.

3. The modular floating dock unit of claim 2, wherein the different sizes include: 24'×4'×2'; 24'×6'×2'; and 24'×8'×2'; and 12'×24'×2'.

4. The modular floating dock unit of claim 1, wherein the floatation shell includes support columns molded therein and spaced regularly in the flotation shell.

5. The modular floating dock unit of claim 4, wherein one or more support members are supported by the support columns.

6. The modular floating dock unit of claim 5 wherein the decking piece is fixed to the flotation shell support through a framing member.

7. The modular floating dock unit of claim 5, wherein the support member is enclosed in a water-tight compartment.

8. The modular floating dock unit of claim 5, wherein the support members are wooden beams, laminate beams and metal beams.

9. The modular floating dock unit of claim 5, wherein the beams are encased in plastic.

10. The modular floating dock unit of claim 9, wherein the brackets are galvanized steel, e-coat steel, stainless steel or combinations thereof.

11. The modular floating dock unit of claim 1, further including an attachment mechanism for connecting the unit to one or more modular floating dock units.

12. The modular floating dock unit of claim 1, wherein the foam decking piece is made by rotational molding.

13. The modular floating dock unit of claim 12, wherein the foam decking is one-step foam.

14. The modular floating dock unit of claim 1, wherein the floatation shell is made by rotational molding.

15. The modular floating dock unit of claim 1, wherein the water-tight retainer ring is made by rotational molding.

16. The modular floating dock unit according to claim 1, further including a side rail that intercalates with the floatation shell, foam decking piece and retainer ring upon assembly.

17. The modular floating dock system of claim 16, wherein the floatation shell is made by rotational molding.

18. The modular floating dock system of claim 16, wherein the water-tight retainer ring is made by rotational molding.

19. The modular floating dock system of claim 16, further comprising a linear boat bumper system.

20. The linear boat bumper system of claim 19, wherein the system includes hollow molded bumper units that provide resilience and cushioning to an abutting boat and to the modular dock units.

21. The linear boat bumper system of claim 20, wherein the hollow molded bumper units are molded from linear low-density polyethylene (LLDPE) resins, polycarbonates, nylons, polyvinylchlorides, polyesters, acetals, acrylics, cellulosics, epoxies, fluorocarbons, phenolics, polystyrenes, polyurethanes, SAN polymers, silicone polymers, EVA copolymers and EBA.

22. A modular floating dock system comprising a plurality of floating dock units each including:

i) a molded flotation shell;

ii) a foam decking piece designed and configured to mate with the floatation shell; and iii) a water-tight retainer ring, designed and configured to fit in between the decking and the flotation shell;

wherein the molded floatation shell is designed and configured to nest within one or more other flotation shells for shipment and storage;

wherein the decking piece is mounted on the flotation shell with the retainer ring therebetween creating a water-tight flotation chamber and wherein two or more dock units are connected to provide a dock system.

23. The modular floating dock system of claim 22, wherein the floating dock units have internal support members.

24. The modular floating dock system of claim 22, wherein the two or more dock units are connected directly through the floatation shell.

25. The modular floating dock system of claim 22, wherein the plurality of floating dock units comprises a plurality of flotation shells of a same size.

26. The modular floating dock system of claim 22, wherein the plurality of floating dock units include floatation shells of different sizes.

27. The modular floating dock system of claim 22, wherein the different sizes are: 24'×4'×2'; 24'×6'×2'; and 24'×8'×2'; and 12'×24'×2'.

28. The modular floating dock system of claim 22, wherein the floatation shell includes support columns molded therein.

29. The modular floating dock system of claim 28, wherein one or more support members are supported by the support columns.

30. The modular floating dock system of claim 29 wherein the decking piece is fixed to the floatation shell support through a support member.

31. The modular floating dock system of claim 29, wherein the support member is enclosed in a water-tight compartment.

32. The modular floating dock system of claim 29, wherein the support member includes wooden beams, metal beams, laminate beams and combinations thereof.

33. The modular floating dock system of claim 32, wherein the beams are encased in plastic.

34. The modular floating dock system of claim 22, wherein the decking piece is made by rotational molding.

35. The modular floating dock system of claim 12, wherein the foam decking is one-step foam having an outer skin and an inner foam core.

36. A linear boat bumper system suitable for use on an aquatic dock comprising a plurality of hollow molded bumper units the bumper units being optimized to provide an upper lip, an expansion pocket, a side rail recess and a lower lip such that a deck edge and side rail of the aquatic dock are encased in the linear boat bumper unit, the hollow unit having resilience and providing a cushion for object moored against the linear boat bumper unit, the boat bumper units combinable to allow for various aquatic dock designs.

37. The linear boat bumper system of claim 36 made by molding from linear low-density polyethylene (LLDPE) resins, polycarbonates, nylons, polyvinylchlorides, polyesters, acetals, acrylics, cellulosics, epoxies, fluorocarbons, phenolics, polystyrenes, polyurethanes, SAN polymers, silicone polymers, EVA copolymers and EBA.

* * * * *